United States Patent [19]

Katagiri et al.

[11] Patent Number: 4,471,040

[45] Date of Patent: Sep. 11, 1984

[54] ELECTROPHOTOGRAPHIC DISAZO PHOTOSENSITIVE MEMBER

[75] Inventors: Kazuharu Katagiri, Mitaka; Katsunori Watanabe, Yamato; Shozo Ishikawa, Sayama; Makoto Kitahara, Yokohama, all of Japan

[73] Assignees: Canon Kabushiki Kaisha; Copyer Kabushiki Kaisha, both of Tokyo, Japan

[21] Appl. No.: 300,581

[22] Filed: Sep. 9, 1981

[30] Foreign Application Priority Data

| | | | |
|---|---|---|---|
| Sep. 10, 1980 | [JP] | Japan | 55-124501 |
| Sep. 10, 1980 | [JP] | Japan | 55-124502 |
| Oct. 3, 1980 | [JP] | Japan | 55-137708 |
| Oct. 4, 1980 | [JP] | Japan | 55-138263 |
| Oct. 4, 1980 | [JP] | Japan | 55-138264 |
| Oct. 4, 1980 | [JP] | Japan | 55-138265 |
| Oct. 4, 1980 | [JP] | Japan | 55-138266 |
| Nov. 4, 1980 | [JP] | Japan | 55-153814 |
| Nov. 28, 1980 | [JP] | Japan | 55-166557 |

[51] Int. Cl.[3] ..... G03G 5/06; G03G 5/14

[52] U.S. Cl. ..... 430/59; 430/58; 430/76; 430/77; 430/78; 260/157; 260/158

[58] Field of Search ..... 430/58, 59, 76, 77, 430/78; 260/157, 158

[56] References Cited

U.S. PATENT DOCUMENTS

| | | | |
|---|---|---|---|
| 3,884,691 | 5/1975 | Rochlitz | 430/76 X |
| 4,260,672 | 4/1981 | Sasaki et al. | 430/78 X |
| 4,349,616 | 9/1982 | Sasaki | 430/79 X |
| 4,356,243 | 10/1982 | Ishikawa et al. | 430/79 X |

FOREIGN PATENT DOCUMENTS

| | | | |
|---|---|---|---|
| 2,302,522 | 8/1974 | Germany | 260/158 |

*Primary Examiner*—Roland E. Martin, Jr.

*Attorney, Agent, or Firm*—Fitzpatrick, Cella, Harper & Scinto

[57] ABSTRACT

An electrophotographic photosensitive member have a photosensitive layer, said photosensitive layer comprising at least one dis-azo pigment of Formula (I) or Formula (II) shown below:

Formula (I)

wherein Z represents an oxygen atom, a sulfur atom or $>N-A_2$, wherein $A_2$ is a hydrogen atom or a lower alkyl, $A_1$ a hydrogen atom, a lower alkyl or a halogen atom; $Ph_1$ an unsubstituted or substituted phenylene group, n an integer of 0 or 1, and $B_1$ a coupler residue; with proviso that when n is 0, Z is an oxygen atom and $A_1$ is a hydrogen atom, the case where $Ph_1$ represents substituted phenyl radicals except for unsubstituted or mono-substituted phenyl radicals with a halogen atom, a lower alkyl or an alkoxy group;

and

Formula (II)

wherein $Ph_2$ represents an unsubstituted or substituted phenylene group and $B_2$ a coupler residue.

171 Claims, No Drawings

ELECTROPHOTOGRAPHIC DISAZO PHOTOSENSITIVE MEMBER

BACKGROUND OF THE INVENTION

1. Field of the Invention

This invention relates to an electrophotographic photosensitive member containing a dis-azo pigment.

2. Description of the Prior Arts

As photosensitive members having layers containing organic pigments on a conductive layer known in the art, there are:

(i) a photosensitive member having a layer containing a pigment dispersed in an insulating binder provided on a conductive layer, as disclosed in Japanese Patent Publication No. 1667/1977 (Electrophotographic plate);

(ii) a photosensitive member having a layer containing a pigment dispersed in a charge transport medium, comprising a charge transport material or a combination of said material with an insulating binder (binder itself may be a charge transport material), provided on a conductive layer, as disclosed in U.S. Pat. No. 3,894,868 (Electrophotographic plate) and U.S. Pat. No. 3,870,516 (Electrophotographic imaging method);

(iii) a photosensitive member, comprising a conductive layer, a charge generation layer containing an organic pigment and a charge transport layer, as disclosed in U.S. Pat. No. 3,837,851 (Electrophotographic plate);

(iv) a photosensitive member, comprising an organic pigment added in a charge-transfer complex, as disclosed in U.S. Pat. No. 3,775,105 (Photoconductive member); and (v) others.

As the pigments to be used in such photosensitive members, there have been proposed a great number of pigments such as phthalocyanine type pigments, polycyclic quinone type pigments, azo type pigments and quinacridone type pigments, but use of such pigment has scarecely been successful in practical application.

This is because an organic photoconductive pigment was inferior in sensitivity or durability, as compared with inorganic photoconductive materials such as Se, CdS or ZnO.

On the other hand, an inorganic photosensitive member also involves problems. For example, in case of Se-type photosensitive member, crystallization will proceed due to such factors as temperature, humidity, finger mark, etc. In particular, when the atmosphere surrounding photosensitive member exceeds a temperature of about 40° C., crystallization is more pronounced, whereby there may be caused such disadvantages as lowering in charge bearing properties or formation of white spots on images. While the life of Se-type photosensitive member is said to be up to 30,000 through 50,000 copies, but there are much photosensitive members which cannot enjoy such a life, because of various environmental conditions depending on the regions and sites at which copying machines are placed.

The life of CdS type photosensitive member coated with an insulating layer is also similar to Se-type photosensitive member, but it is very difficult to overcome the drawback of poor humidity resistance. Under the present situation, a supplementary means such as heater is required to be used in order to prevent the photosensitive member from absorption of humidity.

In case of ZnO photosensitive member, it is sensitized with a dyestuff, typically Rose Bengal, and therefore there is such a problem as charge deterioration caused by corona discharge or colour fastness. At the present time, the life of this type of photosensitive member is about 1000 sheets of copies.

The sensitivities of photosensitive members, as represented by exposure quantity for halving original potential ($E_{\frac{1}{2}}$) are about 15 lux·sec for unsensitized Se-type photosensitive member, and 4 to 8 lux·sec for sensitized one. The sensitivity of CdS type photosensitive member is similar to that of sensitized Se, while ZnO type photosensitive member has about 7 to 12 lux·sec of sensitivity.

As a sensitivity of practical photosensitive member, $E_{\frac{1}{2}}$ value is desired to be 20 lux·sec or lower in case of a PPC copying machine, more preferably 15 lux·sec or lower for a high copying speed PPC copying machine. But, depending on uses, it is also possible to use a photosensitive member having a sensitivity lower than that mentioned above.

SUMMARY OF THE INVENTION

An object of the present invention is to provide a novel electrophotographic photosensitive member, which has overcome the drawbacks of inorganic photosensitive members of prior art and also improved the drawbacks of organic electrophotographic photosensitive members hitherto proposed.

Another object of the present invention is to provide an electrophotographic photosensitive member having a laminated structure comprising a charge generation layer and a charge transport layer.

Still another object of the present invention is to provide a dis-azo pigment suitable for use in a photosensitive layer having a laminated structure comprising a charge generation layer and a charge transport layer.

Also, another object of the present invention is to provide an electrophotographic photosensitive member provided with a layer containing a dis-azo pigment and a charge transport material.

Further, still another object of the present invention is to provide an excellent electrophotographic photosensitive member, of which photosensitive member containing a dis-azo pigment has a high sensitivity and a high durability to be actually used and in which heat resistance (crystallization of Se), humidity resistance and color fastness, which have been the problems in inorganic photosensitive members, are overcome.

Other objects of the present invention will readily be apparent from the following description.

According to the present invention, there is provided an electrophotographic photosensitive member having a photosensitive layer, said photosensitive layer comprising at least one dis-azo pigment of Formula (I) or Formula (II) shown below:

Formula (I)

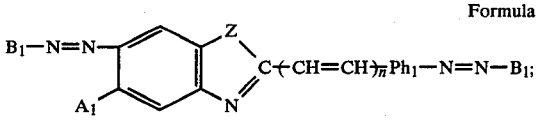

wherein Z represents an oxygen atom, a sulfur atom or $>N—A_2$, wherein $A_2$ is a hydrogen atom or a lower alkyl, $A_1$ a hydrogen atom, a lower alkyl or a halogen atom; $Ph_1$ an unsubstituted or substituted phenylene group, n an integer of 0 or 1, and $B_1$ a coupler residue; with proviso that when n is 0, Z is an oxygen atom and $A_1$ is a hydrogen atom, the case where $Ph_1$ represents substituted phenyl radicals except for unsubstituted or mono-substituted phenyl radicals with a halogen atom, a lower alkyl or an alkoxy group; and Formula (II)

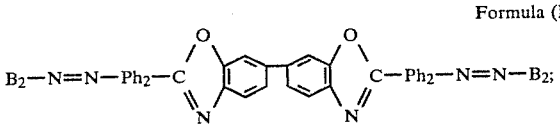

wherein $Ph_2$ represents an unsubstituted or substituted phenylene group and $B_2$ a coupler residue.

DETAILED DESCRIPTION OF THE EMBODIMENTS OF THE INVENTION

The dis-azo pigment to be used in the present invention is represented by Formula (I) or Formula (II) shown below:

(I)

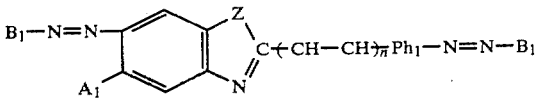

(II)

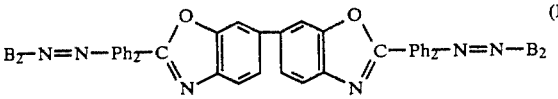

In the above formulae, Z represents an oxygen atom, a sulfur atom or $>N—A_2$, wherein $A_2$ is a hydrogen atom or a lower alkyl (e.g. a straight chain or branched alkyl such as methyl, ethyl, propyl or butyl). $A_1$ represents a hydrogen atom, a lower alkyl (e.g. a straight chain or branched alkyl such as methyl, ethyl, propyl or butyl) or a halogen atom (e.g. chlorine, bromine or fluorine).

$Ph_1$ and $Ph_2$ each represents a phenylene group, particularly preferably a p-phenylene group. This phenylene group may be substituted with a suitable atom (e.g. a halogen atom such as chlorine, bromine or iodine) or an organic residue (e.g. a straight chain or branched lower alkyl such as methyl, ethyl, propyl or butyl; an alkoxy such as methoxy, ethoxy, propoxy or butoxy; an acylamino such as acetylamino, propionylamino, butyrylamino, benzoylamino or toluoylamino; nitro; or hydroxyl). In the phenylene radical, these substituent atoms or groups may be present in number of one or more, and when there are two or more substituent atoms or groups, they may be the same or different. n is an integer of 1 or 0.

$B_1$ and $B_2$ represent coupler residues. Typical examples of coupler residues may include those represented by the following Formula (III), (IV) or (V) shown below.

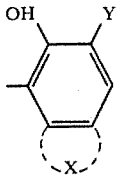

wherein X is an atomic group forming a naphthalene-, anthracene-, carbazole or dibenzofuran-ring together with the benzene ring; and Y is a group of the formula

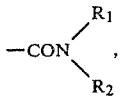

wherein $R_1$ is an atom or radical selected from the group consisting of hydrogen atom, unsubstituted and substituted alkyls, unsubstituted or substituted phenyls, and $R_2$ is a radical selected from the group consisting of unsubstituted or substituted alkyls, unsubstituted or substituted phenyls, unsubstituted or substituted naphthyls and disubstituted amino groups.

As the alkyl group, there may be mentioned methyl, ethyl, n- and iso-propyl, n-, iso- and t-butyl, octyl (e.g. n-octyl and 2-ethylhexyl), etc. As the di-substituted amino group, there may be mentioned diphenylamino, dibenzylamino, dimethylamino, diethylamino, dipropylamino, dibutylamino, etc.

As the substituents in $R_1$ and $R_2$ of the above formula, there are included an alkyl group such as methyl, ethyl, n- and iso-propyl, n-, iso- and t-butyl, octyl; a halogen atom such as fluorine, chlorine or bromine; an alkoxy such as methoxy, ethoxy, propoxy or butoxy; an acyl group such as acetyl, propionyl, butyryl, benzoyl or toluoyl; an alkylthio group such as methylthio, ethylthio, propylthio or butylthio; an arylthio group such as phenylthio, toluylthio or xylylthio; an aryl group such as phenyl, toluyl or xylyl; an aralkyl such as benzyl; nitro groups; cyano group; an alkylamino group such as dimethylamino, ethylamino, diethylamino, dibenzylamino, dipropylamino, etc.

(IV)

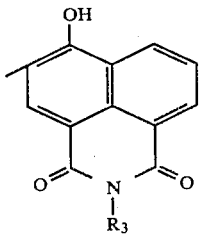

(V)

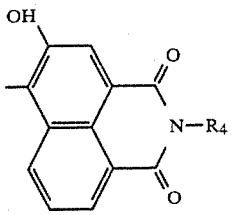

In the above formulae, $R_3$ and $R_4$ represent groups selected from the group consisting of unsubstituted or substituted alkyl groups and unsubstituted or substituted phenyl groups. More specifically, $R_3$ and $R_4$ represent alkyl groups such as methyl, ethyl, propyl, and butyl; hydroxylalkyl groups such as hydroxymethyl, 2-hydroxyethyl, and 3-hydroxypropyl; alkoxyalkyl groups such as methoxymethyl, ethoxymethyl, 2-ethoxyethyl, and 3-methoxypropyl; cyanoalkyl groups such as cyanomethyl, 2-cyanoethyl, 3-cyanopropyl, and 4-cyanobutyl; aminoalkyl groups such as aminomethyl, 2-aminoethyl, 3-aminopropyl, and 2-aminopropyl; N-alkylaminoalkyl groups such as N-methylaminomethyl, N-ethylaminomethyl, 2-N-methylaminoethyl, 2-N-ethylaminoethyl, and 3-N-methylaminopropyl; N,N-dialkylaminoalkyl groups such as N,N-dimethylaminomethyl, N,N-diethylaminomethyl, and 2,N,N-dimethylaminoethyl; substituted alkyl groups including halogenated alkyl groups such as chloromethyl, bromomethyl, 2-chloroethyl, 2-bromoethyl, 3-chloropropyl, and 3-bromopropyl, and aralkyl groups such as benzyl and phenethyl; and unsubstituted or substituted phenyl groups, there may be included those as mentioned with respect to $R_1$ and $R_2$ in Formula (III).

Among the dis-azo pigments represented by the above Formula (I), the following dis-azo pigments represented by the formulae (A) through (H) are preferred. As the dis-azo pigment represented by the Formula (II), the dis-azo pigment represented by the formula (J) is preferred.

(A)

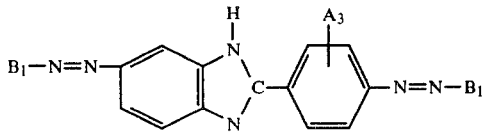

(B)

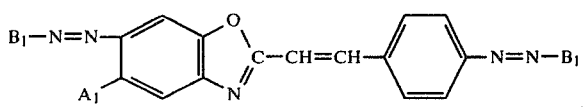

(C)

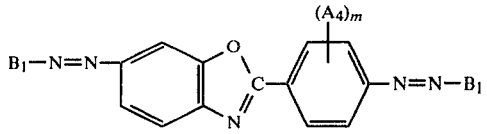

(D)

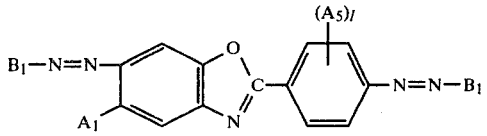

(E)

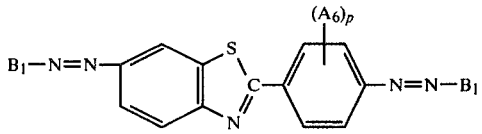

(F)

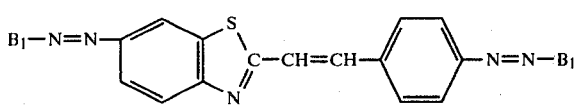

(G)

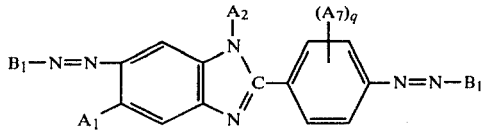

(H)

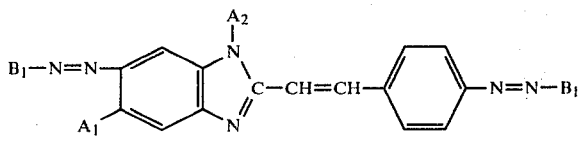

(J)

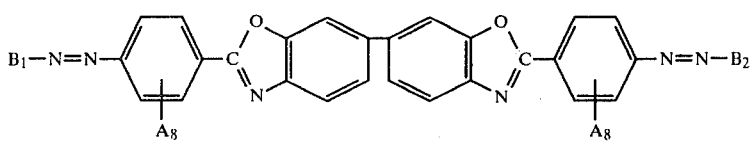

In the above formulae, $B_1$ and $B_2$ have the same meanings as described above, namely coupler residues. $A_1$ and $A_2$ have also the same meanings as described above, $A_1$ representing a hydrogen atom, a lower alkyl or a halogen atom and $A_2$ a hydrogen atom or a lower alkyl. But in the formula (B), $A_1$ represents a hydrogen atom, a lower alkyl or a halogen atom, preferably a hydrogen atom, a chlorine atom or methyl. In the formula (D), $A_1$ represents a halogen atom or a lower alkyl, preferably a chlorine atom or a methyl. In the formula (G), $A_1$ represents a lower alkyl, preferably a methyl. In the formula (H), $A_1$ represents a hydrogen atom or a lower alkyl, preferably a hydrogen atom or a methyl.

$A_3$ represents a hydrogen atom, a halogen atom, a lower alkyl group, an alkoxy group, a nitro group or an acylamino group. $A_4$ represents a hydroxyl group or an acylamino group when m is an integer of 1 to 4, and also an alkoxy group when m is an integer of 2 to 4. $A_5$ represents a hydrogen atom, a halogen atom, a lower alkyl group, a lower alkoxy group, an acylamino group or a hydroxyl group and l is an integer of 1 to 4. $A_6$ represents a hydrogen atom, a halogen atom, a lower alkyl group, a lower alkoxy group, an acylamino group or a hydroxyl group and p is an integer of 1 to 4. $A_7$ represents a hydrogen atom, a halogen atom, a lower alkyl group, a lower alkoxy group, an acylamino group or a hydroxyl group and q is an integer of 1 to 4. $A_8$ represents a hydrogen atom, a halogen atom, a lower alkyl group, an alkoxy group, an acylamino group or a nitro group.

Typical examples of the halogen atom mentioned above may include chlorine, bromine, iodine and fluorine atoms; those of the lower alkyl group methyl, ethyl, propyl, isopropyl, butyl, iso-butyl, and t-butyl groups; those of the lower alkoxy group methoxy, ethoxy, propoxy and butoxy groups; and those of the acylamino group acetylamino, propionylamino, butyrylamino, benzoylamino and toluoylamino groups.

Specific examples of the dis-azo pigments as represented by the formulae (A) through (H) and (J) are enumerated below, other specific examples being also described in Examples set forth below.

Dis-azo pigments

No. 1: example of formula (A)

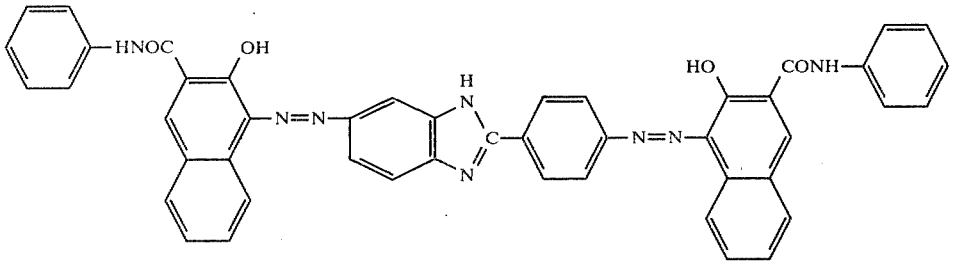

No. 10: example of formula (A)

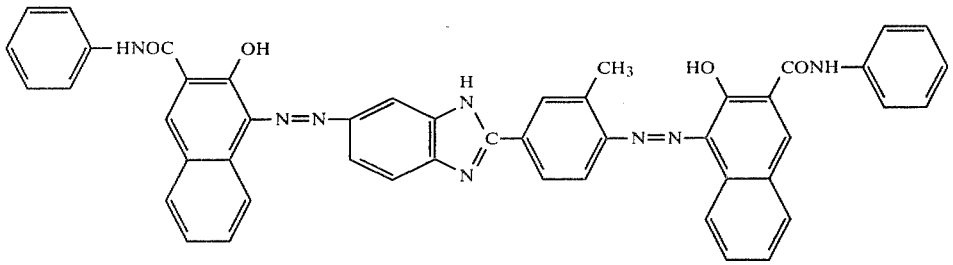

No. 13: example of formula (B)

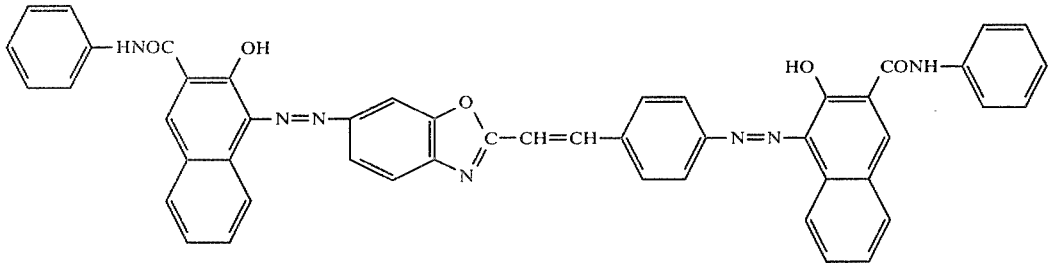

No. 28: example of formula (C)

-continued
Dis-azo pigments
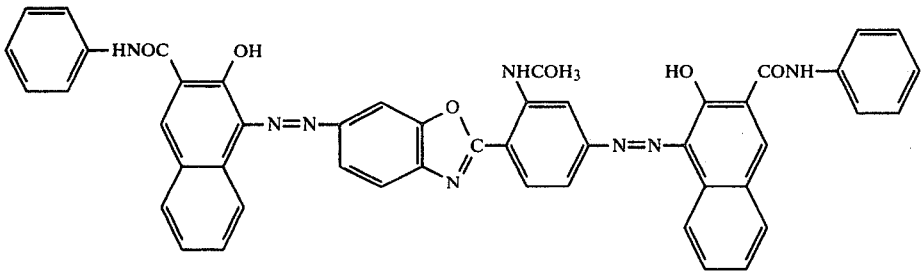
No. 43: example of formula (D)
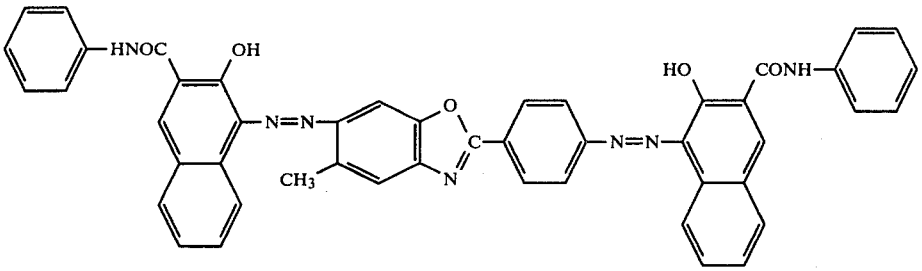
No. 62: example of formula (E)
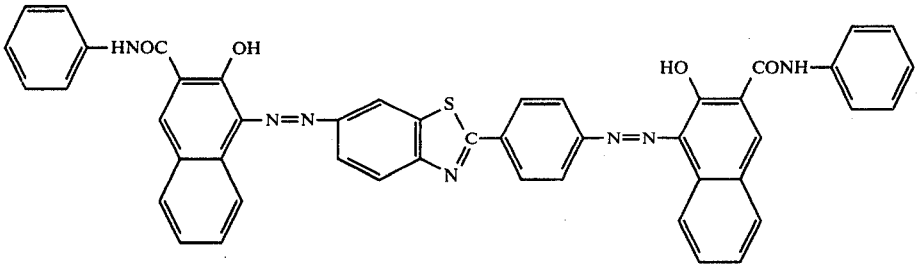
No. 72: example of formula (E)
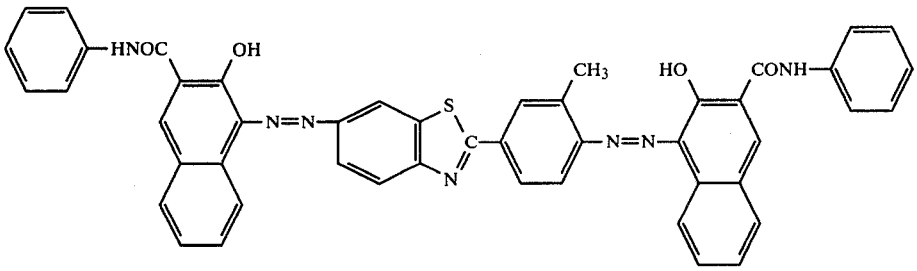
No. 80: example of formula (F)
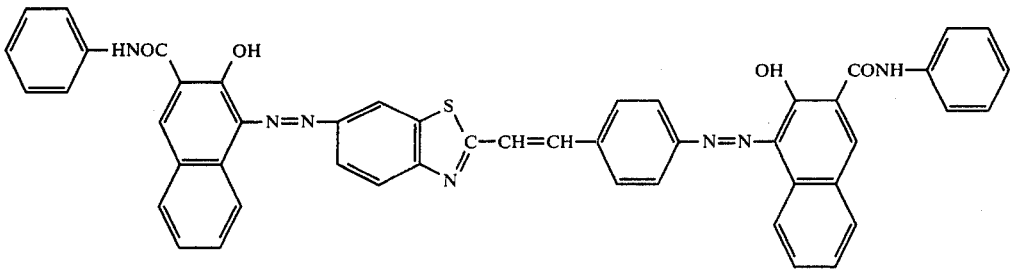
No. 91: example of formula (G)

-continued

Dis-azo pigments

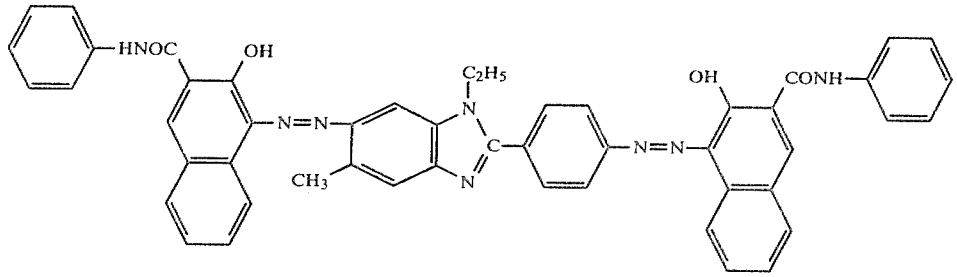

No. 107: example of formula (H)

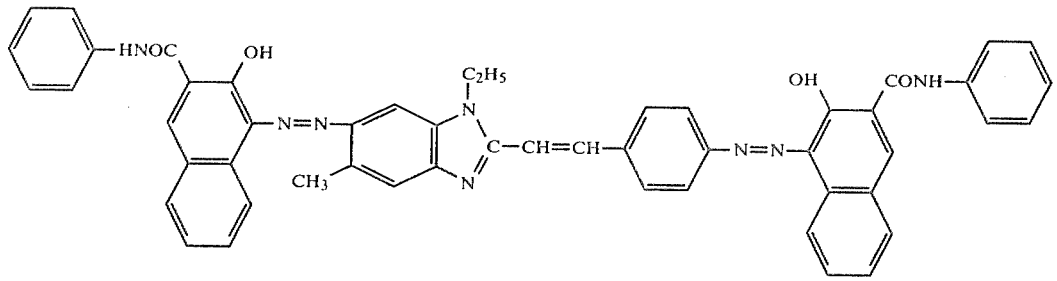

No. 121: example of formula (J)

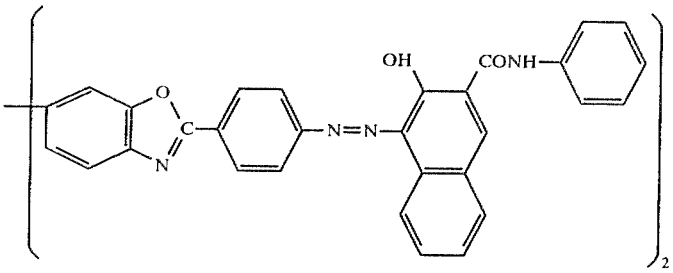

The dis-azo pigment represented by the formula (A) can readily be prepared by tetrazotizing in a conventional manner a diamine which is the starting compound represented by the formula:

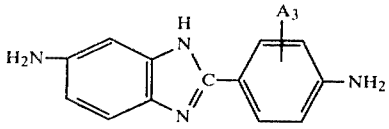

(1)

wherein $A_3$ has the same meaning as mentioned above, and then coupling the tetrazotized product in the presence of an alkali with a coupler with a structure having a hydrogen atom at the coupling position of a coupling residue represented by the formula (III) to (V), or alternatively by isolating once a tetrazonium salt of the diamine of the formula (1) in the form of a borofluoride salt or a zinc chloride salt, followed by coupling with a coupler with a structure having a hydrogen atom at the coupling position of a coupling residue represented by the formula (III) to (V) in the presence of an alkali in a suitable solvent such as N,N-dimethylformamide, dimethyl sulfoxide, and the like.

The dis-azo pigment represented by the formula (B) can readily be prepared by tetrazotizing in a conventional manner a diamine which is the starting material represented by the formula:

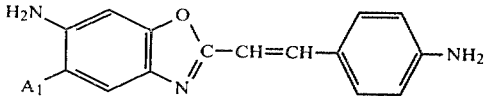

(2)

wherein $A_1$ has the same meaning as mentioned above, and then coupling the tetrazotized product in the presence of an alkali with a coupler with a structure having a hydrogen atom at the coupling position of a coupling residue represented by the formula (III) to (V), or alternatively isolating once a tetrazonium salt of the diamine of the formula (2) in the form of a borofluoride salt or a zinc chloride salt, followed by coupling with a coupler with a structure having a hydrogen atom at the coupling position of a coupling residue represented by the formula (III) to (V) in the presence of an alkali in a suitable solvent such as N,N-dimethylformamide, dimethyl sulfoxide, and the like. The diamine represented by the formula (2) can be synthesized according to the method described in Belgian Pat. No. 623,386 (1963).

The dis-azo pigment represented by the formula (C) can readily be prepared by tetrazotizing a diamine which is the starting compound represented by the formula:

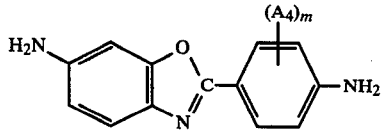

(3)

wherein $A_4$ and m have the same meanings as mentioned above, according to a conventional method, and then coupling the tetrazotized product with a coupler in the presence of an alkali, or alternatively by isolating a tetrazonium salt of a diamine of the formula (3) once in the form of a borofluoride or a zinc chloride salt, followed by coupling with a coupler in the presence of an alkali in a suitable solvent such as N,N-dimethylformamide, dimethyl sulfoxide, and the like.

The dis-azo pigment represented by the formula (D) can readily be prepared by tetrazotizing a diamine which is the starting compound represented by the formula:

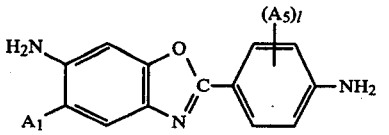

(4)

wherein $A_1$, $A_5$ and l have the same meanings as mentioned above, according to a conventional method and then coupling the tetrazotized product with a coupler in the presence of an alkali, or alternatively by isolating once a tetrazonium salt of a diamine of the formula (4) in the form of a borofluoride salt or a zinc chloride salt, followed by coupling with a coupler in a suitable solvent such as N,N-dimethylformamide, dimethyl sulfoxide, and the like.

The dis-azo pigment represented by the formula (E) can readily be prepared by tetrazotizing a diamine which is the starting compound represented by the formula:

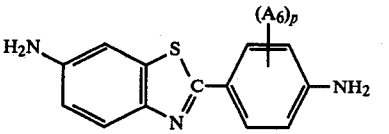

(5)

wherein $A_6$ and p have the same meanings as mentioned above, according to a conventional method, and then coupling the tetrazotized product with a coupler in the presence of an alkali, or alternatively by isolating a tetrazonium salt of a diamine of the formula (5) once in the form of a borofluoride or a zinc chloride salt, followed by coupling with a coupler in the presence of an alkali in a suitable solvent such as N,N-dimethylformamide, dimethyl sulfoxide, and the like.

The dis-azo pigment represented by the formula (F) can readily be prepared by tetrazotizing in a conventional manner a diamine which is the starting compound represented by the formula:

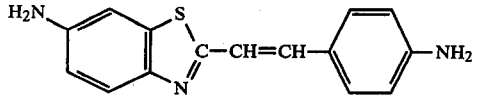

(6)

and then coupling the tetrazotized product with a coupler in the presence of an alkali, or alternatively by isolating once a tetrazonium salt of a diamine of the formula (6) in the form of a borofluoride salt or a zinc chloride salt, followed by coupling with a coupler in a suitable solvent such as N,N-dimethylformamide, dimethyl sulfoxide, and the like.

The dis-azo pigment represented by the formula (G) can readily be prepared by tetrazotizing a diamine which is the starting compound represented by the formula:

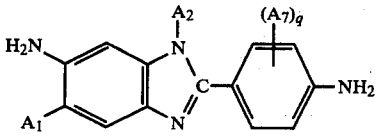

(7)

wherein $A_1$, $A_2$, $A_7$ and q have the same meanings as mentioned above, according to a conventional method, and then coupling the tetrazotized product with a coupler in the presence of an alkali, or alternatively by isolating a tetrazonium salt of a diamine of the formula (7) once in the form of a borofluoride or a zinc chloride salt, followed by coupling with a coupler in the presence of an alkali in a suitable solvent such as N,N-dimethylformamide, dimethyl sulfoxide, and the like.

The dis-azo pigment represented by the formula (H) can readily be prepared by tetrazotizing a diamine which is the starting compound represented by the formula:

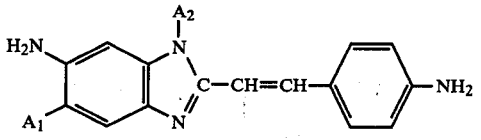

(8)

wherein $A_1$ and $A_2$ have the same meanings as mentioned above, according to a conventional method and then coupling the tetrazotized product with a coupler in the presence of an alkali, or alternatively by isolating once a tetrazonium salt of a diamine of the formula (8) in the form of a borofluoride salt or a zinc chloride salt, followed by coupling with a coupler in a suitable solvent such as N,N-dimethylformamide, dimethyl sulfoxide, and the like.

The dis-azo pigment represented by the formula (J) can readily be prepared by tetrazotizing in a conventional manner a diamine which is the starting material represented by the formula:

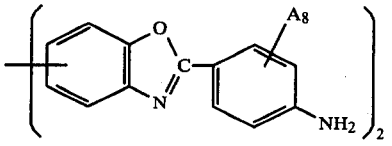

(9)

wherein $A_8$ has the same meaning as mentioned above, and then coupling the tetrazotized product in the presence of an alkali with a coupler with a structure having a hydrogen atom at the coupling position of a coupling residue represented by the formula (III) to (V), or alternatively isolating once a tetrazonium salt of the diamine of the formula (9) in the form of a borofluoride salt or a zinc chloride salt, followed by coupling with a coupler with a structure having a hydrogen atom at the coupling position of a coupling residue represented by the formula (III) to (V) in the presence of an alkali in a suitable solvent such as N,N-dimethylformamide, dimethyl sulfoxide, and the like.

The specific feature of the electrophotographic photosensitive member according to the present invention resides in having a photosensitive layer containing a dis-azo pigment represented by the formula (I) or (II) as described above, and may be applicable for any type of electrophotographic photosensitive members (i) to (v) as mentioned previously. It is desirable, however, to use the type (ii), (iii) or (iv) for enhancement of transporting efficiency of charge-carriers generated by absorption of light by the dis-azo pigment represented by the formula (I). Further, for the best use of characteristic of said pigment, it is most preferred to use the type (iii) photosensitive member in which charge-carrier generating function is separated from transporting function.

In the following, this type of electrophotographic photosensitive member is described in detail.

As the layer constitution, conductive layer, charge generation layer and charge transport layer are essential. A charge generation layer may be provided either above or beneath a charge transport layer, but in an electrophotographic photosensitive member of the type repeatedly used, it is preferable to overlay a conductive layer, a charge generation layer and a charge transport layer in the order mentioned, from aspects primarily of physical strength and sometimes of charge bearing properties. For the purpose of improving adhesion between a conductive layer and a charge generation layer, there may also be provided an adhesive layer, if desired.

As a conductive layer, there may be employed a metal plate or a metal foil such as of aluminum, a plastic film on which a metal such as aluminum is vapor deposited, a laminate of aluminum foil with paper or a conductivized paper.

As the material for an adhesive layer, there may effectively be used a resin such as casein, polyvinyl alcohol, water-soluble ethylene-acrylic acid copolymer, nitrocellulose or hydroxypropylcellulose. The thickness of the adhesive layer may suitably be 0.1 through 5μ, preferably 0.5 through 3μ.

On a conductive layer or on an adhesive layer applied on a conductive layer, there is provided a charge generation layer by coating a dis-azo pigment represented by the formula (I) or (II) after micro-pulverization without binder or, if necessary, as a dispersion in a suitable binder solution, followed by drying. A dis-azo pigment may be dispersed by use of a known method using ball mill, attritor, etc., whereby the pigment particles may desirably be ground to sizes of 5μ or less, preferably 2μ or less, most preferably 0.5μ or less.

A dis-azo pigment can be coated as a solution dissolved in an amine type solvent such as ethylenediamine. As the coating method, there may be employed a conventional method such as blade coating, Meyer bar coating, spray coating or dip coating.

A charge generation layer may have a thickness of 5μ or less, preferably 0.01 to 1μ. When a binder is used in a charge generation layer, too much quantity of the binder will affect its sensitivity and hence the percentage of the binder in a charge transport layer should desirably be 80% by weight or less, preferably 40% by weight or less.

The binders to be used may include various resins such as polyvinyl butyral, polyvinyl acetate, polyesters, polycarbonates, phenoxy resins, acrylic resins, polyacrylamide, polyamides, polyvinyl pyridine resin, cellulose type resins, urethane resins, epoxy resins, casein, polyvinyl alcohol and the like.

On the thus provided charge generation layer, there is provided a charge transport layer. When a charge transport material has no ability to form a coated film, the material added in a solution containing a binder dissolved in a suitable organic solvent is coated and dried in a conventional manner to form a charge transport layer.

As charge transport materials, there are electron-transporting materials and hole-transporting materials.

The electron-transporting materials may include electron attractive substances such as chloranil, bromanil, tetracyanoethylene, tetracyanoquinodimethane, 2,4,7-trinitro-9-fluorenone, 2,4,5,7-tetranitrofluorenone, 2,4,7-trinitro-9-dicyanomethylene-fluorenone, 2,4,5,7-tetranitroxanthone, 2,4,8-trinitrothioxanthone, and the like, and polymerized products of these electron attractive substances.

The hole-transporting substances may include pyrene, N-ethyl-carbazole, N-isopropylcarbazole, hydrazones such as N-methyl-N-phenylhydrazino-3-methylidene-9-ethylcarbazole, N,N-diphenylhydrazino-3-methylidene-9-ethylcarbazole, p-diethylaminobenzaldehyde-N,N-diphenyl hydrazone, and the like, 2,5-bis(p-diethylaminophenyl)-1,3,4-oxadiazole, pyrazolines such as 1-phenyl-3-(p-diethylaminostyryl)-5-(p-diethylaminophenyl)pyrazoline, 1-[pyridyl-(2)]-3-(p-diethyl-aminostyryl)-5-(p-diethylaminophenyl)pyrazoline, 1-[quinolyl-(2)]-3-(p-diethylaminostyryl)-5-(p-diethylaminophenyl)pyrazoline, and the like, oxazoles such as 2-(p-diethylaminophenyl)-4-dimethylamino-5-(2-chlorophenyl)oxazole, 2-(p-diethylaminophenyl)-4-(p-dimethylaminophenyl)-5-(o-chlorophenyl)oxazole, and the like, diaryl alkanes such as 1,1-bis(p-diethylaminophenyl)propane, triphenylamine, poly-N-vinylcarbazole, halogenated poly-N-vinylcarbazole, polyvinylpyrene, polyvinylanthracene, polyvinylacridine, poly-9-vinylphenylanthracene, pyrene-formaldehyde resin, ethylcarbazole-formaldehyde resin, and the like. The charge transport materials are not limited to those herein mentioned, and they may be used as a single species or as a mixture of two or more species. But, when an electron-transporting material is mixed with a hole-transporting material, charge-transport absorption may occur at the visible portion, whereby the light when exposed may not reach the charge generation layer beneath the charge transport layer.

A charge transport layer may have a thickness of 5 to 30μ, preferably 8 to 20μ.

As a binder, there may be employed an acrylic resins, polystyrene, polyesters, polycarbonates, and the like. It is possible to use a hole-transporting polymer such as previously mentioned poly-N-vinylcarbazole, and the like, as a binder for a low molecular hole-transporting material. On the other hand, as a binder for a low molecular electron-transporting material, there may be used a polymer of electron-transporting monomers as disclosed in U.S. Pat. No. 4,122,113.

In using a photosensitive member having layered in the order of a conductive layer, a charge generation layer and a charge transport layer, when a charge transport material comprises an electron-transporting material, it is necessary to charge positively the surface of the electron transport layer. In the exposed area, upon exposure after charging, electrons generated in the charge generation layer are injected into the charge transport layer and thereafter arrive the surface to neutralize the positive charges thereon, whereby attenuation of surface potential is caused to form electrostatic contrasts between the exposed and unexposed areas. The thus formed electrostatic latent image can be developed with a negatively chargeable toner to give a visible image. This can be fixed directly or the toner image may be transferred on paper or plastic film and thereafter developed and fixed.

It is also possible to use a method wherein developing and fixing are effected after transferring the electrostatic latent image on an insulating layer of a copying paper. The developer employed, the developing method and the fixing method may be any of those known in the art and not limited to specific ones.

On the other hand, when the charge transport material comprises a hole-transporting material, it is necessary to charge negatively the surface of the charge transport layer. In the exposed area, upon exposure after charging, holes generated in the charge generation layer are injected into the charge transport layer and thereafter reach the surface to neutralize the negative charges thereon, whereby attenuation of the surface potential is caused to form electrostatic contrasts between the exposed and unexposed area. At the time of developing, it is necessary to use a positively chargeable toner, contrary to the case when using an electron-transporting material.

A photosensitive member of the type (i) can be prepared by dispersing a dis-azo pigment represented by the formula (I) or (II) into a solution of an insulating binder as can be used in charge transport layer of photosensitive member of the type (iii) photosensitive member, and then coating the dispersion on a conductive support, followed by drying.

A photosensitive member of the type (ii) can be prepared by dissolving an insulating binder as can be used for the charge transport material and the charge transport material for the photosensitive member of the type (iii) in a suitable solvent, dispersing a dis-azo pigment represented by the formula (I) in the resultant solution and then coating the dispersion on a conductive support, followed by drying.

A photosensitive member of the type (iv) can be prepared by dispersing a dis-azo pigment represented by the formula (I) or (II) in a solution of a charge-transfer complex, which is formed by combination of the electron-transporting material and the hole-transporting material as mentioned in the type (iii) photosensitive member, and then coating the dispersion on a conductive support, followed by drying.

In any of the photosensitive members, there is contained at least one dis-azo pigment selected from those represented by the formula (I) or (II). If necessary, it is also possible to use a combination of pigments with different light absorptions to enhance sensitivity of the photosensitive member; to use a combination of at least two dis-azo pigments represented by the formula (I) or (II) for the purpose obtaining a panchromatic photosensitive member; or to use a combination of said pigment with a charge generation material selected from known dyestuffs or pigments.

The electrophotographic photosensitive member according to the present invention can be utilized not only for electrophotographic copying machines but also for a wide applications of electrophotography such as laser printer, CRT printer, and the like.

Typical dis-azo pigments to be used in the present invention are illustrated below with reference to the Synthesis examples.

SYNTHESIS EXAMPLE 1

(No. 1)

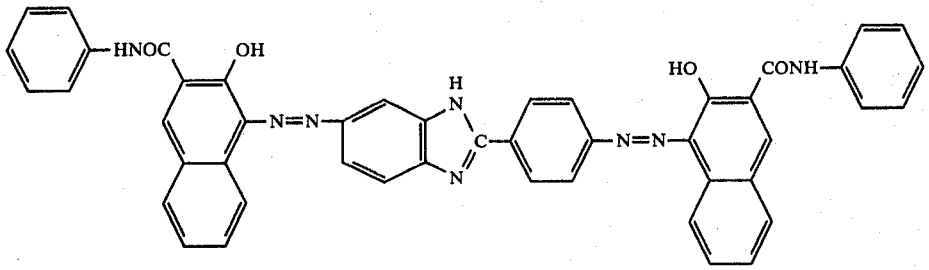

A dispersion comprising 8.0 g (0.036 mole) of 2-(p-aminophenyl)-5(6)-aminobenzimidazole, prepared according to the method as described in Ber. 32, 2178–2180 (1899), 15 ml (0.17 mole) of conc. hydrochloric acid and 250 ml of water was cooled to 4.5° C., and while maintaining the temperature of the dispersion at 4.5° to 5.5° C., a solution of 5.2 g (0.075 mole) of sodium nitrite dissolved in 25 ml of water was added dropwise to the dispersion over 20 minutes, followed further by stirring for 20 minutes, to obtain a tetrazotized solution. Then, in 900 ml of water, there were dissolved 33 g (0.82 mole) of caustic soda and 19.7 g (0.075 mole) of naphthol AS (3-hydroxy-2-naphthoic acid anilide) and, while maintaining the solution at 5° to 10° C., the previously synthesized tetrazotized solution was added dropwise to the naphthol AS solution over 30 minutes. Sritting was continued for additional one hour, followed by leaving to stand at room temperature overnight. The pigment obtained by filtration of the reaction mixture was washed with water and then with acetone, and dried to give 25 g of a crude pigment (crude yield from diamine: 91%).

As the next step, the crude pigment was subjected to hot filtration 5 times with 400 ml of DMF and once with acetone to obtain 17.4 g of a pigment (pure yield from diamine: 63%). Decompd. at 300° C. or higher, Max. absorption wavelength 577 nm (o-dichlorobenzene solution), IR absorption spectrum amide 1655 $cm^{-1}$.

SYNTHESIS EXAMPLE 2

(No. 121)

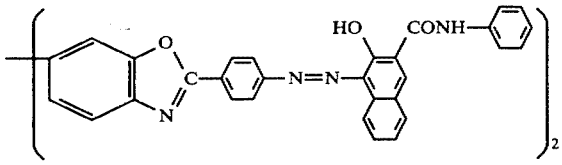

A dispersion comprising 4.0 g (0.009 mole) of 2,2'-p-aminophenyl-6,6'-bibenzoxazole, 120 ml of water and 5.9 ml (0.067 mole) of conc. hydrochloric acid was cooled to 4.5° C., and while maintaining the dispersion temperature at 4.5° to 6° C., a solution of 1.4 g (0.02 mole) of sodium nitrite dissolved in 10 ml of water was added dropwise to the dispersion over 20 minutes, followed further by stirring at the same temperature for 40 minutes, to obtain a tetrazotized solution.

Then, in 250 ml of water, there were dissolved 8.9 g (0.22 mole) of caustic soda and 5.3 g (0.020 mole) of naphthol AS (3-hydroxy-2-naphthoic acid anilide). While maintaining the solution at 3.5° to 7° C., the previously synthesized tetrazotized solution was added dropwise thereto over one hour and 15 minutes. Stirring was further continued for 3 hours, followed by leaving to stand at room temperature overnight. The pigment obtained by filtration of the reaction mixture was washed with water and then with acetone, followed by drying, to give 7.0 g of a crude pigment (crude yield from diamine: 76%). The crude pigment was then subjected to hot filtration 5 times with 400 ml of DMF and once with acetone, and dried to give 5.5 g of pigment (pure yield from diamine: 65%). Decompd. at 300° C. or higher, visible spectrum max. absorption wavelength 557 nm (o-dichlorobenzene solution), IR absorption spectrum: amide 1670 $cm^{-1}$.

Having described synthetic methods for two kinds of dis-azo pigments, other dis-azo pigments represented by the formula (I) or (II) can also be synthesized according to similar procedures to the above.

The present invention is further illustrated by the following Examples.

EXAMPLE 1

On an aluminum plate, there was coated a solution of casein in an aqueous ammonia (casein 11.2 g. 28% aqueous ammonia, 1 g, water 222 ml) by means of Meyer bar and dried to form an adhesive layer of 1.0 $g/m^2$. Then, 5 g of the pigment No. 1 together with a solution of 2 g of a polyvinyl butyral (content of butyral: 63 mole%) dissolved in 95 ml of ethanol was dispersed in a ball mill, and the dispersion was coated by a Meyer bar on the adhesive layer to form a charge generation layer of 0.2 $g/m^2$ after drying. Subsequently, a solution prepared by dissolving 5 g of 1-phenyl-3-(p-diethylaminostyryl)-5-(p-diethylaminophenyl)pyrazoline and 5 g of polycarbonate of 2,2-bis(4-hydroxyphenyl)propane (molecular weight: about 30,000) in 70 ml of tetrahydrofuran was coated on the charge generation layer and dried to form a charge transport layer of 10 $g/m^2$. The thus prepared electrophotographic photosensitive member was conditioned at 20° C. at a relative humidity of 65% and thereafter subjected to corona charging at −5 KV by a static process using an electrostatic copying paper test device (Model SP-428; produced by Kawaguchi Denki Co., Ltd.) and, after being retained in a dark place for 10 seconds, exposed to light at an illuminance of 5 lux·sec for examination of charge bearing characteristics.

The initial potential is represented by $V_0(-V)$, the potential retentivity after standing in a dark place for 10 seconds by $V_k(\%)$ and the exposure quantity for halving initial potential by $E\ \frac{1}{2}$ (lux·sec).

$V_0$−480 V; $V_k$ 87%; $E\ \frac{1}{2}$ 11 lux·sec

EXAMPLES 2–14

Example 1 was repeated except for use of the dis-azo pigments represented by the formula (A), wherein $B_1$ and $A_3$ are as indicated in Table 1, in place of the pigment No. 1. The results of the charging tests are shown in Table 2.

TABLE 1

(Structures of pigments used)

| Example | Pigment No. | Dis-azo pigment: $A_3$ (Position relative to azo group is indicated in bracket) | Dis-azo pigment: $B_1$ |
|---|---|---|---|
| 2 | 2 | H | 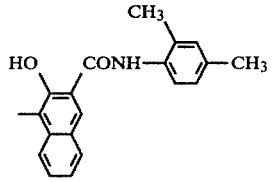 |
| 3 | 3 | H | 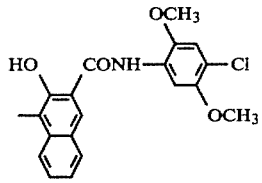 |
| 4 | 4 | H | 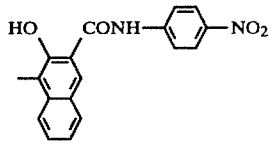 |
| 5 | 5 | H | 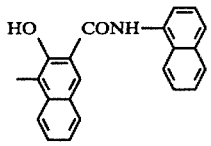 |
| 6 | 6 | H | 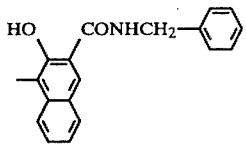 |
| 7 | 7 | H | 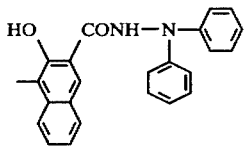 |

TABLE 1-continued (Structures of pigments used)

| Example | Pigment No. | Dis-azo pigment $A_3$ (Position relative to azo group is indicated in bracket) | $B_1$ |
|---|---|---|---|
| 8 | 8 | H | 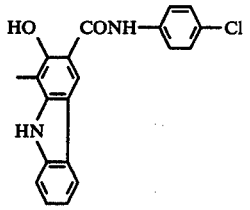 |
| 9 | 9 | H | 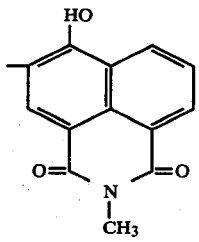 |
| 10 | 10 | $CH_3$ (O—position) | 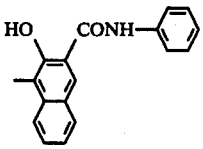 |
| 11 | 11 | Cl (m-position) | 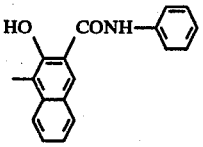 |
| 12 | 12 | $NHCOCH_3$ (O—position) | 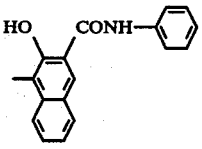 |
| 13 | 13 | H | 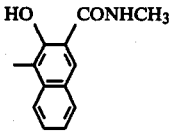 |
| 14 | 14 | H | 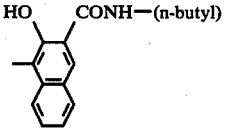 |

TABLE 2

(Charge bearing characteristics)

| Example | $V_O$ (−V) | $V_k$ (%) | $E_{\frac{1}{2}}$ (lux · sec) |
|---|---|---|---|
| 2 | 480 | 89 | 14.0 |
| 3 | 510 | 91 | 13.8 |
| 4 | 510 | 88 | 15.0 |
| 5 | 490 | 90 | 12.0 |
| 6 | 475 | 93 | 17.0 |
| 7 | 480 | 90 | 18.3 |
| 8 | 510 | 91 | 12.3 |
| 9 | 500 | 88 | 10.9 |
| 10 | 480 | 86 | 10.3 |
| 11 | 490 | 91 | 11.6 |
| 12 | 510 | 92 | 13.8 |
| 13 | 520 | 90 | 8.9 |
| 14 | 510 | 89 | 11.0 |

EXAMPLE 15

On the charge generation layer as prepared in Example 1, a solution prepared by dissolving 5 g of 2,4,7-trinitrofluorenone and 5 g of the same polycarbonate resin as used in Example 1 in 70 ml of tetrahydrofuran was coated by a Meyer bar in a coating weight after drying of 12 g/m$^2$. Measurement of charge bearing characteristics was conducted in entirely the same manner as in Example 1 to obtain the following specific values. But the charging polarity was positive.

$V_0$+490 V; $V_k$ 88%; E ½ 20 lux·sec

EXAMPLE 16

To a solution containing 5 g of p-diethylaminobenzaldehyde-N,N-diphenylhydrazone and 5 g of a polyvinylcarbazole (molecular weight: about 300,000) dissolved in 70 ml of tetrahydrofuran, there was added 1 g of the pigment No. 1 and the mixture was dispersed in a ball mill. The resultant dispersion was coated by a Meyer bar on the casein layer of the aluminum plate having the casein layer as used in Example 1 in a coating weight after drying of 10 g/m$^2$.

The thus prepared photosensitive plate was subjected to measurement of charge bearing characteristics similarly as in Example 1. The results are shown below. The polarity of charging was positive.

$V_0$+500 V; $V_k$ 88%; E ½ 18 lux·sec

EXAMPLE 17

On an aluminum plate, there was coated a solution of casein in an aqueous ammonia (casein 11.2 g, 28% aqueous ammonia 1 g, water 222 ml) by means of a Meyer bar and dried to form an adhesive layer of 1.0 g/m$^2$. Then 5 g of the pigment having the following structural formula (pigment No. 15):

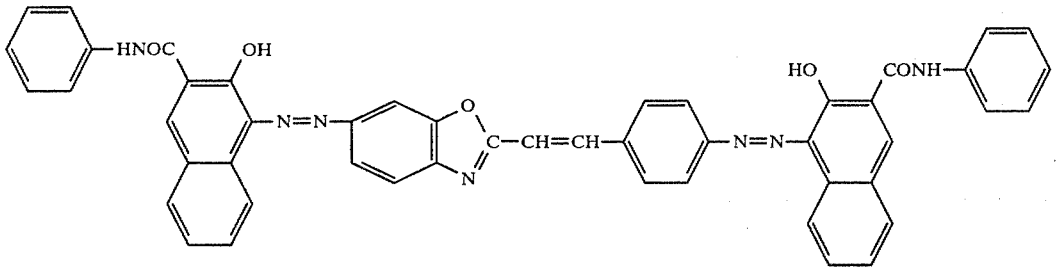

was dispersed in a ball mill together with a solution of 2 g polyvinyl butyral resin (content of butyral: 63 mole %) dissolved in 95 ml of ethanol, and the dispersion was coated by a Meyer bar on the adhesive layer and dried to form a charge generation layer of 0.2 g/m$^2$. Subsequently, a solution prepared by dissolving 5 g of 1-phenyl-3-(p-diethylaminostyryl)-5-(p-diethylaminophenyl)-pyrazoline and 5 g of polycarbonate of 2,2-bis(4-hydroxyphenyl)propane (molecular weight: about 30,000) in 70 ml of tetrahydrofuran was coated on the charge generation layer and dried to form a charge transport layer of 10 g/m$^2$. The thus prepared electrophotographic photosensitive member was subjected to corona charging at −5 KV by a static process using an electrostatic copying paper test device (Model SP-428; produced by Kawaguchi Denki Co., Ltd.) and, after being retained in a dark place for 10 seconds, exposed to light at an illuminance of 5 lux for examination of charge bearing characteristics. The initial potential is represented by $V_0$ (−V), the potential retentivity in a dark place for 10 seconds by $V_k$ (%) and the exposure quantity for halving initial potential by E $\frac{1}{2}$ (lux·sec).

$V_0$=580 V; $V_k$ 93%; E $\frac{1}{2}$ 8.0 lux·sec

EXAMPLE 18

On the charge generation layer prepared in Example 17, there was coated a solution prepared by dissolving 5 g of 2,4,7-trinitrofluorenone and 5 g of the same polycarbonate as used in Example 17 in 70 ml of tetrahydrofuran, followed by drying, in a coating weight after drying of 12 g/m$^2$. Measurement of charge bearing characteristics was conducted in the same manner as in Example 17, except that the charging polarity was positive, to obtain the following specific values.

$V_0$+560 V; $V_k$ 93%; E $\frac{1}{2}$ 14.5 lux·sec

EXAMPLES 19–34

A dispersion of 5 g dis-azo pigment represented by the formula (B), wherein $A_1$ and $B_1$ are indicated in Table 3, 10 g polyester resin solution (Polyester adhesive 49,000, produced by Du Pont de Nemours & Company; solid content 20%) and 80 ml tetrahydrofuran was coated on the aluminum surface of a Mylar film on which aluminum is varpor deposited, followed by drying to a coating weight of 0.25 g/m$^2$. Then, a solution of 5 g 1-[6-methoxypyridyl(2)]-3-(p-diethylaminostyryl)-5-p-diethylamino-phenylpyrasoline and 5 g of a polymethylmethacrylate resin (molecular weight: about 100,000) in 70 ml of tetrahydrofuran was coated on the above charge generation layer in a coating weight after drying of 11 g/m$^2$.

The thus prepared photosensitive members were subjected to measurement of charge bearing characteristics similarly to Example 17. The results are given in Table 4.

TABLE 3

| | Dis-azo pigment represented by the formula (B) | | |
|---|---|---|---|
| Example | Pigment No. | $B_1$ | $A_1$ |
| 19 | 16 | 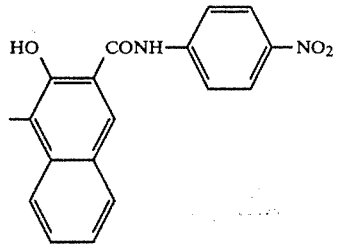 | H |
| 20 | 17 | 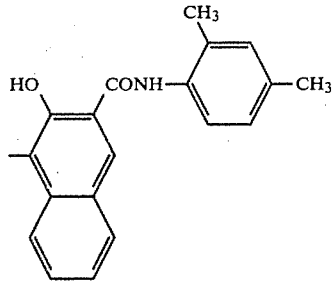 | H |
| 21 | 18 | 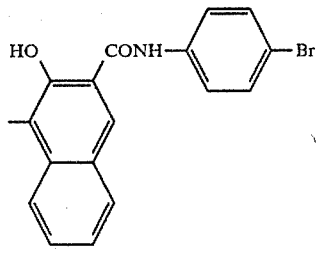 | H |
| 22 | 19 | 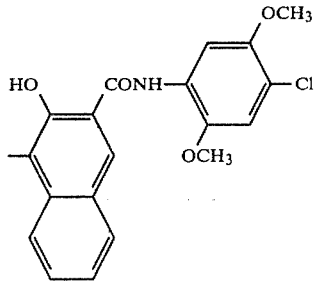 | H |

TABLE 3-continued
| Example | Pigment No. | $B_1$ | $A_1$ |
|---|---|---|---|
| | | Dis-azo pigment represented by the formula (B) | |
| 23 | 20 | 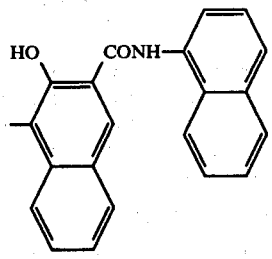 | H |
| 24 | 21 | 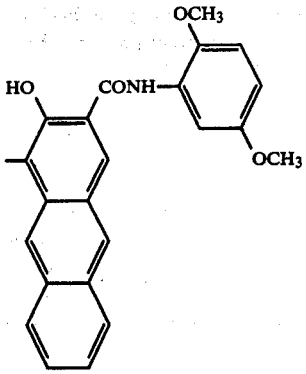 | H |
| 25 | 22 | 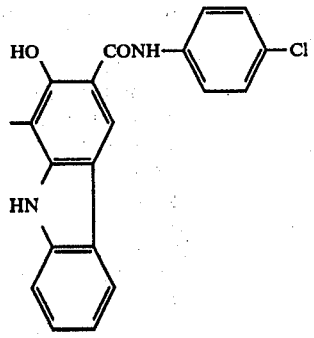 | H |
| 26 | 23 | 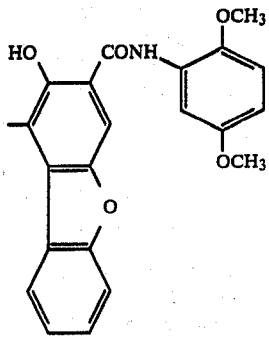 | H |
TABLE 3-continued
| Example | Pigment No. | $B_1$ | $A_1$ |
|---|---|---|---|
| | | Dis-azo pigment represented by the formula (B) | |
| 27 | 24 | 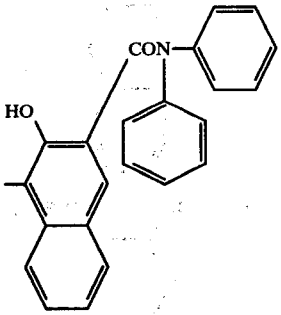 | H |
| 28 | 25 | 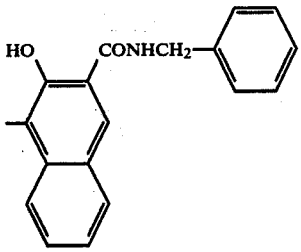 | H |
| 29 | 26 | 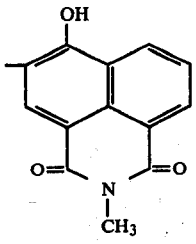 | H |
| 30 | 27 | 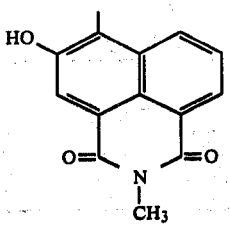 | H |
| 31 | 28 | 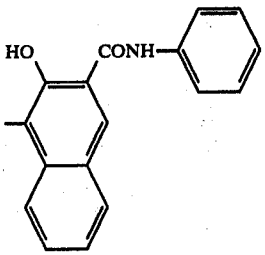 | Cl |

TABLE 3-continued

| Example | Pigment No. | Dis-azo pigment represented by the formula (B) $B_1$ | $A_1$ |
|---|---|---|---|
| 32 | 29 | 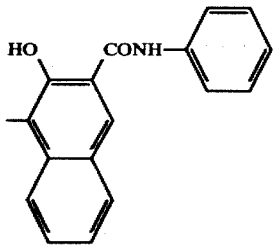 | $CH_3$ |
| 33 | 30 | 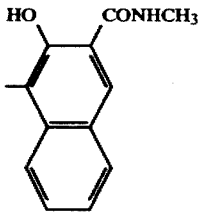 | H |
| 34 | 31 | 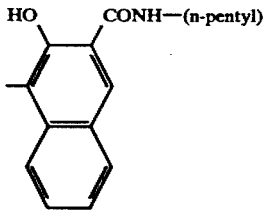 | H |

TABLE 4

| Example | Pigment No. | (Charge bearing characteristics) $V_O$ (−V) | $V_k$ (%) | $E\frac{1}{2}$ (lux · sec) |
|---|---|---|---|---|
| 19 | 16 | 580 | 91 | 13 |
| 20 | 17 | 560 | 89 | 12 |
| 21 | 18 | 580 | 93 | 8.8 |
| 22 | 19 | 590 | 94 | 10.0 |
| 23 | 20 | 570 | 90 | 9.8 |
| 24 | 21 | 560 | 89 | 10.0 |
| 25 | 22 | 590 | 93 | 10.0 |
| 26 | 23 | 580 | 92 | 11.0 |
| 27 | 24 | 590 | 94 | 13.0 |
| 28 | 25 | 570 | 93 | 15.0 |
| 29 | 26 | 560 | 83 | 8.9 |
| 30 | 27 | 580 | 91 | 9.3 |
| 31 | 28 | 590 | 92 | 9.4 |
| 32 | 29 | 600 | 94 | 8.9 |
| 33 | 30 | 560 | 90 | 8.0 |
| 34 | 31 | 570 | 93 | 10.6 |

EXAMPLE 35

To a solution containing 5 g of 2,5-bis(p-diethylaminophenyl)-1,3,4-oxadiazole and 5 g of poly-N-vinylcarbazole (molecular weight: about 300,000) in 70 ml of tetrahydrofuran, there was added 1.0 g of the pigment No. 15 used in Example 17 to be dispersed therein. The dispersion was then coated on the casein layer of the aluminum plate having the casein layer used in Example 17 in a coating weight after drying of 10 g/m$^2$.

The thus prepared photosensitive member was subjected to measurement of the charge bearing characteristics similarly to in Example 17 to obtain the following results. The charging polarity was positive.

$V_0$+530 V; $V_k$ 85%; E ½ 16 lux·sec

EXAMPLE 36

On an aluminum plate, there was coated a solution of casein in an aqueous ammonia (casein 11.2 g, 28% aqueous ammonia 1 g, water 222 ml) by means of a Meyer bar and dried to form an adhesive layer of 1.0 g/m$^2$. Then 5 g of the pigment having the following structural formula (pigment No. 32):

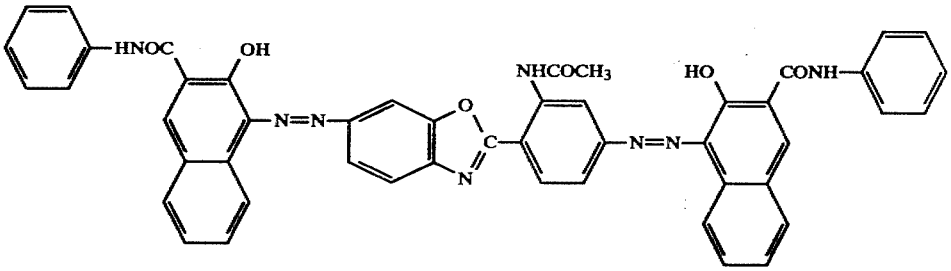

was dispersed in a ball mill together with a solution of 2 g polyvinyl butyral resin (content of butyral: 63 mole %) dissolved in 95 ml of ethanol, and the dispersion was coated by a Meyer bar on the adhesive layer and dried to form a charge generation layer of 0.2 g/m$^2$. Subsequently, a solution prepared by dissolving 5 g of 1-phenyl-3-(p-diethylaminostyryl)-5-(p-diethylaminophenyl)-pyrazoline and 5 g of polycarbonate of 2,2-bis(4-hydroxyphenyl)propane (molecular weight: about 30,000) in 70 ml of tetrahydrofuran was coated on the charge generation layer and dried to form a charge transport layer of 10 g/m$^2$. The thus prepared electrophotographic photosensitive member was subjected to corona charging at −5 KV by a static process using an electrostatic copying paper test device (Model SP-428: produced by Kawaguchi Denki Co., Ltd.) and, after being retained in a dark place for 10 seconds, exposed to light at an illuminance of 5 lux for examination of charge bearing characteristics. The initial potential is represented by $V_0$ (−V), the potential retentivity in a dark place for 10 seconds by $V_k$ (%) and the exposure quantity for halving initial potential by E ½ (lux·sec).

$V_0$⊖590 V; $V_k$ 91%; E ½ 6.4 lux·sec

EXAMPLE 37

On the charge generation layer prepared in Example 36, there was coated a solution containing 5 g of 2,4,7-trinitro-fluorenone and 5 g of the same polycarbonate resin as used in Example 36 dissolved in 70 ml of tetrahydrofuran in a coating weight after drying of 12 g/m$^2$.

The charge bearing characteristics were determined in the same manner as in Example 36, except that the charging polarity was positive, to obtain the following specific values.

$V_0$+540 V, $V_k$ 89%; E ½ 15 lux·sec

EXAMPLES 38–53

A dispersion of 5 g of dis-azo pigment represented by the formula (C), wherein $A_4$ and $B_1$ are indicated in Table 5, 10 g of polyester resin solution (Polyester adhesive 49,000, produced by Du Pont de Nemours & Company, solid content 20%) and 80 ml of tetrahydrofuran was coated on the aluminum surface of Mylar film on which aluminum is vapor deposited, followed by drying, to a coating weight of 0.2 g/m². The thus prepared photosensitive members were subjected to measurement of charge bearing characteristics similarly to Example 36 to obtain the specific values shown in Table 6.

TABLE 5

| | (Pigments used) Structure of dis-azo pigment | | |
|---|---|---|---|
| Example | Pigment No. | $B_1$ | $A_4$ (position relative to azo group) |
| 38 | 33 | 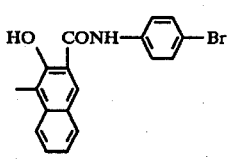 | $NHCOCH_3$ (m) |
| 39 | 34 | 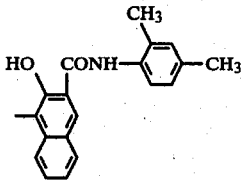 | $NHCOCH_3$ (m) |
| 40 | 35 | 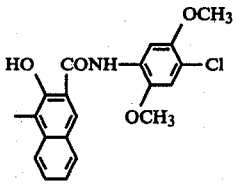 | $NHCOCH_3$ (m) |
| 41 | 36 | 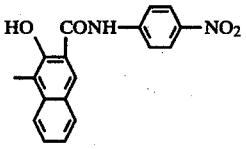 | $NHCOCH_3$ (m) |
| 42 | 37 | 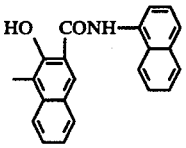 | $NHCOC_2H_5$ (m) |

TABLE 5-continued

| | (Pigments used) Structure of dis-azo pigment | | |
|---|---|---|---|
| Example | Pigment No. | $B_1$ | $A_4$ (position relative to azo group) |
| 43 | 38 | 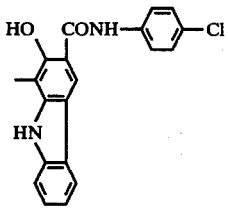 | $NHCOC_2H_8$ (m) |
| 44 | 39 | 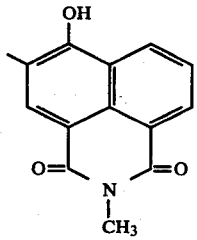 | $NHCOC_2H_5$ (m) |
| 45 | 40 | 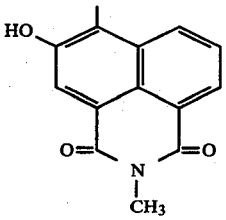 | $NHCOC_2H_5$ (m) |
| 46 | 41 | 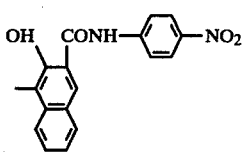 | $NHCOC_2H_5$ (m) |
| 47 | 42 | 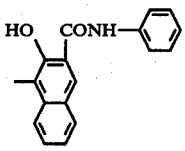 | $NHCO(CH_2)_3CH_3$ (m) |
| 48 | 43 | 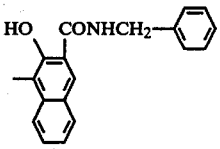 | $NHCOCH_3$ (m) |
| 49 | 44 | 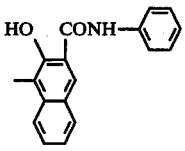 | OH (O) |

TABLE 5-continued

| Example | Pigment No. | (Pigments used) Structure of dis-azo pigment $B_1$ | $A_4$ (position relative to azo group) |
|---|---|---|---|
| 50 | 45 | 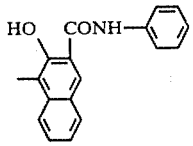 | $(OH)_2$ (O,O') |
| 51 | 46 | 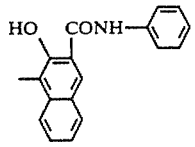 | $(OCH_3)_2$ (O,O') |
| 52 | 47 | 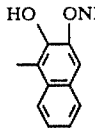 | $NHCOCH_3$ (m) |
| 53 | 48 | 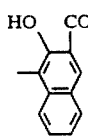 | OH (O) |

TABLE 6

| Example | Pigment No. | Charging characteristics $V_O$ (−V) | $V_k$ (%) | $E\frac{1}{2}$ (lux · sec) |
|---|---|---|---|---|
| 38 | 33 | 560 | 89 | 8.3 |
| 39 | 34 | 590 | 91 | 9.2 |
| 40 | 35 | 580 | 90 | 10.4 |
| 41 | 36 | 600 | 94 | 12.0 |
| 42 | 37 | 570 | 91 | 9.4 |
| 43 | 38 | 590 | 93 | 8.2 |
| 44 | 39 | 610 | 94 | 7.0 |
| 45 | 40 | 570 | 90 | 7.4 |
| 46 | 41 | 580 | 94 | 10.5 |
| 47 | 42 | 580 | 91 | 8.8 |
| 48 | 43 | 590 | 94 | 14.6 |
| 49 | 44 | 550 | 88 | 8.9 |
| 50 | 45 | 570 | 89 | 8.1 |
| 51 | 46 | 590 | 91 | 7.8 |
| 52 | 47 | 580 | 93 | 8.0 |
| 53 | 48 | 560 | 90 | 7.8 |

EXAMPLE 54

A dispersion of 1 g of the pigment No. 32 used in Example 36 in a solution containing 5 g of p-diethylaminobenzaldehyde-N,N-diphenylhydrazone and 5 g of a poly-N-vinylcarbazole (molecular weight: about 300,000) dissolved in 70 ml of tetrahydrofuran was coated on a polyvinyl alcohol layer (0.7 g/m$^2$) provided on a 100$\mu$ aluminum plate, followed by drying, in a coating weight of 11 g/m$^2$. The thus prepared photosensitive member was subjected to measurement of charge bearing characteristics similar to described in Example 36, except that the charging polarity was positive, to obtain the following specific values.

$V_0$+550 V; $V_k$ 88%; E $\frac{1}{2}$ 15 lux·sec

EXAMPLE 55

On a aluminum plate, there was coated a solution of casein in an aqueous ammonia (casein 11.2 g, 28% aqueous ammonia 1 g, water 222 ml) by means of a Meyer bar and dried to form an adhesive layer of 1.0 g/m$^2$. Then 5 g of the pigment having the following structural formula (pigment No. 49):

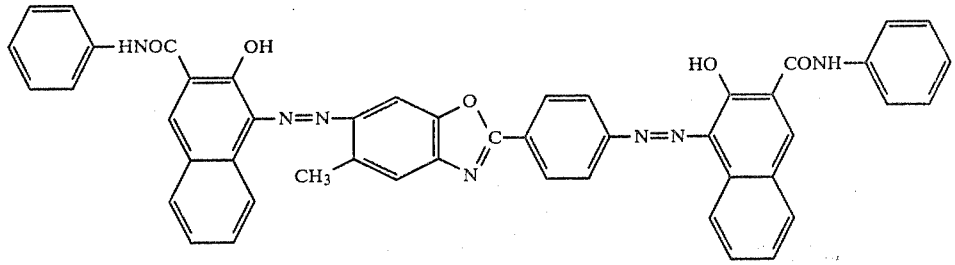

was dispersed in a ball mill together with a solution of 2 g polyvinyl butyral resin (content of butyral: 63 mole %) dissolved in 95 ml of ethanol, and the dispersion was coated by a Meyer bar on the adhesive layer and dried to form a charge generation layer of 0.2 g/m$^2$. Subsequently, a solution prepared by dissolving 5 g of 1-phenyl-3-(p-diethylaminostyryl)-5-(p-diethylaminophenyl)-pyrazoline and 5 g of polycarbonate of 2,2-bis(4-hydroxyphenyl)propane (molecular weight: about 30,000) in 70 ml of tetrahydrofuran was coated on the charge generation layer and dried to form a charge transport layer of 10 g/m$^2$. The thus prepared electrophotographic photosensitive member was subjected to corona charging at −5 KV by an electrostatic process using an electrostatic copying paper test device (Model SP-428; produced by Kawaguchi Denki Co., Ltd.) and, after being retained in a dark place for 10 seconds, exposed to light at an illuminance of 5 lux for examination of charge bearing characteristics. The initial potential is represented by $V_0$ (−V), the potential retentivity in a dark place for 10 seconds by $V_k$ (%) and the exposure quantity for halving initial potential by E $\frac{1}{2}$ (lux·sec).

$V_0$⊖600 V; $V_k$ 93%; E $\frac{1}{2}$ 6.1 lux.·sec

EXAMPLE 56

A dispersion of the pigment No. 49 used in Example 55 in a solution prepared by dissolving 5 g of p-diethylaminobenzaldehyde-N,N-diphenylhydrazone and 5 g of a poly-N-vinylcarbazole (molecular weight: about 300,000) in 70 ml of tetrahydrofuran was coated on the casein layer used in Example 55 in a coating weight after drying of 11 g/m$^2$.

Measurement of the photosensitive member prepared was conducted similarly to described in Example 55 to obtain the following specific values. The charging polarity was positive.

$V_0$+570 V; $V_k$ 89%; E ½ 15 lux·sec

EXAMPLES 57–76

A dispersion prepared from 5 g of the dis-azo pigment represented by the formula (D), wherein $A_1$, $B_1$ and $A_5$ are indicated in Table 7, 10 g of a polyester resin solution (polyester adhesive 49,000, produced by Du Pont de Nemours & Company; solid content 20%) and 80 ml of tetrahydrofuran was coated on the aluminum surface of a Mylar film on which aluminum is vapor deposited, followed by drying to a coating weight of 0.15 g/m². Then, a solution of 5 g of 2,5-bis(p-diethylaminophenyl)-1,3,4-oxadiazole and 5 g of a polymethylmethacrylate resin (molecular weight: about 100,000) in 70 ml of tetrahydrofuran was coated on the above charge generation layer in a coating weight after drying of 11 g/m².

Measurement of the photosensitive members prepared was conducted similarly to describe in Example 55 to give the results shown in Table 8.

TABLE 7

| | Structures of pigments used | | | |
|---|---|---|---|---|
| | Dis-azo pigment represented by the formula (D) | | | |
| Example | Pigment No. | $B_1$ | $A_1$ | $A_5$ (position relative to azo group) |
| 57 | 50 | 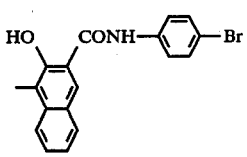 | $CH_3$ | H |
| 58 | 51 | 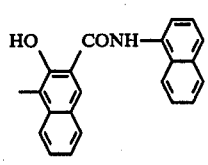 | $CH_3$ | H |
| 59 | 52 | 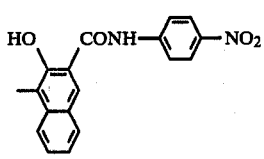 | Cl | H |
| 60 | 53 | 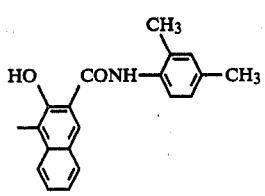 | Cl | H |
| 61 | 54 | 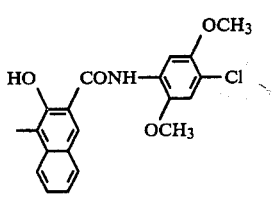 | $CH_3$ | H |

TABLE 7-continued

| | Structures of pigments used | | | |
|---|---|---|---|---|
| | Dis-azo pigment represented by the formula (D) | | | |
| Example | Pigment No. | $B_1$ | $A_1$ | $A_5$ (position relative to azo group) |
| 62 | 55 | 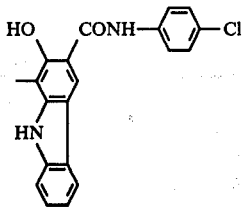 | $CH_3$ | H |
| 63 | 56 | 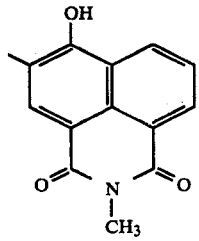 | $CH_3$ | H |
| 64 | 57 | 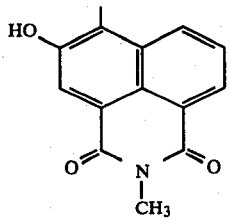 | $CH_3$ | H |
| 65 | 58 | 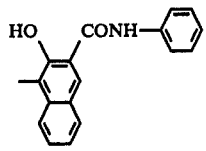 | $CH_3$ | $CH_3$ (O) |
| 66 | 59 | 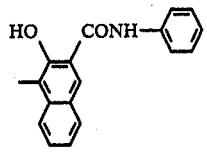 | $CH_3$ | $OCH_3$ (O) |
| 67 | 60 | 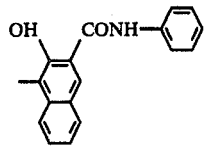 | $CH_3$ | Cl (m) |
| 68 | 61 | 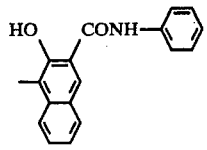 | $CH_3$ | OH (O) |

TABLE 7-continued

| Example | Pigment No. | Structures of pigments used: Dis-azo pigment represented by the formula (D) $B_1$ | $A_1$ | $A_5$ (position relative to azo group) |
|---|---|---|---|---|
| 69 | 62 | 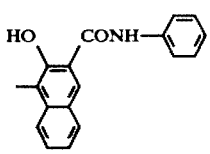 | $CH_3$ | $OC_2H_5$ (O) |
| 70 | 63 | 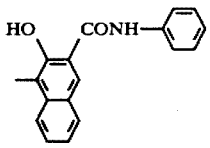 | $CH_3$ | $(OCH_3)_2$ (O,O') |
| 71 | 64 | 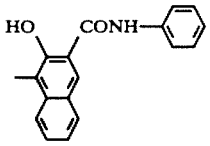 | $CH_3$ | $NHCOCH_3$ (m) |
| 72 | 65 | 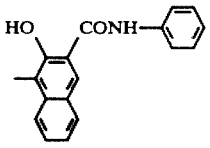 | Cl | $CH_3$ (C) |
| 73 | 66 | 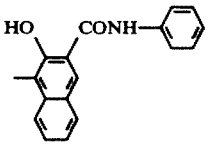 | Cl | H |
| 74 | 67 | 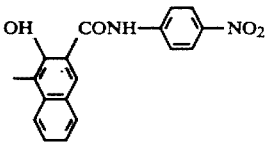 | $CH_3$ | H |
| 75 | 68 | 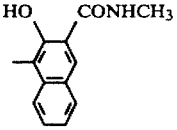 | $CH_3$ | H |

TABLE 7-continued

| Example | Pigment No. | Structures of pigments used: Dis-azo pigment represented by the formula (D) $B_1$ | $A_1$ | $A_5$ (position relative to azo group) |
|---|---|---|---|---|
| 76 | 69 | 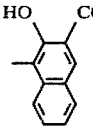 | $CH_3$ | $CH_3$ |

TABLE 8

| Example | Charge bearing characteristics: $V_O$ (−V) | $V_k$ (%) | $E\frac{1}{2}$ (lux · sec) |
|---|---|---|---|
| 57 | 580 | 93 | 7.6 |
| 58 | 590 | 91 | 10.0 |
| 59 | 600 | 94 | 13.0 |
| 60 | 570 | 89 | 8.3 |
| 61 | 570 | 91 | 10.0 |
| 62 | 590 | 93 | 8.0 |
| 63 | 570 | 91 | 7.8 |
| 64 | 580 | 91 | 8.0 |
| 65 | 590 | 93 | 6.8 |
| 66 | 610 | 94 | 7.4 |
| 67 | 600 | 93 | 9.0 |
| 68 | 580 | 89 | 8.8 |
| 69 | 590 | 92 | 7.6 |
| 70 | 600 | 89 | 8.2 |
| 71 | 580 | 90 | 9.0 |
| 72 | 600 | 94 | 9.3 |
| 73 | 600 | 91 | 8.0 |
| 74 | 580 | 94 | 13.6 |
| 75 | 580 | 93 | 6.9 |
| 76 | 560 | 90 | 10.3 |

EXAMPLE 77

On the charge generation layer prepared in Example 55, there was coated a solution prepared by dissolving 5 g of 2,4,7-trinitrofluorenone and 5 g of the same polycarbonate resin as used in Example 55 in 70 ml of tetrahydrofuran in a coating weight after drying of 12 g/m$^2$. The charge bearing characteristics were measured in the same manner as in Example 55, except that the charging polarity was positive, to obtain the following specific values.

$V_0$+550 V; $V_k$ 88%; E $\frac{1}{2}$ 16 lux·sec

EXAMPLE 78

On an aluminum plate, there was coated a solution of casein in an aqueous ammonia (casein 11.2 g, 28% aqueous ammonia 1 g, water 222 ml) by means of a Meyer bar and dried to form an adhesive layer of 1.0 g/m$^2$. Then 5 g of the pigment having the following structural formula (pigment No. 70):

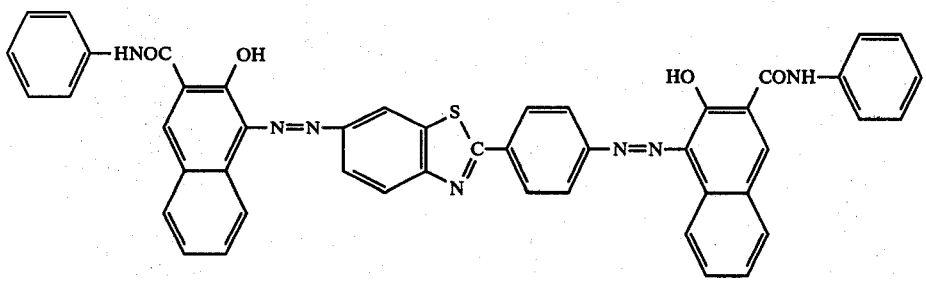

was dispersed in a ball mill together with a solution of 2 g polyvinyl butyral resin (content of butyral: 63 mole %) dissolved in 95 ml of ethanol, and the dispersion was coated by a Meyer bar on the adhesive layer and dried to form a charge generation layer of 0.2 g/m$^2$. Subsequently, a solution prepared by dissolving 5 g of 1-phenyl-3-(p-diethylaminostyryl)-5-(p-diethylaminophenyl)-pyrazoline and 5 g of polycarbonate of 2-2-bis(4-hydroxyphenyl)propane (molecular weight: about 30,000) in 70 ml of tetrahydrofuran was coated on the charge generation layer and dried to form a charge transport layer of 10 g/m$^2$. The thus prepared electrophotographic photosensitive member was subjected to corona charging at −5 KV by an electrostatic process using an electrostatic copying paper test device (Model SP-428; produced by Kawaguchi Denki Co., Ltd.) and, after being retained in a dark place for 10 seconds, exposed to light at an illuminance of 5 lux for examination of charge bearing characteristics. The initial potential is represented by $V_0$ (−V), the potential retentivity in a dark place for 10 seconds by $V_k$ (%) and the exposure quantity for halving initial potential by E ½ (lux·sec).

$V_0$⊖590 V; $V_k$ 91%; E ½ 6.9 lux·sec

EXAMPLES 79–98

A dispersion prepared from 5 g of the dis-azo pigment represented by the formula (E), wherein $B_1$ and $A_6$ are indicated in Table 9, 10 g of a polyester resin solution (Polyester adhesive 49,000, produced by Du Pont de Nemours & Company; solid content 20%) and 80 ml of tetrahydrofuran was coated on the aluminum surface of Mylar film on which aluminum is vapor deposited, followed by drying to a coating weight of 0.15 g/m$^2$. Then, a solution of 5 g of 2,5-bis(p-diethylaminophenyl)-1,3,4-oxadiazole and 5 g of a polymethylmethacrylate resin (molecular weight: about 100,000) in 70 ml of tetrahydrofuran was coated on the above charge generation layer in a coating weight after drying of 11 g/m$^2$.

Measurement of the photosensitive members prepared was conducted in a similar way to described in Example 78 to give the results shown in Table 10.

TABLE 9

| | Pigments used | | |
|---|---|---|---|
| | Dis-azo pigment represented by the formula (E) | | |
| Example | Pigment No. | $B_1$ | $A_6$ (position relative to azo group) |
| 79 | 71 | 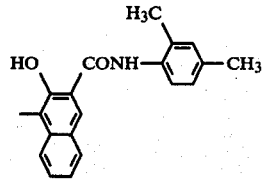 | H |
| 80 | 72 | 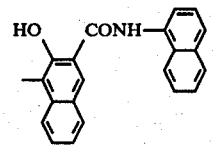 | H |
| 81 | 73 | 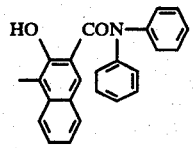 | H |
| 82 | 74 | 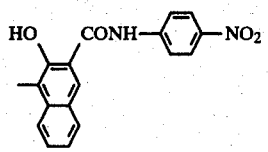 | H |
| 83 | 75 | 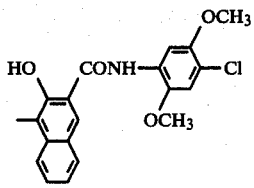 | $CH_3$ (O) |
| 84 | 76 | 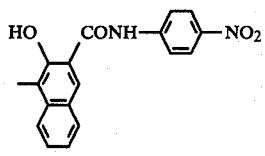 | $CH_3$ (O) |

TABLE 9-continued

| Example | Pigments used: Dis-azo pigment represented by the formula (E) — Pigment No. | $B_1$ | $A_6$ (position relative to azo group) |
|---|---|---|---|
| 85 | 77 | 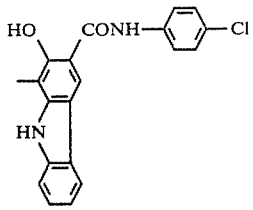 | H |
| 86 | 78 | 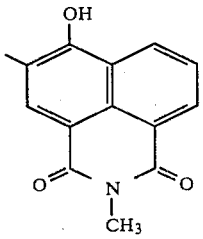 | H |
| 87 | 79 | 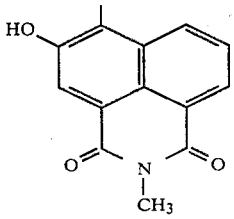 | H |
| 88 | 80 | 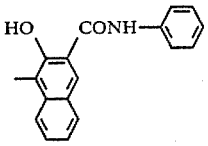 | $CH_3$ (O) |
| 89 | 81 | 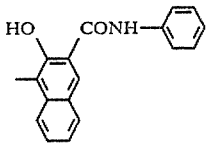 | Cl (m) |
| 90 | 82 | 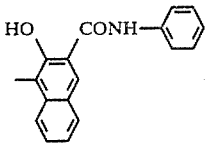 | $NHCOCH_3$ (m) |
| 91 | 83 | 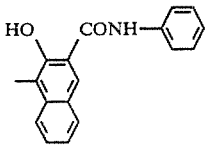 | $OCH_3$ (O) |

TABLE 9-continued

| Example | Pigments used: Dis-azo pigment represented by the formula (E) — Pigment No. | $B_1$ | $A_6$ (position relative to azo group) |
|---|---|---|---|
| 92 | 84 | 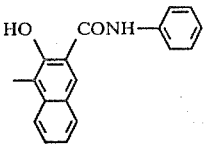 | $OC_2H_3$ (O) |
| 93 | 85 | 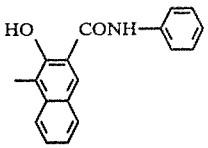 | $(OCH_3)_2$ (O,O') |
| 94 | 86 | 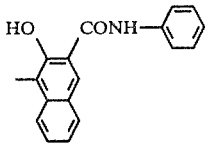 | OH (O) |
| 95 | 87 | 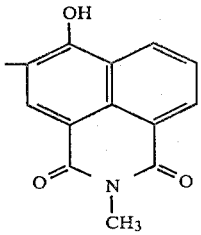 | $CH_3$ (O) |
| 96 | 88 | 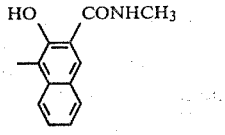 | H |
| 97 | 89 | 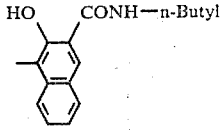 | $CH_3$ (O) |
| 98 | 90 | 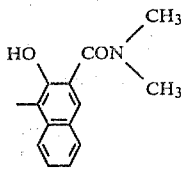 | Cl (m) |

TABLE 10

| Example | Charge bearing characteristics: $V_O$ (−V) | $V_k$ (%) | $E_{\frac{1}{2}}$ (lux · sec) |
|---|---|---|---|
| 79 | 580 | 89 | 8.0 |
| 80 | 600 | 92 | 9.2 |
| 81 | 580 | 91 | 11.2 |
| 82 | 610 | 94 | 13.0 |
| 83 | 570 | 90 | 9.8 |
| 94 | 600 | 92 | 9.4 |
| 85 | 560 | 88 | 8.3 |
| 86 | 590 | 90 | 7.6 |

TABLE 10-continued

| Example | Charge bearing characteristics $V_O$ (−V) | $V_k$ (%) | $E_{\frac{1}{2}}$ (lux · sec) |
|---|---|---|---|
| 87 | 540 | 88 | 7.9 |
| 88 | 580 | 93 | 6.9 |
| 89 | 600 | 94 | 9.0 |
| 90 | 570 | 89 | 8.4 |
| 91 | 590 | 91 | 8.2 |
| 92 | 575 | 93 | 8.4 |
| 93 | 590 | 91 | 8.5 |
| 94 | 600 | 90 | 9.0 |
| 95 | 590 | 92 | 10.0 |
| 96 | 580 | 90 | 7.4 |
| 97 | 560 | 88 | 10.6 |
| 98 | 590 | 93 | 12.4 |

EXAMPLE 99

On the charge generation layer as prepared in Example 78, a solution prepared by dissolving 5 g f 2,4,7-trinitrofluorenone and 5 g of the same polycarbonate resin as used in Example 78 in 70 ml of tetrahydrofuran was coated in a coating weight after drying of 12 g/m². Measurement of charge bearing characteristics was conducted in the same manner as described in Example 78 to obtain the following specific values. But the charging polarity was positive.

$V_0 \oplus 570$ V; $V_k$ 89%; E ½ 15.5 lux·sec

EXAMPLE 100

To a solution containing 5 g of p-diethylaminobenzaldehyde-N,N-diphenylhydrazone and 5 g of a poly-N-vinylcarbazole (molecular weight: about 300,000) dissolved in 70 ml of tetrahydrofuran, there was added 1 g of the pigment No. 70 used in Example 78 and the mixture was dispersed. The resultant dispersion was coated on the casein layer as used in Example 78 in a coating weight after drying of 11 g/m².

The thus prepared photosensitive plate was tested for charge bearing characteristics similarly to described in Example 78. The results are shown below. The polarity of charging was positive.

$V_0 \oplus 540$ V, $V_k$ 87 %; E ½ 19.0 lux·sec

EXAMPLE 101

On an aluminum plate, there was coated a solution of casein in an aqueous ammonia (casein 11.2 g, 28% aqueous ammonia 1 g, water 222 ml) by means of a Meyer bar and dried to form an adhesive layer with a coating weight of 1.0 g/m². Then 5 g of the pigment having the following structural formula (pigment No. 91):

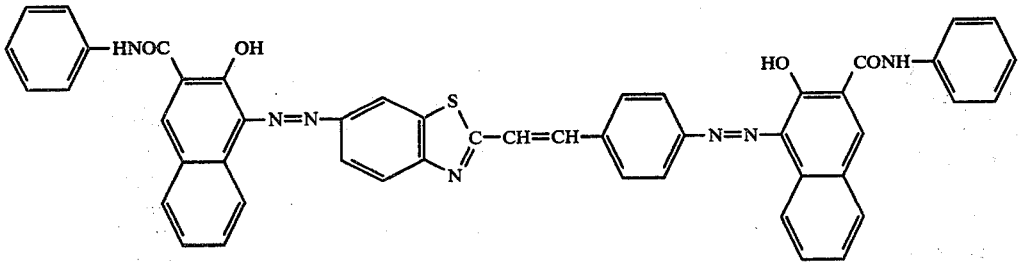

10 g of a polyester resin (Polyester adhesive 49,000, produced by Du Pont de Nemours & Company, solid content 20%) and 80 ml of tetrahydrofuran were dispersed and the dispersion was coated on the above adhesive layer in a coating weight after drying of 0.25 g/m².

Then, a solution prepared by dissolving 5 g of 2,5-bis-(p-diethylaminophenyl)-1,3,4-oxadiazole and 5 g of a polymethylmethacrylate (molecular weight: about 100,000) in 70 ml of tetrahydrofuran was coated on the charge generation layer in a coating weight after drying of 10 g/m². The thus prepared electrophotographic photosensitive member was subjected to corona charging at −5 KV by an electrostatic process using an electrostatic copying paper test device (Model SP-428; produced by Kawaguchi Denki Co., Ltd.) and, after being retained in a dark place for 10 seconds, exposed to light at an illuminance of 5 lux for examination of charge bearing characteristics. The initial potential is represented by $V_0$(−V), the potential retentivity in a dark place for 10 seconds by $V_k$(%) and the exposure quantity for halving initial potential by E ½ (lux·sec).

$V_0$−570 V; $V_k$ 89%; E ½ 8.6 lux·sec

EXAMPLE 102

On the charge generation layer prepared in Example 101, there was coated a solution containing 5 g of 2,4,7-trinitro-fluorenone and 5 g of polycarbonate of 2,2-bis(4-hydroxyphenyl)propane (molecular weight: about 30,000) dissolved in 70 ml of tetrahydrofuran in a coating weight after drying of 12 g/m². Measurement of charging characteristics was conducted in a similar way to described in Example 101 to obtain the following specific values. The charging polarity was positive.

$V_0$+540 V; $V_k$ 89%; E ½ 17.4 lux·sec

EXAMPLES 103–115

A dispersion prepared from 5 g of the dis-azo pigment represented by the formula (F), wherein $B_1$ is indicated in Table 11, and a solution containing 2 g of a polyvinyl butyral resin (butyral content: 63 mole %) dissolved in 95 ml of ethanol was coated on the aluminum surface of a Mylar film on which aluminum is vapor deposited in a coating weight after drying of 0.2 g/m². Then, a solution containing 5 g of 1-phenyl-3-(p-diethylaminostyryl)-5-(p-diethylaminophenyl) pyrazoline and 5 g of the same polycarbonate resin as used in Example 102 dissolved in 70 ml of tetrahydrofuran was coated on the above charge generation layer and dried to form a charge transport layer of 11 g/m². The charge bearing characteristics of the photosensitive members were measured in a similar way to that described in Example 101 to obtain the results shown in Table 11.

TABLE 11

| Example | Pigment No. | $B_1$ | $V_0$ (−V) | $V_k$ (%) | $E_{\frac{1}{2}}$ (lux. sec) |
|---|---|---|---|---|---|
| | | Pigments used; Charge bearing characteristics | | | |
| | | Dis-azo pigment represented by the formula (F) | Charge bearing characteristics | | |
| 103 | 92 | 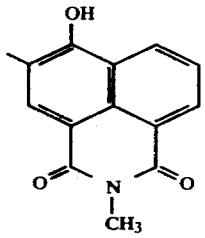 | 570 | 91 | 8.9 |
| 104 | 93 | 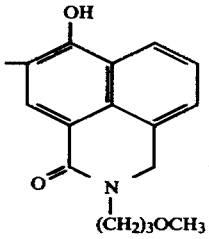 | 580 | 92 | 8.5 |
| 105 | 94 | 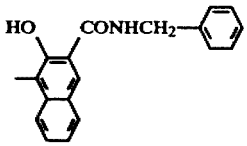 | 560 | 91 | 14.5 |
| 106 | 95 | 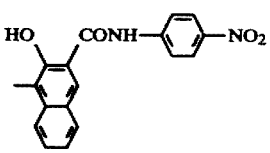 | 590 | 94 | 14.2 |
| 107 | 96 | 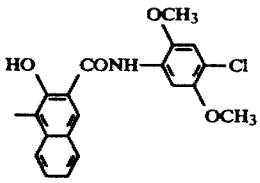 | 580 | 93 | 13.2 |
| 108 | 97 | 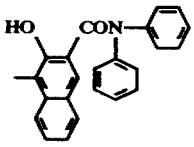 | 590 | 90 | 14.8 |
| 109 | 98 | 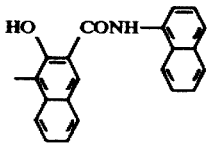 | 560 | 88 | 12.8 |

TABLE 11-continued

| Example | Pigment No. | $B_1$ | $V_0$ (−V) | $V_k$ (%) | $E_{\frac{1}{2}}$ (lux. sec) |
|---|---|---|---|---|---|
| | | Pigments used; Charge bearing characteristics | | | |
| | | Dis-azo pigment represented by the formula (F) | Charge bearing characteristics | | |
| 110 | 99 | 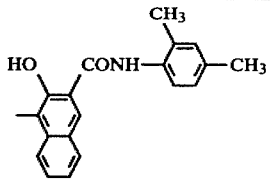 | 540 | 86 | 11.2 |
| 111 | 100 | 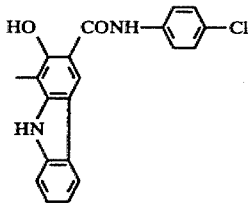 | 550 | 89 | 9.4 |
| 112 | 101 | 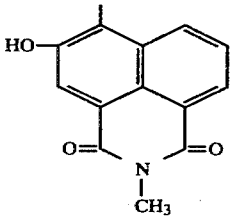 | 590 | 91 | 9.4 |
| 113 | 102 | 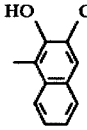 | 560 | 88 | 8.4 |
| 114 | 103 | 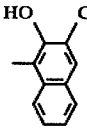 | 570 | 91 | 9.3 |
| 115 | 104 | 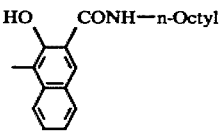 | 550 | 8.7 | 14.6 |

EXAMPLE 116

A dispersion prepared by adding 1.0 g of the pigment No. 91 used in Example 101 to a solution containing 5 g of p-diethylaminobenzaldehyde-N,N-diphenylhydrazone and 5 g of poly-N-vinylcarbazole (molecular weight: about 300,000) dissolved in 70 ml tetrahydrofuran was coated on the casein layer used in Example 101 in a coating weight after drying of 10 g/m$^2$. The photosensitive member prepared was set in a charging exposure device, wherein corona charging was effected at +6 KV, followed immediately by a light image exposure. The light image was irradiated through a transmission type test chart using a tungsten light source. Immediately thereafter, negatively chargeable developer (containing toners and carriers) was cascaded on the surface of the photosensitive member to obtain a good toner image.

EXAMPLE 117

On an aluminum plate of 100μ in thickness, an aqueous polyvinyl alcohol solution was coated and dried to form an adhesive layer of 0.8 g/m².

Then, 5 g of the pigment having the following structural formula (pigment No. 105):

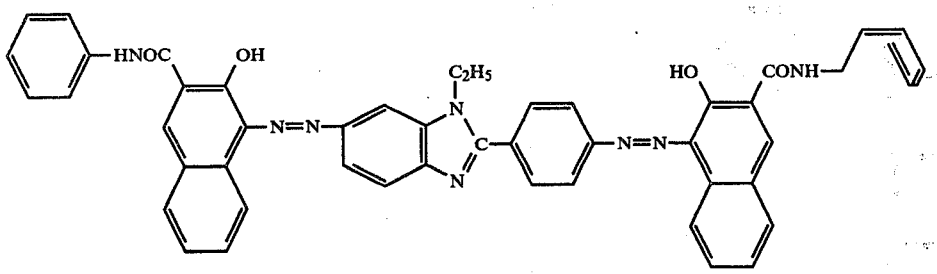

10 g of a polyester resin (Polyester adhesive 49,000, produced by Du Pont de Nemours & Company, solid content 20%) and 80 ml of tetrahydrofuran were dispersed and the dispersion was coated on the above adhesive layer in a coating weight after drying of 0.20 g/m².

Then, a solution prepared by dissolving 5 g of 2,5-bis-(p-diethylaminophenyl)-1,3,4-oxadiazole and 5 g of a polymethylmethacrylate (molecular weight: about 100,000) in 70 ml of tetrahydrofuran was coated on the charge generation layer in a coating weight after drying of 10 g/m². The thus prepared electrophotographic photosensitive member was subjected to corona charging at −5 KV by an electrostatic process using an electrostatic copying paper test device (Model SP-428; produced by Kawaguchi Denki Co., Ltd.) and, after being retained in a dark place for 10 seconds, exposed to light at an illuminance of 5 lux for examination of charge bearing characteristics. The initial potential is represented by $V_0(-V)$, the potential retentivity in a dark place for 10 seconds by $V_k(\%)$ and the exposure quantity for halving initial potential by E ½ (lux·sec).

$V_0$−600 V; $V_k$ 92%; E ½ 7.8 lux·sec

EXAMPLE 118

On the charge generation layer prepared in Example 117, there was coated a solution containing 5 g of 2,4,7-trinitrofluorenone and 5 g of polycarbonate of 2,2-bis(4-hydroxyphenyl)propane (molecular weight: about 30,000) dissolved in 70 ml of tetrahydrofuran in a coating weight after drying of 12 g/m². The charge bearing characteristics were measured in the same manner as described in Example 117, except that the charging polarity was positive, to give the following specific values.

$V_0$+510 V; $V_k$ 88%; E ½ 16.0 lux·sec

EXAMPLES 119–136

An aqueous hydroxypropyl cellulose solution was coated and dried on the aluminum surface of a Mylar film on which aluminum was vapor deposited to provide an adhesive layer of 0.8 g/m².

Then, 5 g of the dis-azo pigment represented by the formula (G), wherein $A_1$, $A_2$, $A_7$ and $B_1$ have the structures as indicated in Table 12 was dispersed together with a solution containing 2 g of a polyvinyl butyral resin (butyral content: 63 mole %) dissolved in 95 ml of ethanol, and the resulting dispersion was coated, on the above adhesive layer, followed by drying, in a coating weight of 0.2 g/m².

Subsequently, on the above charge generation layer, there was coated a solution containing 5 g of 1-phenyl-3-(p-diethylaminostyryl)-5-(p-diethylaminophenyl)-pyrazoline and 5 g of the polycarbonate resin used in Example 118, followed by drying, to form a charge transport layer in a coating weight of 11 g/m².

Measurement of charge bearing characteristics of the thus prepared photosensitive members was conducted in a similar manner to described in Example 117 to give the results set forth in Table 13.

TABLE 12
| Example | Pigment No. | Structures of pigments used: Dis-azo pigment represented by the formula (G) $B_1$ | $A_1$ | $A_2$ | $A_7$ (position relative to azo group) |
|---|---|---|---|---|---|
| 119 | 106 | 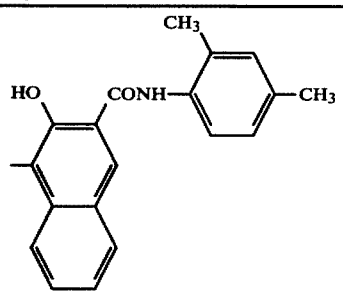 | $CH_3$ | $C_2H_5$ | H |
| 120 | 107 | 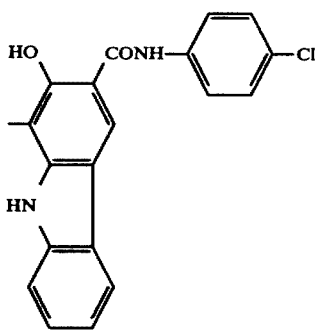 | $CH_3$ | $C_2H_5$ | H |
| 121 | 108 | 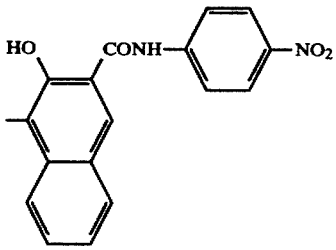 | $CH_3$ | $C_2H_5$ | $CH_3$ (O) |
| 122 | 109 | 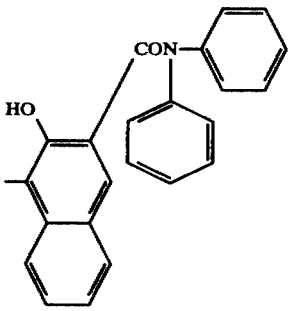 | $CH_3$ | $CH_3$ | H |
| 123 | 110 | 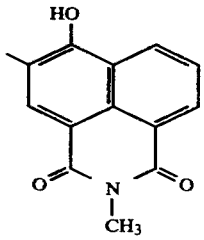 | $CH_3$ | $CH_3$ | H |

TABLE 12-continued
| Structures of pigments used | | | | | |
|---|---|---|---|---|---|
| | | Dis-azo pigment represented by the formula (G) | | | |
| Example | Pigment No. | $B_1$ | $A_1$ | $A_2$ | $A_7$ (position relative to azo group) |
| 124 | 111 | 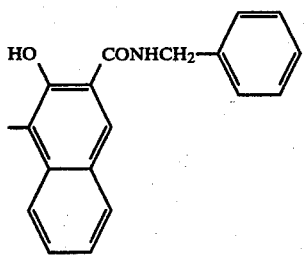 | $CH_3$ | $(CH_2)_3CH_3$ | H |
| 125 | 112 | 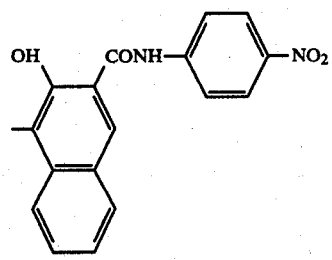 | $CH_3$ | $(CH_2)_3CH_3$ | Cl (m) |
| 126 | 113 | 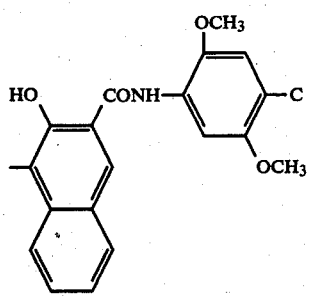 | $CH_3$ | $(CH_2)_3CH_3$ | $OC_2H_5$ (O) |
| 127 | 114 | 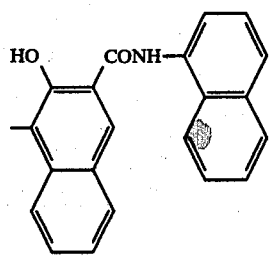 | $CH_3$ | $(CH_2)_3CH_3$ | $OCH_3$ (O) |
| 128 | 115 | 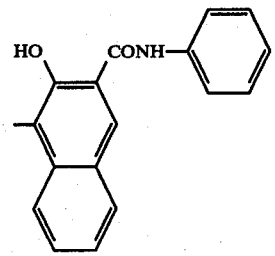 | $CH_3$ | $C_2H_5$ | $(OCH_3)_2$ (O, O') |

TABLE 12-continued
| Example | Pigment No. | Structures of pigments used: Dis-azo pigment represented by the formula (G) $B_1$ | $A_1$ | $A_2$ | $A_7$ (position relative to azo group) |
|---|---|---|---|---|---|
| 129 | 116 | 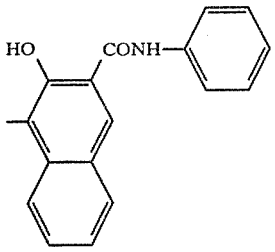 | $CH_3$ | $C_2H_5$ | $NHCOCH_3$ (m) |
| 130 | 117 | 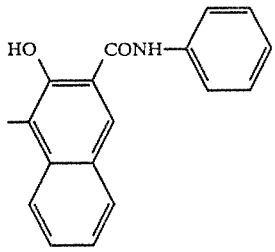 | $CH_3$ | H | H |
| 131 | 118 | 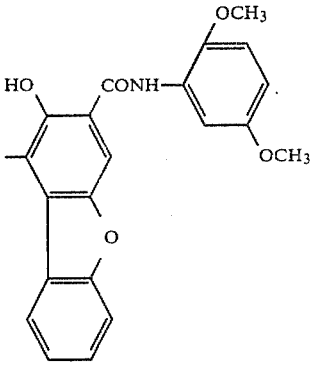 | $CH_3$ | $C_2H_5$ | H |
| 132 | 119 | 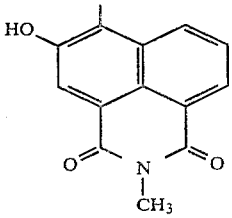 | $CH_3$ | $C_2H_5$ | H |
| 133 | 120 | 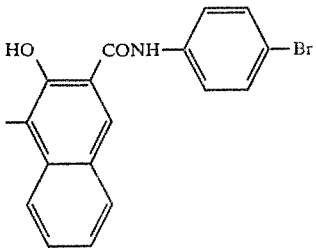 | $CH_3$ | $C_2H_5$ | H |

TABLE 12-continued

| Example | Pigment No. | Structures of pigments used: Dis-azo pigment represented by the formula (G) $B_1$ | $A_1$ | $A_2$ | $A_7$ (position relative to azo group) |
|---|---|---|---|---|---|
| 134 | 121 | 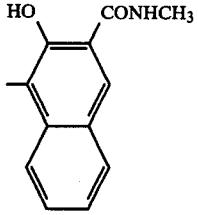 | $CH_3$ | $CH_3$ | H |
| 135 | 122 | 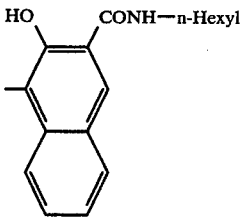 | $CH_3$ | $C_2H_5$ | $CH_3$ (O) |
| 136 | 123 | 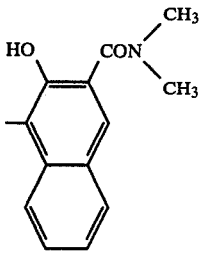 | $CH_3$ | $CH_3$ | Cl (m) |

TABLE 13

| Example | Charge bearing characteristics: Pigment No. | $V_O$ (−V) | $V_k$ (%) | $E_{\frac{1}{2}}$ (lux · sec) |
|---|---|---|---|---|
| 119 | 106 | 580 | 90 | 7.9 |
| 120 | 107 | 590 | 89 | 8.0 |
| 121 | 108 | 600 | 94 | 12.9 |
| 122 | 109 | 620 | 93 | 14.9 |
| 123 | 110 | 590 | 92 | 7.8 |
| 124 | 111 | 610 | 93 | 16.8 |
| 125 | 112 | 600 | 92 | 11.7 |
| 126 | 113 | 600 | 90 | 10.8 |
| 127 | 114 | 610 | 91 | 12.6 |
| 128 | 115 | 590 | 90 | 7.8 |
| 129 | 116 | 580 | 88 | 9.4 |
| 130 | 117 | 570 | 87 | 11.8 |
| 131 | 118 | 600 | 92 | 8.2 |
| 132 | 119 | 620 | 94 | 8.6 |
| 133 | 120 | 600 | 93 | 8.4 |
| 134 | 121 | 580 | 93 | 8.2 |
| 135 | 122 | 600 | 89 | 12.4 |
| 136 | 123 | 570 | 88 | 13.3 |

EXAMPLE 137

An aqueous polyvinyl alcohol solution was coated and dried on an aluminum plate of 100μ thickness to form an adhesive layer in a coating weight of 1.2 g/m². Then, a dispersion was prepared by adding 0.05 g of the pigment No. 107 used in Example 120 to a solution containing 5 g of 2-(p-diethylaminophenyl)-4-dimethylamino-5-(2-chlorophenyl) oxazole and 5 g of a poly-2,2-propane-bis(4-phenylisophthalateterephthalate co-ester) (carboxylic acid molar ratio=50:50) dissolved in 70 ml of tetrahydrofuran. The resulting dispersion was coated on the above adhesive layer and dried to give a coating weight of 10 g/m².

The thus prepared photosensitive member was tested for charge bearing characteristics in a similar manner to that described in Example 117 except that the charging polarity was positive. The results are shown below.

$V_0$+500 V, $V_k$ 86%; E ½ 18.8 lux·sec.

EXAMPLE 138

On an aluminum plate of 100μ in thickness, an aqueous polyvinyl alcohol solution was coated and dried to form an adhesive layer of 0.8 g/m².

Then, 5 g of the pigment having the following structural formula (pigment No. 124):

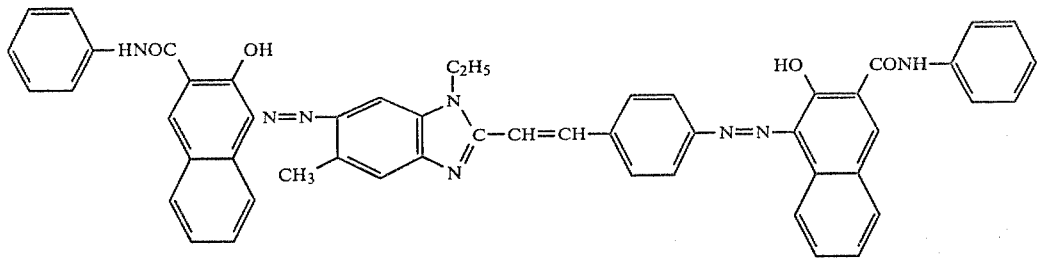

10 g of a polyester resin (Polyester adhesive 49,000, produced by Du Pont de Nemours & Company, solid content 20%) and 80 ml of tetrahydrofuran were dispersed and the dispersion was coated on the above adhesive layer in a coating weight after drying of 0.20 g/m$^2$.

Then, a solution prepared by dissolving 5 g of 2,5,-bis-(p-diethylaminophenyl)-1,3,4-oxadiazole and 5 g of a polymethylmethacrylate (molecular weight: about 100,000) in 70 ml of tetrahydrofuran was coated on the charge generation layer in a coating weight after drying of 10 g/m$^2$. The thus prepared electrophotographic photosensitive member was subjected to corona charging at $-5$ KV by an electrostatic process using an electrostatic copying paper test device (Model SP-428; produced by Kawaguchi Denki Co., Ltd.) and, after being retained in a dark place for 10 seconds, exposed to light at an illuminance of 5 lux for examination of charge bearing characteristics. The initial potential is represented by $V_0(-V)$, the potential retentivity in a dark place for 10 seconds by $V_k(\%)$ and the exposure quantity for halving initial potential by E ½ (lux·sec).

$V_0-590$ V; $V_k$ 92%; E ½ 8.6 lux·sec.

EXAMPLE 139

On the charge generation layer prepared in Example 138, there was coated a solution containing 5 g of 2,4,7-trinitrofluorenone and 5 g of polycarbonate of 2,2-bis(4-hydroxyphenyl)propane (molecular weight: about 30,000) dissolved in 70 ml of tetrahydrofuran in a coating weight after drying of 12 g/m$^2$. The charge bearing characteristics were measured in the same manner as in Example 138, except that the charging polarity was positive, to give the following specific values.

$V_0+500$ V; $V_k$ 87%; E ½ 16.8 lux·sec.

EXAMPLE 140

On an aluminum plate having a thickness of 100μ, there was coated an aqueous ammonia solution of casein and dried to form an adhesive layer of 1.0 g/m$^2$.

Then, 1.0 g of the pigment No. 124 used in Example 138 was added to a solution containing 5 g of p-diethylaminobenzaldehyde-N,N-diphenylhydrazone and 5 g of the polycarbonate resin used in Example 139 dissolved in 70 ml of tetrahydrofuran to be dispersed therein. The resultant dispersion was coated and dried on the above adhesive layer in a coating weight of 12 g/m$^2$.

The thus prepared photosensitive member was subjected to measurement of charge bearing characteristics in the same manner as in Example 138, except that the charging polarity was positive, to obtain the following results.

$V_0+540$ V; $V_k$ 90%; E ½ 18.2 lux·sec.

EXAMPLES 141–156

A dispersion prepared by adding 5 g of the dis-azo pigment represented by the formula (H), wherein $A_1$, $A_2$ and $B_1$ have the structures as indicated in Table 14, into a solution containing 2 g of a polyvinyl butyral resin (butyral content: 63 mole %) dissolved in 95 ml of ethanol was coated on the aluminum surface of an aluminum deposited Mylar film, followed by drying, in a coating weight of 0.2 g/m$^2$.

Then, a solution containing 5 g of 1-phenyl-3-(p-diethylaminostyryl)-5-(p-diethylaminophenyl)pyrazoline and 5 g of a poly-2,2-propane-bis(4-phenylisophthalate-terephthalate) (molar ratio: isophthalic acid:terephthalic acid=1:1) dissolved in 70 ml of tetrahydrofuran was coated on the above charge generation layer and dried to form a charge transport layer of 11 g/m$^2$. The charge bearing characteristics of these photosensitive members were measured in a similar way to that described in Example 138 to obtain the results as shown in Table 15.

TABLE 14
| Example | Pigment No. | Pigment structure: Dis-azo pigment represented by the formula (H) $B_1$ | $A_2$ | $A_1$ |
|---|---|---|---|---|
| 141 | 125 | 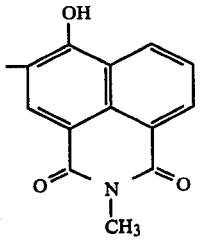 | $-C_2H_5$ | $-CH_3$ |
| 142 | 126 | 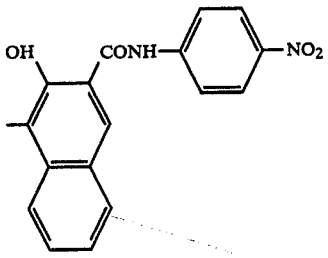 | $-C_2H_5$ | $-CH_3$ |
| 143 | 127 | 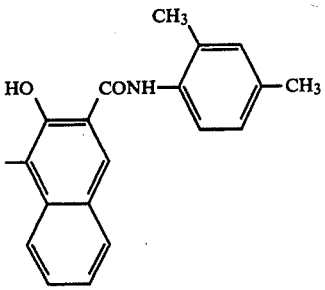 | $-C_2H_5$ | $-CH_3$ |
| 144 | 128 | 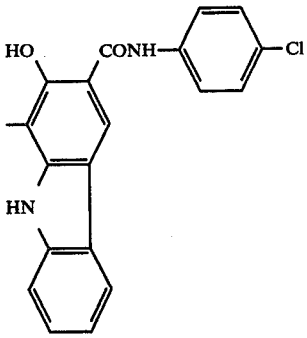 | $-C_2H_5$ | $-CH_3$ |
| 145 | 129 | 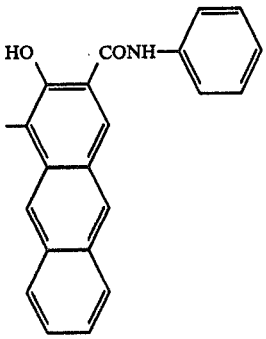 | $-C_2H_5$ | $-CH_3$ |

TABLE 14-continued
| Example | Pigment No. | Pigment structure: Dis-azo pigment represented by the formula (H) $B_1$ | $A_2$ | $A_1$ |
|---|---|---|---|---|
| 146 | 130 | 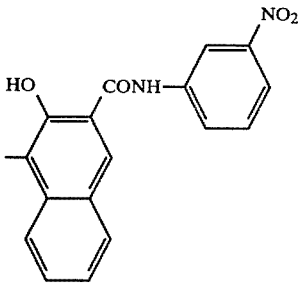 | $-C_2H_5$ | $-CH_3$ |
| 147 | 131 | 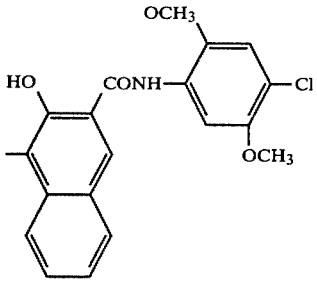 | $-C_2H_5$ | $-CH_3$ |
| 148 | 132 | 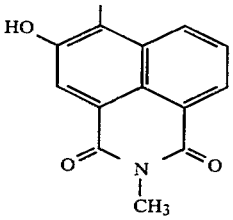 | $-CH_3$ | $-CH_3$ |
| 149 | 133 | 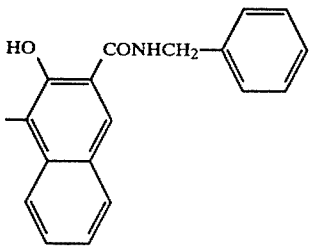 | $-(CH_2)_3CH_3$ | $-CH_3$ |
| 150 | 134 | 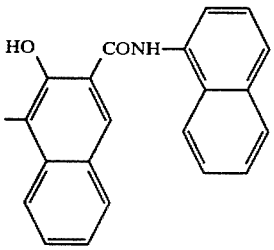 | H | $-CH_3$ |

TABLE 14-continued
| Example | Pigment No. | Pigment structure: Dis-azo pigment represented by the formula (H) $B_1$ | $A_2$ | $A_1$ |
|---|---|---|---|---|
| 151 | 135 | 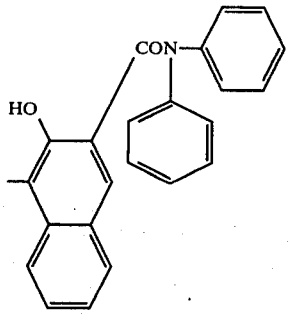 | H | $-CH_3$ |
| 152 | 136 | 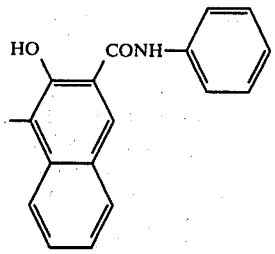 | H | $-CH_3$ |
| 153 | 137 | 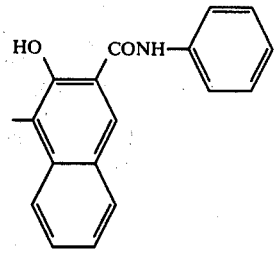 | H | H |
| 154 | 138 | 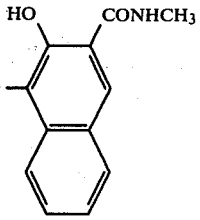 | H | H |
| 155 | 139 | 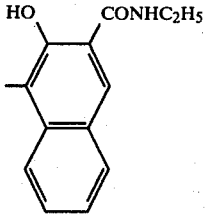 | $CH_3$ | $CH_3$ |

TABLE 14-continued

| Example | Pigment No. | Pigment structure: Dis-azo pigment represented by the formula (H) $B_1$ | $A_2$ | $A_1$ |
|---|---|---|---|---|
| 156 | 140 | 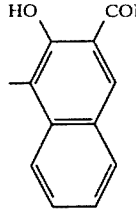 | $C_2H_5$ | $CH_3$ |

TABLE 15

| Example | Charge bearing characteristics: Pigment No. | $V_O$ (−V) | $V_k$ (%) | $E_{\frac{1}{2}}$ (lux · sec) |
|---|---|---|---|---|
| 141 | 125 | 610 | 94 | 8.4 |
| 142 | 126 | 600 | 92 | 9.3 |
| 143 | 127 | 590 | 92 | 9.4 |
| 144 | 128 | 580 | 91 | 9.2 |
| 145 | 129 | 600 | 93 | 9.4 |
| 146 | 130 | 620 | 94 | 12.4 |
| 147 | 131 | 590 | 89 | 11.2 |
| 148 | 132 | 590 | 91 | 9.0 |
| 149 | 133 | 630 | 94 | 16.8 |
| 150 | 134 | 580 | 90 | 13.2 |
| 151 | 135 | 600 | 91 | 14.8 |
| 152 | 136 | 540 | 88 | 12.6 |
| 153 | 137 | 550 | 89 | 13.4 |
| 154 | 138 | 560 | 88 | 10.3 |
| 155 | 139 | 580 | 90 | 12.3 |
| 156 | 140 | 590 | 93 | 14.4 |

EXAMPLE 157

An aqueous hydroxypropyl cellulose solution was coated and dried on the aluminum surface of a Mylar film on which aluminum was vapor deposited to form an adhesive layer of 0.8 g/m$^2$.

Then, a dispersion prepared by adding 1 g of the pigment No. 125 into a solution of 5 g of a poly-N-vinylcarbazole (molecular weight: about 300,000), 5 g of 2-(p-diethylaminophenyl-4-(p-dimethylaminophenyl)-5-(o-chlorophenyl)oxazole and 0.1 g of 2,4,7-trinitrofluorenone dissolved in 140 ml of dichloroethane was coated on the above adhesive layer, followed by drying, in a coating weight of 12 g/m$^2$.

The thus prepared photosensitive member was subjected to measurement of charge bearing characteristics in the same manner as in Example 138, except that the charging polarity was made positive, to give the following results.

$V_0$+510 V; $V_k$ 87%; E ½ 16.8 lux·sec.

EXAMPLE 158

On an aluminum plate, there was coated a solution of casein in an aqueous ammonia (casein 11.2 g, 28% aqueous ammonia 1 g, water 222 ml) by means of a Meyer bar and dried to form an adhesive layer of 1.0 g/m$^2$. Then 5 g of the pigment No. 141 was dispersed in a ball mill together with a solution of 2 g polyvinyl butyral resin (content of butyral: 63 mole %) dissolved in 95 ml of ethanol, and the dispersion was coated by a Meyer bar on the adhesive layer to form a charge generation layer in a coating weight after drying of 0.2 g/m$^2$.

Then, a solution prepared by dissolving 5 g of 2,5-bis(p-diethylaminophenyl)-1,3,4-oxadiazole and 5 g of polycarbonate of 2,2-bis(4-hydroxyphenyl)propane (molecular weight: about 30,000) in 70 ml of tetrahydrofuran was coated on the charge generation layer and dried to form a charge transport layer of 10 g/m$^2$. The thus prepared electrophotographic photosensitive member after conditioned at 20° C. and 65% of relative humidity, was subjected to corona charging at −5 KV by an electrostatic process using an electrostatic copying paper test device (Model SP-428; produced by Kawaguchi Denki Co., Ltd.) and, after being retained in a dark place for 10 seconds, exposed to light at an illuminance of 5 lux for examination of charge bearing characteristics. The initial potential is represented by $V_0$(−V), the potential retentivity in a dark place for 10 seconds by $V_k$(%) and the exposure quantity for halving initial potential by E ½ (lux·sec).

$V_0$−580 V; $V_k$ 97%; E ½ 13.5 lux·sec.

EXAMPLE 159

On the charge generation layer prepared in Example 158, there was coated by a Meyer bar a solution containing 5 g of 2,4,7-trinitro-fluorenone and 5 g of the same polycarbonate resin as used in Example 158 dissolved in 70 ml of tetrahydrofuran in a coating weight after drying of 10.8 g/m$^2$. The charge bearing characteristics were determined in the same manner as in Example 158, except that the charging polarity was positive, to obtain the following specific values.

$V_0$⊕560 V, $V_k$ 90%; E ½ 20 lux·sec.

EXAMPLE 160

A dispersion prepared in a ball mill by adding 1.0 g of the pigment No. 141 into a solution of 5 g of p-diethylaminobenzaldehyde-N,N-diphenylhydrazone and 5 g of a poly-N-vinylcarbazole (molecular weight: about 300,000) dissolved in 70 ml of tetrahydrofuran was coated by a Meyer bar on the casein layer of the aluminum plate having the casein layer as used in Example 158 in a coating weight of 10 g/m$^2$.

The thus prepared photosensitive member was subjected to measurement of charge bearing characteristics in a similar way to that described in Example 158 to obtain the following results. The charging polarity was made positive.

$V_0$+580 V; $V_k$ 90%; E ½ 24 lux·sec.

EXAMPLES 161–176

A dispersion of 5 g dis-azo pigment represented by the formula (J), wherein $A_8$ and $B_2$ are indicated in Table 16, 10 g polyester resin solution (Polyester adhesive 49,000, produced by Du Pont de Nemours & Company; solid content 20%) and 80 ml tetrahydrofuran was coated on the aluminum surface of a Mylar film on which aluminum was vapor deposited, followed by drying to a coating weight of 0.25 g/m$^2$. Then, a solution of 5 g 1-phenyl-3-(p-diethylaminostyryl)-5-p-diethylaminophenylpyrazoline and 5 g of a polymethylmethacrylate resin (molecular weight: about 100,000) in 70 ml tetrahydrofuran was coated on the above charge generation layer by a baker applicator, followed by drying, in a coating weight of 10 g/m$^2$. Thus, a photosensitive member was prepared.

Table 16 shows the structures of pigments used and Table 17 charge bearing characteristics of each photosensitive member, which were measured in the same manner as in Example 158.

TABLE 16

| Example | Pigment No. | Structures of pigments used: Pigment represented by the formula (J) — $A_8$ (position relative to azo group) | $B_2$ |
|---|---|---|---|
| 161 | 141 | H | 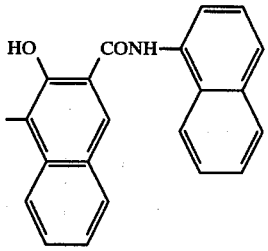 |
| 162 | 142 | H | 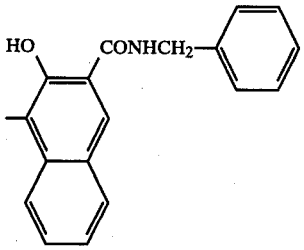 |
| 163 | 143 | H | 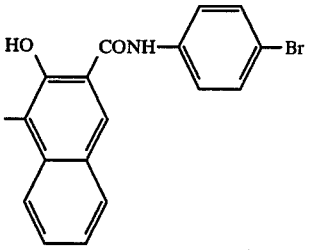 |
| 164 | 144 | H | 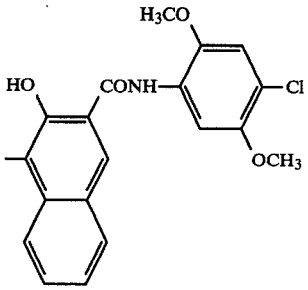 |

TABLE 16-continued

| Example | Pigment No. | Structures of pigments used: Pigment represented by the formula (J) — $A_8$ (position relative to azo group) | $B_2$ |
|---|---|---|---|
| 165 | 145 | H | 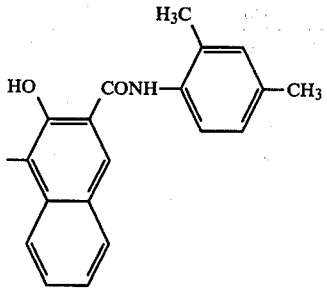 |
| 166 | 146 | H | 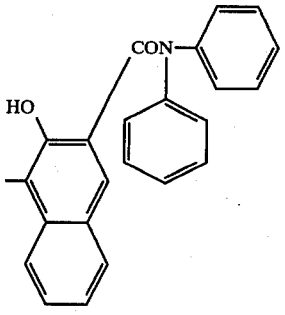 |
| 167 | 147 | H | 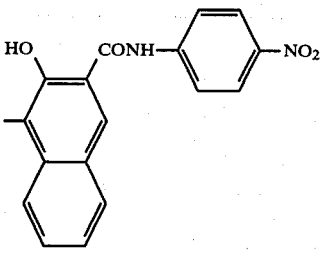 |
| 168 | 148 | H | 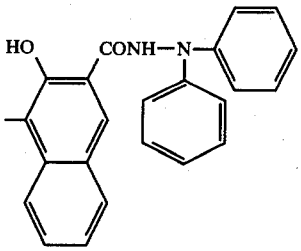 |
| 169 | 149 | H | 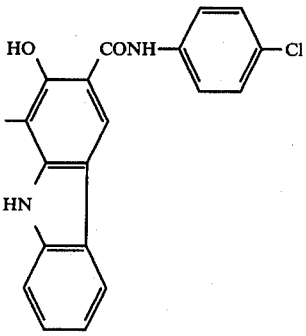 |

TABLE 16-continued

| Example | Pigment No. | Structures of pigments used: Pigment represented by the formula (J) $A_8$ (position relative to azo group) | $B_2$ |
|---|---|---|---|
| 170 | 150 | H | 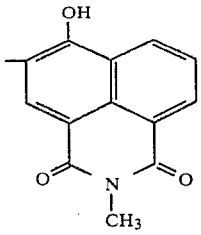 |
| 171 | 151 | $CH_3$ (O) | 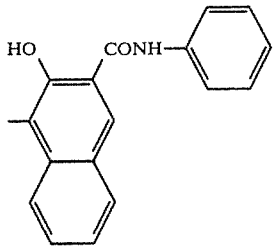 |
| 172 | 152 | Cl (m) | 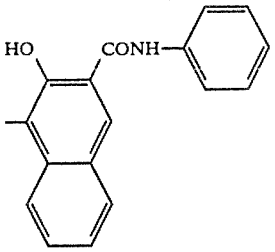 |
| 173 | 153 | $NHCOCH_3$ (O) | 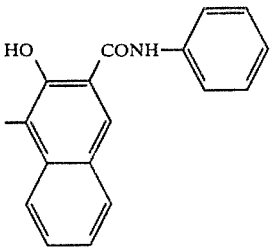 |
| 174 | 154 | H | 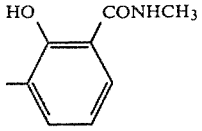 |
| 175 | 155 | Cl (m) | 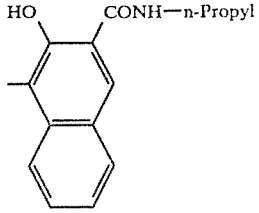 |

TABLE 16-continued

| Example | Pigment No. | Structures of pigments used: Pigment represented by the formula (J) $A_8$ (position relative to azo group) | $B_2$ |
|---|---|---|---|
| 176 | 156 | $CH_3$ (O) | 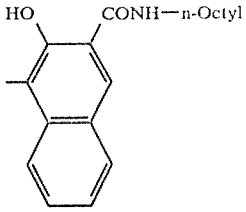 |

TABLE 17

| Example | Charge bearing characteristics $V_O$ (−V) | $V_k$ (%) | $E_{\frac{1}{2}}$ (lux · sec) |
|---|---|---|---|
| 161 | 600 | 96 | 13.8 |
| 162 | 580 | 93 | 20.4 |
| 163 | 590 | 92 | 18.3 |
| 164 | 575 | 94 | 14.8 |
| 165 | 590 | 93 | 15.2 |
| 166 | 610 | 98 | 22.3 |
| 167 | 580 | 93 | 18.3 |
| 168 | 590 | 96 | 20.5 |
| 169 | 570 | 89 | 14.8 |
| 170 | 590 | 89 | 14.0 |
| 171 | 560 | 96 | 14.6 |
| 172 | 590 | 91 | 13.9 |
| 173 | 560 | 88 | 16.0 |
| 174 | 570 | 90 | 12.0 |
| 175 | 560 | 88 | 12.2 |
| 176 | 600 | 91 | 14.9 |

What we claim is:

1. An electrophotographic photosensitive member having a photosensitive layer comprising at least one disazo pigment represented by the following formula (B):

Formula (B)

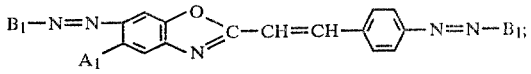

wherein $A_1$ is a hydrogen atom, a halogen atom or a lower alkyl group and $B_1$ is a coupler residue.

2. An electrophotographic photosensitive member according to claim 1, wherein said electrophotographic photosensitive member comprises at least a conductive layer, a charge generation layer containing at least one dis-azo pigment represented by the following Formula (B), and a charge transport layer:

Formula (B)

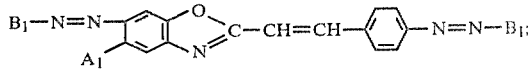

wherein $A_1$ is a hydrogen atom, a halogen atom or a lower alkyl group and $B_1$ is a coupler residue.

3. An electrophotographic photosensitive member according to claim 2, wherein said electrophotographic photosensitive member comprises at least a conductive layer, an adhesive layer provided on said conductive layer, a charge generation layer containing at least one dis-azo pigment represented by the following Formula (B), and a charge transport layer:

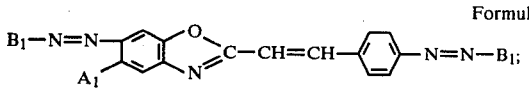

Formula (B)

wherein $A_1$ is a hydrogen atom, a halogen atom or a lower alkyl group and $B_1$ is a coupler residue.

4. An electrophotographic photosensitive member according to claim 1, wherein said electrophotographic photosensitive member comprises at least one conductive layer and a layer, containing at least one dis-azo pigment represented by the following Formula (B) and at least one charge transport material:

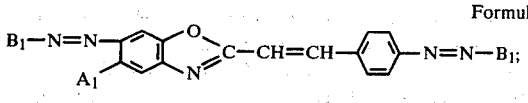

Formula (B)

wherein $A_1$ is a hydrogen atom, a halogen atom or a lower alkyl group and $B_1$ is a coupler residue.

5. An electrophotographic photosensitive member according to any of claims 1, 2, 3 and 4, wherein said dis-azo pigment is represented by the following Formula ($b_1$):

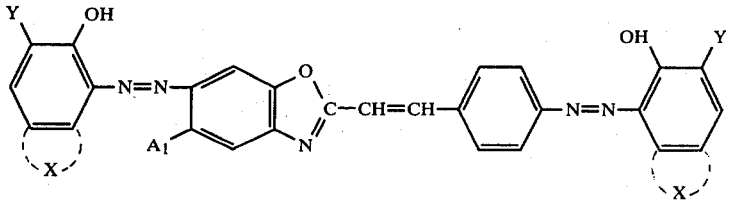

Formula ($b_1$)

wherein $A_1$ is a hydrogen atom, a lower alkyl group, or a halogen atom, X is an atomic group forming a naphthalene-, anthracene, carbazole- or dibenzofuran-ring together with the benzene ring, and Y a group of the formula

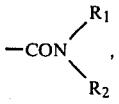

wherein $R_1$ is a hydrogen atom, an unsubstituted or substituted alkyl, or an unsubstituted or substituted phenyl group and $R_2$ an unsubstituted or substituted alkyl, or an unsubstituted or substituted aryl group.

6. An electrophotographic photosensitive member according to any of claims 1, 2, 3 and 4, wherein said dis-azo pigment is represented by the following Formula ($b_2$):

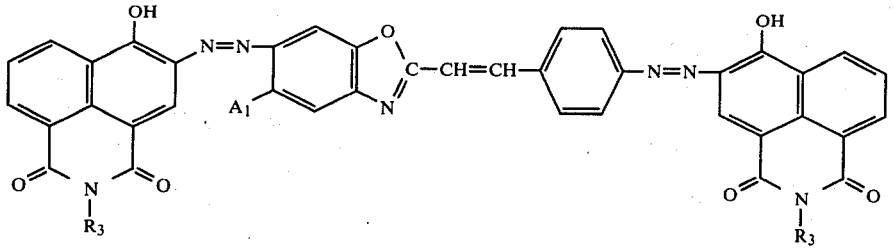

Formula ($b_2$)

wherein $A_1$ is a hydrogen atom, a lower alkyl group or a halogen atom, and $R_3$ is an unsubstituted or substituted alkyl, or an unsubstituted or substituted phenyl group.

7. An electrophotographic photosensitive member according to any of claims 1, 2, 3 and 4, wherein said dis-azo pigment is represented by the following Formula ($b_3$):

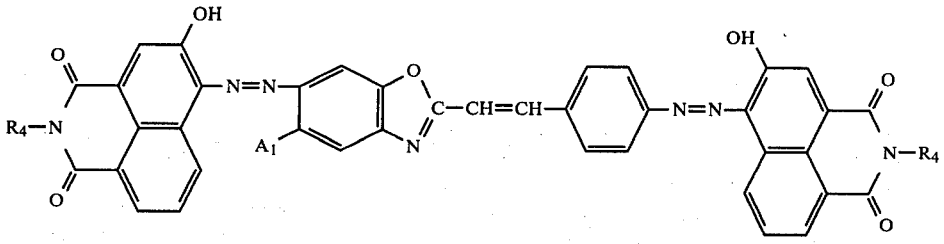

wherein $A_1$ is a hydrogen atom, a lower alkyl group or a halogen atom, and $R_4$ is an unsubstituted or substituted alkyl, or an unsubstituted or substituted phenyl group.

8. An electrophotographic photosensitive member according to claim 1, wherein said $A_1$ is a hydrogen atom, a chlorin atom or a methyl radical.

9. An electrophotographic photosensitive member according to claim 5, wherein said $B_1$ is any of coupler residues represented by Formulas ($b_4$), ($b_5$) and ($b_6$) shown below:

Formula

-continued (b4)

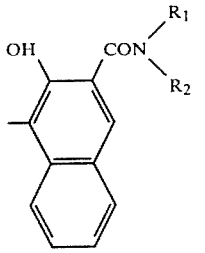

(b5)

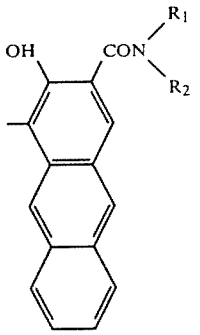

(b6)

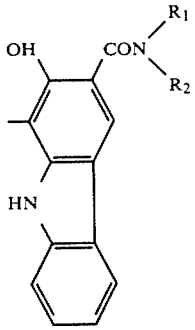

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group.

10. An electrophotographic photosensitive member according to claim 2 or 3, wherein said charge transport layer is provided on the charge generation layer.

11. An electrophotographic photosensitive member according to any of claims 2, 3 and 10, wherein said charge transport layer contains at least one compound selected from the group consisting of oxadiazoles, hydrazones, pyrazolines and nitrofluorenones.

12. An electrophotographic photosensitive member according to claim 11, wherein said pyrazoline is 1-phenyl-3-(p-diethylaminostyryl)-5-(p-diethylaminophenyl)-pyrazoline or 1-[6-methoxypyridyl-(2)]-3-(p-diethylaminostyryl)-5-(p-diethylaminophenyl)pyrazoline.

13. An electrophotographic photosensitive member according to claim 11, wherein said nitrofluorenone is 2,4,7-trinitro-9-fluorenone.

14. An electrophotographic photosensitive member according to claim 11, wherein said oxadiazole is 2,5-bis(p-diethylaminophenyl)-1,3,4-oxadiazole.

15. An electrophotographic photosensitive member according to any of claims 2 and 3, wherein said charge generation layer contains a binder.

16. An electrophotographic photosensitive member according to claim 3, wherein said adhesive layer contains casein.

17. An electrophotographic photosensitive member according to claim 4, wherein said charge transport material is at least one compound selected from the group consisting of nitrofluorenones, hydrazones, oxadiazoles and pyrazolines.

18. An electrophotographic photosensitive member according to claim 4, wherein said charge transport material consists of 2,5-bis(p-diethylaminophenyl)-1,3,4-oxadiazole and poly-N-vinylcarbazole.

19. An electrophotographic photosensitive member having a photosensitive layer, said photosensitive layer comprising a charge generation layer containing at least one disazo pigment represented by the following Formula (C), and a charge transport layer;

Formula (C)

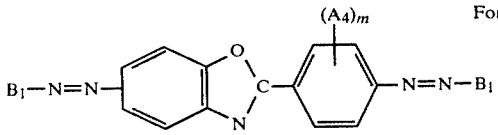

wherein $B_1$ represents a coupler residue and $A_4$ a hydroxyl or an acrylamino group when m is an integer of 1 to 4, or also an alkoxy group when m is 2.

20. An electrophotographic photosensitive member according to claim 19, wherein said electrophotographic photosensitive member comprises at least a conductive layer, an adhesive layer provided on said conductive layer, a charge generation layer containing at least one dis-azo pigment represented by the following Formula (C), and a charge transport layer:

Formula (C)

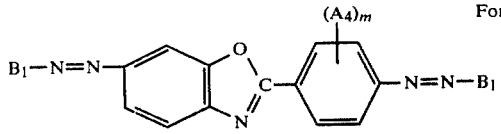

wherein $B_1$ represents a coupler residue and $A_4$ is a hydroxyl or an acylamino group when m is an integer of 1 to 4, or also an alkoxy group when m is an integer of 2 to 4.

21. An electrophotographic photosensitive member which comprises at least a conductive layer and a layer, containing at least one dis-azo pigment represented by the following Formula (C) and at least one charge transport material:

Formula (C)

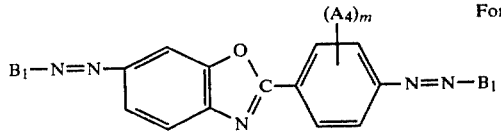

wherein $B_1$ represents a coupler residue and $A_4$ a hydroxyl or an acylamino group when m is an integer of 1 to 4, or also an alkoxy group when m is an integer of 2 to 4.

22. An electrophotographic photosensitive member according to any of claims 19, 20 and 21, wherein said dis-azo pigment is represented by the following Formula ($c_1$):

Formula ($c_1$)

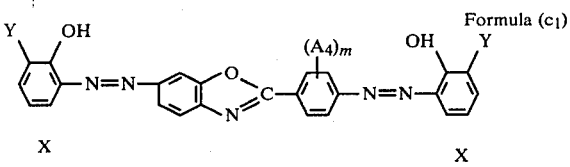

wherein $A_4$ is a hydroxyl or an acylamino group when m is an integer of 1 to 4, or also an alkoxy group when m is an integer of 2 to 4, X is an atomic group forming a naphthalene-, anthracene-, carbazole- or dibenzofuran-ring together with the benzene ring, and Y a grouop of the formula

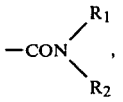

(wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group).

23. An electrophotographic photosensitive member according to any of claims 19, 20 and 21, wherein said dis-azo pigment is represented by the following Formula ($c_2$):

Formula ($c_2$)

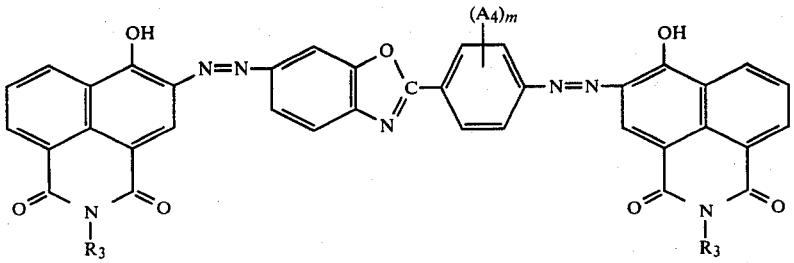

wherein $A_4$ is a hydroxyl or an acylamino group when m is an integer of 1 to 4, or also an alkoxy group when m is an integer of 2 to 4 and $R_3$ is an unsubstituted or substituted alkyl, or an unsubstituted or substituted phenyl group.

24. An electrophotographic photosensitive member according to any of claims 19, 20 and 21, wherein said dis-azo pigment is represented by the following Formula ($c_3$):

Formula ($c_3$)

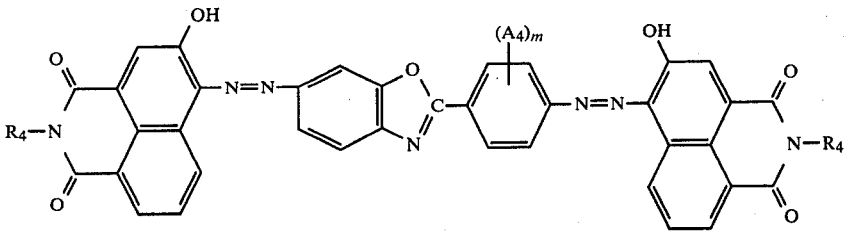

wherein $A_4$ is a hydroxyl or an acylamino group when m is an integer of 1 to 4, or also an alkoxy group when m is an integer of 2 to 4 and $R_3$ is an unsubstituted or substituted alkyl, or an unsubstituted or substituted phenyl group.

25. An electrophotographic photosensitive member according to claim 22, wherein there is contained at least one dis-azo pigment wherein said $B_1$ is a coupler residue represented by the Formula ($c_4$) or ($c_5$):

Formula ($c_4$)

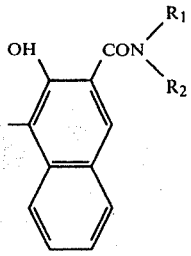

($c_5$)

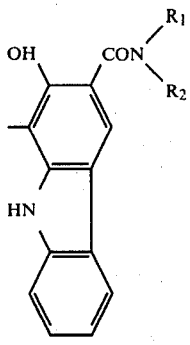

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group.

26. An electrophotographic photosensitive member according to claim 19 or 20, wherein said charge transport layer is provided on the charge generation layer.

27. An electrophotographic photosensitive member according to any of claims 19 and 20, wherein said charge transport layer contains at least one compound selected from the group consisting of oxadiazoles, hydrazones, pyrazolines and nitrofluorenones.

28. An electrophotographic photosensitive member according to claim 27, wherein said hydrazones are at least one compound selected from the group consisting of p-diethylaminobenzaldehyde-N,N-diphenylhydrazone, N-methyl-N-phenylhydrazino-3-methylidene-9-ethylcarbazole and N,N-diphenylhydrazino-3-methylidene-9-ethylcarbazole.

29. An electrophotographic photosensitive member according to claim 27, wherein said pyrazoline is 1-phenyl-3-(p-diethylaminostyryl)-5-(p-diethylaminophenyl)-pyrazoline.

30. An electrophotographic photosensitive member according to claim 27, wherein said oxadiazole is 2,5-bis(p-diethylaminophenyl)-1,3,4-oxadiazole.

31. An electrophotographic photosensitive member according to claim 27, wherein said nitrofluorenones are at least one compound selected from the group consisting of 2,4,7-trinitro-9-fluorenone, 2,4,5,7-tetranitrofluorenone and 2,4,7-trinitro-9-dicyanomethylenefluorenone.

32. An electrophotographic photosensitive member according to any of claims 19 and 20, wherein said charge generation layer contains a binder.

33. An electrophotographic photosensitive member according to claim 32, wherein said binder is polyvinyl butyral or polyesters.

34. An electrophotographic photosensitive member according to claim 20, wherein said adhesive layer contains casein.

35. An electrophotographic photosensitive member according to claim 21, wherein said charge transport material is at least one compound selected from the group consisting of hydrazones, pyrazolines and nitrofluorenones.

36. An electrophotographic photosensitive member according to claim 21, wherein said charge transport material consists of hydrazones and poly-N-vinylcarbazole.

37. An electrophotographic photosensitive member according to claim 35 or 36, wherein said hydrazones are at least one compound selected from the group consisting of p-diethylaminobenzaldehyde-N,N-diphenylhydrazone, N-methyl-N-phenylhydrazino-3-methylidene-9-ethylcarbazole and N,N-diphenylhydrazino-3-methylidene-9-ethylcarbazole.

38. An electrophotographic photosensitive member having a photosensitive layer, said photosensitive layer comprising a charge generation layer containing at least one disazo pigment represented by the following Formula (D), and a charge transport layer:

Formula (D)

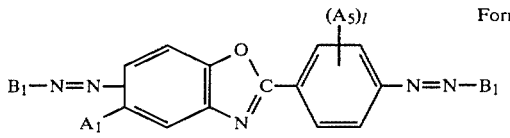

wherein $B_1$ represents a coupler residue, $A_1$ is methyl or chlorine, $A_5$ a hydrogen atom, a halogen atom, a lower alkyl, a lower alkoxy, an acylamino or a hydroxyl group, and l an integer of 1 to 4.

39. An electrophotographic photosensitive member according to claim 38, wherein said electrophotographic photosensitive member comprises at least a conductive layer, an adhesive layer provided on said conductive layer, a charge generation layer containing at least one dis-azo pigment represented by the following Formula (D), and a charge transport layer:

Formula (D)

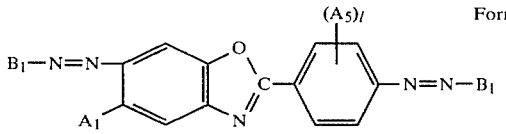

wherein $B_1$ represents a coupler residue, $A_1$ is a lower alkyl group or a halogen atom, $A_5$ is a hydrogen atom, a halogen atom, a lower alkyl, a lower alkoxy, an acylamino or a hydroxyl group, and l is an integer of 1 to 4.

40. An electrophotographic photosensitive member which comprises at least a conductive layer and a layer, containing at least one dis-azo pigment represented by the following Formula (D) and at least one charge transport material:

Formula (D)

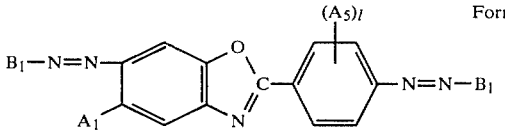

wherein $B_1$ represents a coupler residue, $A_1$ is a lower alkyl group or a halogen atom, $A_5$ is a hydrogen atom, a halogen atom, a lower alkyl, a lower alkoxy, an acylamino or a hydroxyl group, and l is an integer of 1 to 4.

41. An electrophotographic photosensitive member according to any of claims 38, 39 and 40, wherein said dis-azo pigment is represented by the following Formula ($d_1$):

Formula ($d_1$)

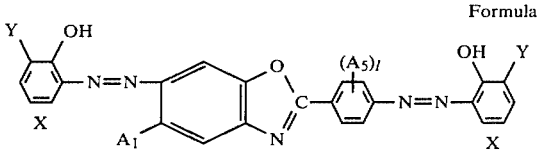

wherein $A_1$ is a lower alkyl group, or a halogen atom, $A_5$ is a hydrogen atom, a halogen atom, a lower alkyl, a lower alkoxy, an acylamino or a hydroxyl group; l is an integer of 1 to 4, X is an atomic group forming a naphthaleneanthracene-, carbazole- or dibenzofuran-ring together with the benzene ring, and Y is a group of the formula

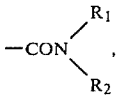

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group.

42. An electrophotographic photosensitive member according to any of claims 38, 39 and 40, wherein said dis-azo pigment is represented by the following Formula ($d_2$):

Formula ($d_2$)

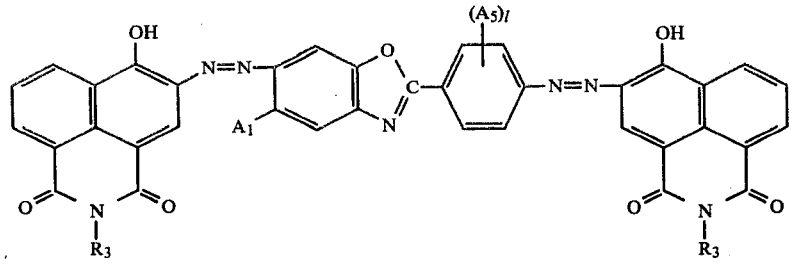

wherein $A_1$ is a lower alkyl group or a halogen atom, $A_5$ is a hydrogen atom, a halogen atom, a lower alkyl, a lower alkoxy, an acylamino or a hydroxyl group, l is an integer of 1 to 4, and $R_3$ is an unsubstituted or substituted alkyl, or an unsubstituted or substituted phenyl group.

43. An electrophotographic photosensitive member according to any of claims 38, 39 and 40, wherein said dis-azo pigment is represented by the following Formula ($d_3$):

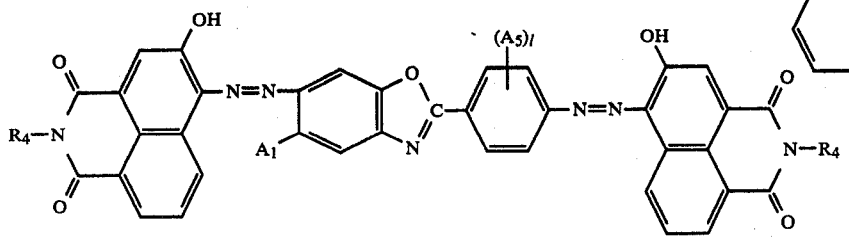

wherein $A_1$ is a lower alkyl group or a halogen atom, $A_5$ is a hydrogen atom a halogen atom, a lower alkyl, a lower alkoxy, an acylamino or a hydroxyl group, l is an integer of 1 to 4, and $R_4$ is an unsubstituted or substituted alkyl, or an unsubstituted or substituted phenyl group.

44. An electrophotographic photosensitive member according to any of claims 38 and 40, wherein said electrophotographic photosensitive member contains at least one dis-azo pigment in which said $A_1$ is a chlorine atom or a methyl radical.

45. An electrophotographic photosensitive member according to claim 41, wherein said electrophotographic photosensitive member contains at least one dis-azo pigment in which said $B_1$ is a coupler residue represented by Formula ($d_4$) or ($d_5$) shown below:

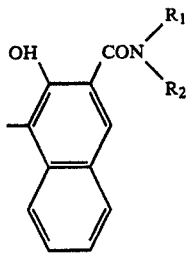

($d_4$)

-continued

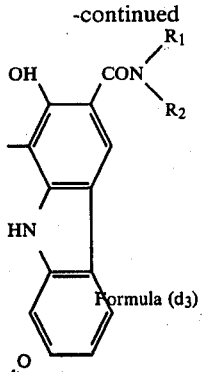

($d_5$)

Formula ($d_3$)

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group.

46. An electrophotographic photosensitive member according to claim 38 or 39, wherein said charge transport layer is provided on the charge generation layer.

47. An electrophotographic photosensitive member according to any of claims 38 and 39, wherein said charge transport layer contains at least one compound selected from the group consisting of oxadiazoles, hydrazones, pyrazolines and nitrofluorenones.

48. An electrophotographic photosensitive member according to claim 47, wherein said hydrazones are at least one compound selected from the group consisting of N-methyl-N-phenylhydrazino-3-methylidene-9-ethylcarbazole and N,N-diphenylhydrazino-3-methylidene-9-ethylcarbazole.

49. An electrophotographic photosensitive member according to claim 47, wherein said pyrazoline is 1-phenyl-3-(p-diethylaminostyryl)-5-(p-diethylaminophenyl)-pyrazoline.

50. An electrophotographic photosensitive member according to claim 47, wherein said oxadiazole is 2,5-bis(p-diethylaminophenyl)-1,3,4-oxadiazole.

51. An electrophotographic photosensitive member according to claim 47, wherein said nitrofluorenones are at least one compound selected from the group consisting of 2,4,7-trinitro-9-fluorenone, 2,4,5,7-tetranitrofluorenone and 2,4,7-trinitro-9-dicyanomethylenefluorenone.

52. An electrophotographic photosensitive member according to any of claims 38 and 39, wherein said charge generation layer contains a binder.

53. An electrophotographic photosensitive member according to claim 52, wherein said binder is polyvinyl butyral or polyesters.

54. An electrophotographic photosensitive member according to claim 39, wherein said adhesive layer contains casein.

55. An electrophotographic photosensitive member according to claim 40, wherein said charge transport material is at least one compound selected from the group consisting of hydrazones, pyrazolines and nitrofluorenones.

56. An electrophotographic photosensitive member according to claim 40, wherein said charge transport material is hydrazones or a poly-N-vinylcarbazole.

57. An electrophotographic photosensitive member according to claim 55 or 56, wherein said hydrazones are at least one compound selected from the group consisting of N-methyl-N-phenylhydrazino-3-methylidene-9-ethylcarbazole and N,N-diphenylhydrazino-3-methylidene-9-ethylcarbazole.

58. An electrophotographic photosensitive member which comprises at least a conductive layer, a charge generation layer containing at least one dis-azo pigment represented by the following Formula (E), and a charge transport layer:

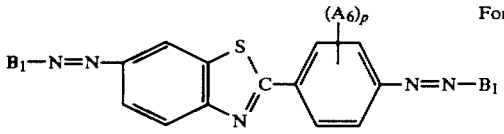

Formula (E)

wherein $B_1$ represents a coupler residue, $A_6$ is a hydrogen atom, a halogen atom, a lower alkyl, a lower alkoxy, an acylamino or a hydroxyl group, and p is an integer of 1 to 4.

59. An electrophotographic photosensitive member according to claim 58, wherein said electrophotographic photosensitive member comprises at least a conductive layer, an adhesive layer provided on said conductive layer, a charge generation layer containing at least one dis-azo pigment represented by the following Formula (E) and; a charge transport layer:

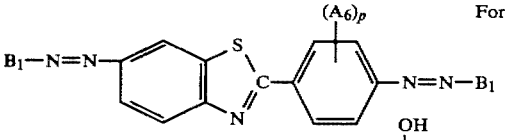

Formula (E)

wherein $B_1$ represents a coupler residue, $A_6$ is a hydrogen atom, a halogen atom, a lower alkyl, a lower alkoxy, an acylamino or a hydroxyl group, and p is an integer of 1 to 4.

60. An electrophotographic photosensitive member which comprises at least a conductive layer and a layer, containing at least one dis-azo pigment represented by the following Formula (E) and at least one charge transport material:

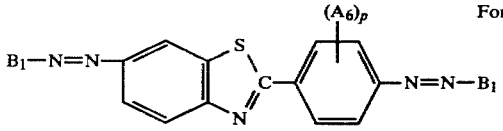

Formula (E)

wherein $B_1$ represents a coupler residue, $A_6$ is a hydrogen atom, a halogen atom, a lower alkyl, a lower alkoxy, an acylamino or a hydroxyl group, and p is an integer of 1 to 4.

61. An electrophotographic photosensitive member according to any of claims 58 and 60, wherein said dis-azo pigment is represented by the following Formula ($e_1$):

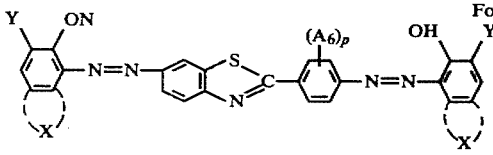

Formula ($e_1$)

wherein $A_6$ is a hydrogen atom, a halogen atom, a lower alkyl, a lower alkoxy, an acylamino or a hydroxyl group, and p is an integer of 1 to 4, X is an atomic group forming a naphthaleneanthracene-, carbazole- or dibenzofuran-ring together with the benzene ring, and Y is a group of the formula

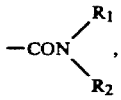

wherein $R_1$ is a hydrogen atom, an unsubstituted or substituted alkyl, or an unsubstituted or substituted phenyl group, and $R_2$ is an unsubstituted or substituted alkyl, or an unsubstituted or substituted aryl group.

62. An electrophotographic photosensitive member according to any of claims 58, 59 and 60, wherein said dis-azo pigment is represented by the following Formula ($e_2$):

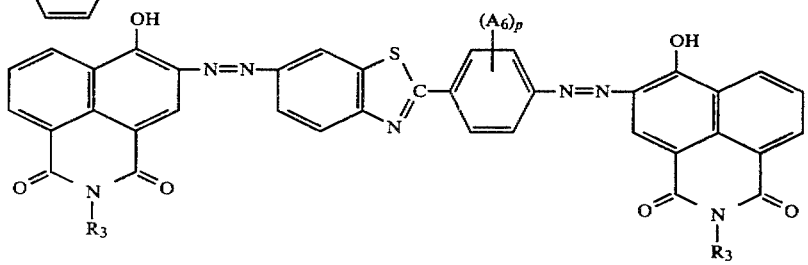

Formula ($e_2$)

wherein $A_6$ is a hydrogen atom, a halogen atom, a lower alkyl, a lower alkoxy, an acylamino or a hydroxyl group, p is an integer of 1 to 4, and $R_3$ is an unsubstituted or substituted alkyl, or an unsubstituted or substituted phenyl group.

63. An electrophotographic photosensitive member according to any of claims 58, 59 and 60, wherein said dis-azo pigment is represented by the following Formula ($e_3$):

Formula ($e_3$)

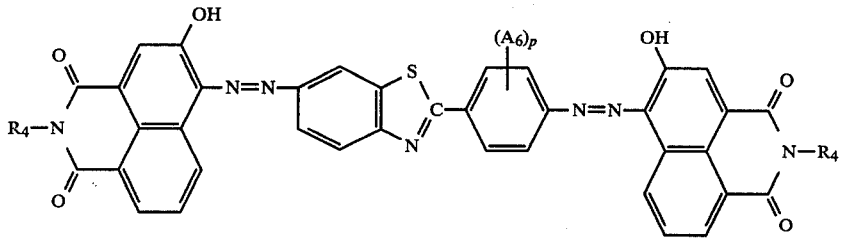

wherein $A_6$ is a hydrogen atom, a halogen atom, a lower alkyl, a lower alkoxy, an acylamino or a hydroxyl group, p is an integer of 1 to 4, and $R_4$ is an unsubstituted or substituted alkyl, or an unsubstituted or substituted phenyl group.

64. An electrophotographic photosensitive member according to claim 61, wherein said $B_1$ is a coupler residue represented by Formula ($e_4$) or ($e_5$) shown below:

Formula ($e_4$)

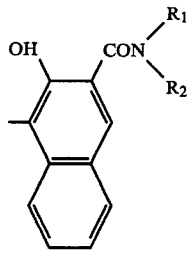

($e_5$)

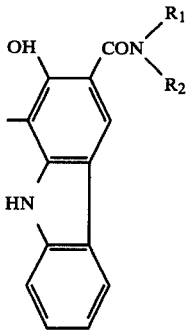

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group.

65. An electrophotographic photosensitive member according to claim 58 or 59, wherein said charge transport layer is provided on the charge generation layer.

66. An electrophotographic photosensitive member according to any of claims 58 and 59, wherein said charge transport layer contains at least one compound selected from the group consisting of oxadiazoles, hydrazones, pyrazolines and nitrofluorenones.

67. An electrophotographic photosensitive member according to claim 66, wherein said hydrazones are at least one compound selected from the group consisting of p-diethylaminobenzaldehyde-N,N-diphenylhydrazone, N-methyl-N-phenylhydrazino-3-methylidene-9-ethylcarbazole and N,N-diphenylhydrazino-3-methylidene-9-ethylcarbazole.

68. An electrophotographic photosensitive member according to claim 66, wherein said pyrazoline is 1-phenyl-3-(p-diethylaminostyryl)-5-(p-diethylaminophenyl)-pyrazoline.

69. An electrophotographic photosensitive member according to claim 66, wherein said oxadiazole is 2,5-bis(p-diethylaminophenyl)-1,3,4-oxadiazole.

70. An electrophotographic photosensitive member according to claim 66, wherein said nitrofluorenones are at least one compound selected from the group consisting of 2,4,7-trinitro-9-fluorenone, 2,4,5,7-tetranitrofluorenone and 2,4,7-trinitro-9-dicyanomethylenefluorenone.

71. An electrophotographic photosensitive member according to any of claims 58 and 65, wherein said charge generation layer contains a binder.

72. An electrophotographic photosensitive member according to claim 71, wherein said binder is polyvinyl butyral or polyesters.

73. An electrophotographic photosensitive member according to claim 59, wherein said adhesive layer contains casein.

74. An electrophotographic photosensitive member according to claim 60, wherein said charge transport material is at least one compound selected from the group consisting of hydrazones, pyrazolines and nitrofluorenones.

75. An electrophotographic photosensitive member according to claim 60, wherein said charge transport material is a hydrazones or a poly-N-vinylcarbazole.

76. An electrophotographic photosensitive member according to claim 74 or 75, wherein said hydrazones are at least one compound selected from the group consisting of p-diethylaminobenzaldehyde-N,N-diphenylhydrazine, N-methyl-N-phenylhydrazino-3-methylidene-9-ethylcarbazole and N,N-diphenylhydrazino-3-methylidene-9-ethylcarbazole.

77. An electrophotographic photosensitive member according to claim 1, wherein said dis-azo pigment is represented by the following Formula (F):

Formula (F)

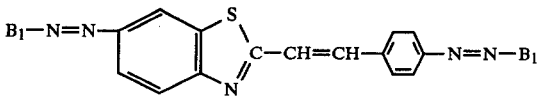

wherein $B_1$ represents a coupler residue.

78. An electrophotographic photosensitive member according to claim 77, wherein said electrophotographic photosensitive member comprises at least a conductive layer, a charge generation layer containing at least one dis-azo pigment represented by the following Formula (F), and a charge transport layer:

Formula (F)

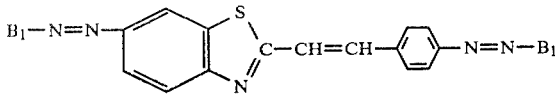

wherein $B_1$ represents a coupler residue.

79. An electrophotographic photosensitive member according to claim 78, wherein said electrophotographic photosensitive member comprises at least a conductive layer, an adhesive layer provided on said conductive layer, a charge generation layer containing at least one dis-azo pigment represented by the following Formula (F), and a charge transport layer:

Formula (F)

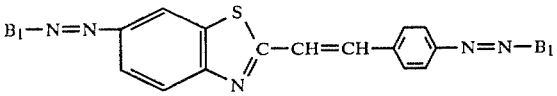

wherein $B_1$ represents a coupler residue.

80. An electrophotographic photosensitive member according to claim 77, wherein said electrophotographic photosensitive member comprises at least a conductive layer and a layer, containing at least one dis-azo pigment represented by the following Formula (F) and at least one charge transport material:

Formula (F)

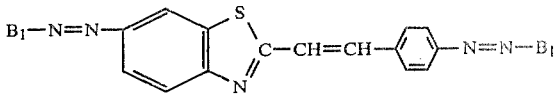

wherein $B_1$ represents a coupler residue.

81. An electrophotographic photosensitive member according to any of claims 77, 78, 79 and 80, wherein said dis-azo pigment is represented by the following Formula ($f_1$):

Formula ($f_1$)

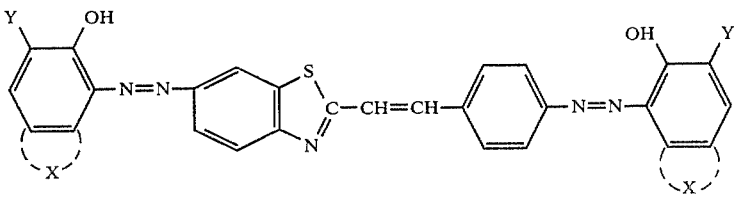

wherein X represents an atomic group forming a naphthaleneanthracene-, carbazole- or dibenzofuran-ring together with the benzene ring and Y a group of the formula

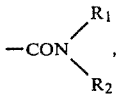

wherein $R_1$ is a hydrogen atom, an unsubstituted or substituted alkyl, or an unsubstituted or substituted phenyl group and $R_2$ an unsubstituted or substituted alkyl, or an unsubstituted or substituted aryl group.

82. An electrophotographic photosensitive member according to any of claims 77, 78, 79 and 80, wherein said dis-azo pigment is represented by the following Formula ($f_2$):

Formula ($f_2$)

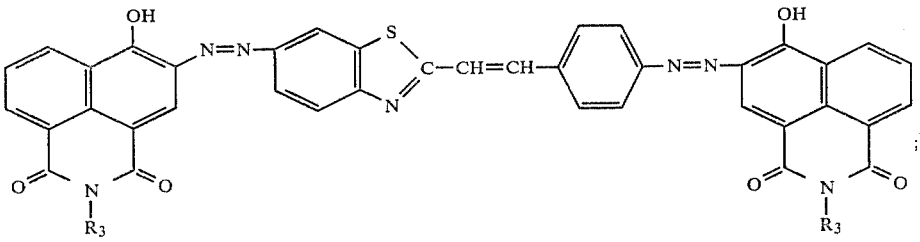

wherein $R_3$ is an unsubstituted or substituted alkyl, or an unsubstituted or substituted phenyl group.

83. An electrophotographic photosensitive member according to any of claims 77, 78, 79 and 80, wherein said dis-azo pigment is represented by the following Formula ($f_3$):

Formula ($f_3$)

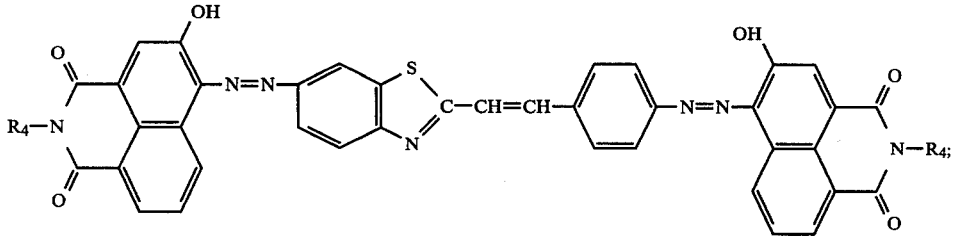

wherein $R_4$ is an unsubstituted or substituted alkyl, or an unsubstituted or substituted phenyl group.

84. An electrophotographic photosensitive member according to claim 81, wherein said $B_1$ is a coupler residue represented by Formula ($f_4$) or ($f_6$) shown below:

Formula ($f_4$)

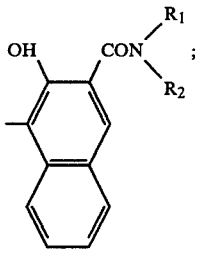

Formula ($f_5$)

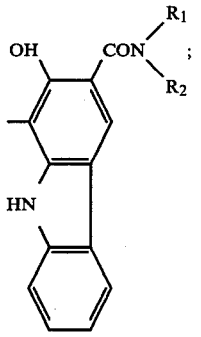

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group.

85. An electrophotographic photosensitive member according to claim 78 or 79, wherein said charge transport layer is provided on the charge generation layer.

86. An electrophotographic photosensitive member according to any of claims 78 and 79, wherein said charge transport layer contains at least one compound selected from the group consisting of oxadiazoles, hydrazones, pyrazolines and nitrofluorenones.

87. An electrophotographic photosensitive member according to claim 86, wherein said hydrazones are at least one compound selected from the group consisting of N-methyl-N-phenylhydrazino-3-methylidene-9-ethylcarbazole and N,N-diphenylhydrazino-3-methylidene-9-ethylcarbazole.

88. An electrophotographic photosensitive member according to claim 86, wherein said pyrazoline is 1-phenyl-3-(p-diethylaminostyryl)-5-(p-diethylaminophenyl)-pyrazoline.

89. An electrophotographic photosensitive member according to claim 86, wherein said oxadiazole is 2,5-bis(p-diethylaminophenyl)-1,3,4-oxadiazole.

90. An electrophotographic photosensitive member according to claim 86, wherein said nitrofluorenones are at least one compound selected from the group consisting of 2,4,7-trinitro-9-fluorenone and 2,4,7-trinitro-dicyanomethylenefluorenone.

91. An electrophotographic photosensitive member according to any of claims 78 and 79, wherein said charge generation layer contains a binder.

92. An electrophotographic photosensitive member according to claim 91, wherein said binder is polyvinyl butyral or polyesters.

93. An electrophotographic photosensitive member according to claim 79, wherein said adhesive layer contains casein.

94. An electrophotographic photosensitive member according to claim 80, wherein said charge transport material is at least one compound selected from the group consisting of hydrazones, pyrazolines and nitrofluorenones.

95. An electrophotographic photosensitive member according to claim 80, wherein said charge transport material is a hydrazones or a poly-N-vinylcarbazole.

96. An electrophotographic photosensitive member according to claim 94 or 95, wherein said hydrazones are at least one compound selected from the group consisting of N-methyl-N-phenylhydrazino-3-methylidene-9-ethylcarbazole and N,N-diphenylhydrazino-3-methylidene-9-ethylcarbazole.

97. An electrophotographic photosensitive member which comprises at least a conductive layer, a charge generation layer containing at least one dis-azo pigment represented by the following Formula (G), and a charge transport layer:

Formula (G)

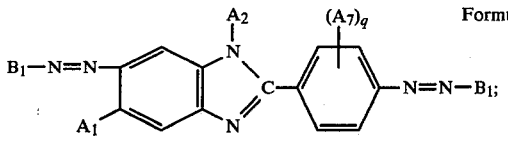

wherein $B_1$ represents a coupler residue, $A_1$ is a lower alkyl group, $A_2$ is a lower alkyl group, $A_7$ is a hydrogen atom, a halogen atom, a lower alkyl, a lower alkoxy, an acylamino or a hydroxyl group, and q is an integer of 1 to 4.

98. An electrophotographic photosensitive member according to claim 97, wherein said electrophotographic photosensitive member comprises at least a conductive layer, an adhesive layer provided on said conductive layer, a charge generation layer containing at least one dis-azo pigment represented by the following Formula (G), and a charge transport layer:

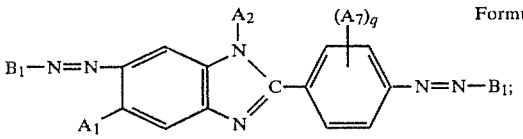

Formula (G)

wherein $B_1$ represents a coupler residue, $A_1$ is a lower alkyl group, $A_2$ is a lower alkyl group, $A_7$ is a hydrogen atom, a halogen atom, a lower alkyl, a lower alkoxy, an acylamino or a hydroxyl group, and q is an integer of 1 to 4.

99. An electrophotographic photosensitive member according to claim 126, wherein said electrophotographic photosensitive member comprises at least a conductive layer and a layer, containing at least one dis-azo pigment represented by the following Formula (G) and at least one charge transport material:

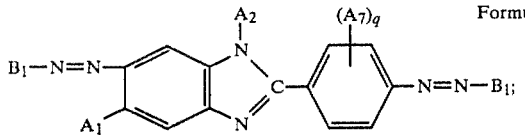

Formula (G)

wherein $B_1$ represents a coupler residue, $A_1$ is a lower alkyl group, $A_2$ is a lower alkyl group, $A_7$ is a hydrogen atom, a halogen atom, a lower alkyl, a lower alkoxy, an acylamino or a hydroxyl group, and q is an integer of 1 to 4.

100. An electrophotographic photosensitive member according to claim 97 or 98, wherein said charge transport layer is provided on the charge generation layer.

101. An electrophotographic photosensitive member according to any of claims 97 and 98, wherein said charge transport layer contains at least one compound selected from the group consisting of oxidiazoles, oxazoles, hydrazones, pyrazolines and nitrofluorenones.

102. An electrophotographic photosensitive member according to claim 101, wherein said hydrazones are at least one compound selected from the group consisting of, N-methyl-N-phenylhydrazino-3-methylidene-9-ethylcarbazole and N,N-diphenylhydrazino-3-methylidene-9-ethylcarbazole.

103. An electrophotographic photosensitive member according to claim 101, wherein said oxazole is 2-(p-diethylaminophenyl)-4-dimethylamino-5-(2-chlorophenyl-)oxazole.

104. An electrophotographic photosensitive member according to claim 101, wherein said pyrazoline is 1-phenyl-3-(p-diethylaminostyryl)-5-(p-diethylaminophenyl)pyrazoline.

105. An electrophotographic photosensitive member according to claim 101, wherein said oxadiazole is 2,5-bis(p-diethylaminophenyl)-1,3,4-oxadiazole.

106. An electrophotographic photosensitive member according to claim 101, wherein said nitrofluorenone is at least one compound selected from the group consisting of 2,4,7-trinitro-9-fluorenone, 2,4,5,7-tetranitrofluorenone and 2,4,7-trinitro-9-dicyanomethylenefluorenone.

107. An electrophotographic photosensitive member according to any of claims 97 and 98, wherein said charge generation layer contains a binder.

108. An electrophotographic photosensitive member according to claim 107, wherein said binder is polyvinyl butyral or polyesters.

109. An electrophotographic photosensitive member according to claim 98, wherein said adhesive layer contains a compound selected from casein, polyvinyl alcohol or hydroxypropyl cellulose.

110. An electrophotographic photosensitive member according to claim 99, wherein said charge transport material is at least one compound selected from the group consisting of oxazoles, oxadiazoles, hydrazones, pyrazolines and nitrofluorenones.

111. An electrophotographic photosensitive member according to claim 110, wherein said oxadiazole is 2,5-bis(p-diethylaminophenyl)-1,3,4-oxadiazole.

112. An electrophotographic photosensitive member having a photosensitive layer comprising a dis-azo pigment represented by the following Formula (H):

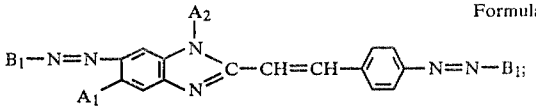

Formula (H)

wherein $B_1$ represents a coupler residue and $A_1$ and $A_2$ each is a hydrogen atom or a lower alkyl group.

113. An electrophotographic photosensitive member according to claim 112, wherein said electrophotographic photosensitive member comprises at least a conductive layer, a charge generation layer containing at least one dis-azo pigment represented by the following formula (H), and a charge transport layer:

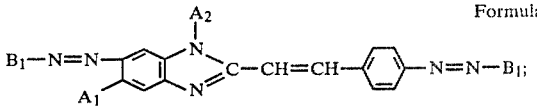

Formula (H)

wherein $B_1$ represents a coupler residue and $A_1$ and $A_2$ each is a hydrogen atom or a lower alkyl group.

114. An electrophotographic photosensitive member according to claim 113, wherein said electrophotographic photosensitive member comprises at least a conductive layer, an adhesive layer provided on said conductive layer, a charge generation layer containing at least one dis-azo pigment represented by the following Formula (H), and a charge transport layer:

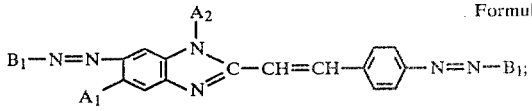

Formula (H)

wherein $B_1$ represents a coupler residue and $A_1$ and $A_2$ each is a hydrogen atom or a lower alkyl group.

115. An electrophotographic photosensitive member according to claim 112, wherein said electrophotographic photosensitive member comprises at least a conductive layer and a layer, containing at least one dis-azo pigment represented by the following Formula (H) and at least one charge transport material:

Formula (H)

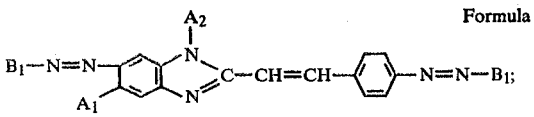

wherein $A_1$ and $A_2$ each is a hydrogen atom or a lower alkyl group and $R_3$ is an unsubstituted or substituted alkyl or an unsubstituted or substituted phenyl group.

118. An electrophotographic photosensitive member according to any of claims 112, 113, 114 and 115, wherein said dis-azo pigment is represented by the following Formula ($h_3$):

Formula ($h_3$)

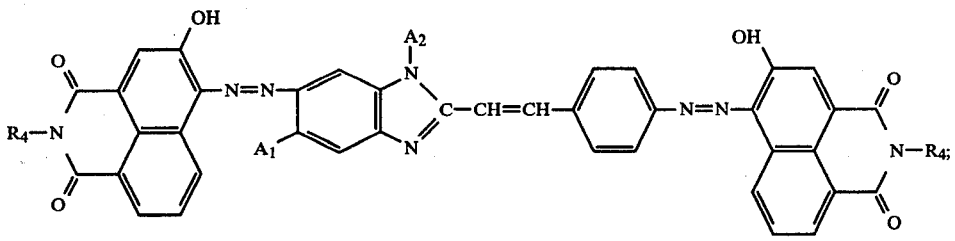

wherein $B_1$ represents a coupler residue $A_1$ and $A_2$ each is a hydrogen atom or a lower alkyl.

116. An electrophotographic photosensitive member according to any of claims 112, 113, 114 and 115, wherein said dis-azo pigment is represented by the following Formula ($h_1$):

Formula ($h_1$)

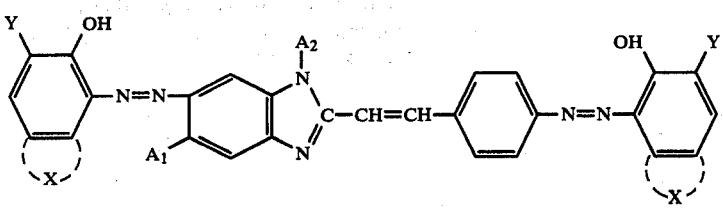

wherein $A_1$ and $A_2$ each is a hydrogen atom or a lower alkyl group, X is an atomic group forming a naphthaleneanthracene-, carbazole- or dibenzofuran-ring together with the benzene ring, and Y is a group of the formula:

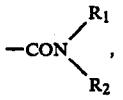

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group.

117. An electrophotographic photosensitive member according to any of claims 112, 113, 114 and 115, wherein said dis-azo pigment is represented by the following Formula ($h_2$):

Formula ($h_2$)

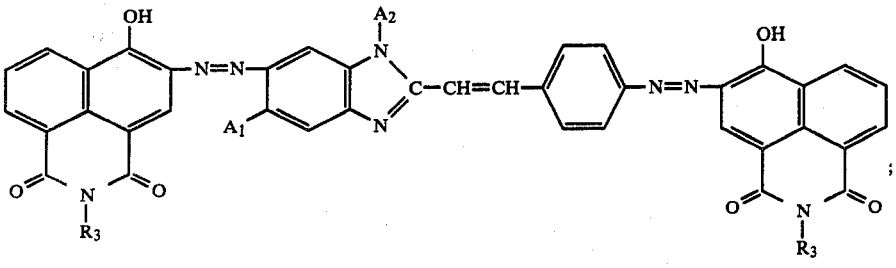

wherein $A_1$ and $A_2$ each is a hydrogen atom or a lower alkyl group and $R_4$ is an unsubstituted or substituted alkyl, or an unsubstituted or substituted phenyl group.

119. An electrophotographic photosensitive member according to claim 112, wherein said electrophotographic photosensitive member contains at least one dis-azo compound wherein said $A_1$ is a hydrogen atom or a methyl radical.

120. An electrophotographic photosensitive member according to claim 116, wherein said electrophotographic photosensitive member comprises at least one dis-azo compound wherein said $B_1$ is a coupler residue selected from any of Formulas ($h_4$), ($h_5$) and ($h_6$) shown below:

Formula ($h_4$)

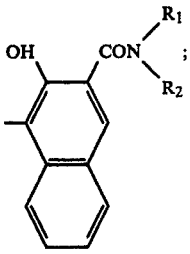

-continued

Formula ($h_5$)

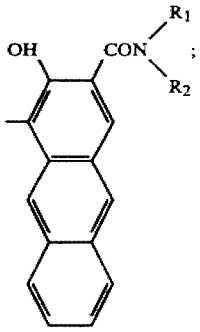

Formula ($h_6$)

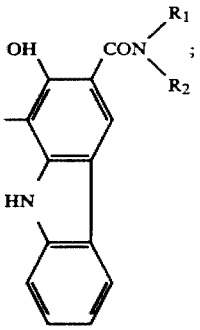

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group.

121. An electrophotographic photosensitive member according to claim 113 or 114, wherein said charge transport layer is provided on the charge generation layer.

122. An electrophotographic photosensitive member according to any of claims 113 and 114, wherein said charge transport layer contains at least one compound selected from the group consisting of diarylalkanes, oxazoles, oxadiazoles, hydrazones, pyrazolines and nitrofluorenones.

123. An electrophotographic photosensitive member according to claim 122, wherein said hydrazones are at least one compound selected from the group consisting of p-diethylaminobenzaldehyde-N,N-diphenylhydrazone, N-methyl-N-phenylhydrazino-3-methylidene-9-ethylcarbazole and N,N-diphenylhydrazino-3-methylidene-9-ethylcarbazole.

124. An electrophotographic photosensitive member according to claim 122, wherein said oxazole is 2-(p-diethylaminophenyl)-4-(p-diethylaminophenyl)-5-(o-chlorophenyl)oxazole.

125. An electrophotographic photosensitive member according to claim 122, wherein said pyrazoline is 1-phenyl-3-(p-diethylaminostyryl)-5-(p-diethylaminophenyl)pyrazoline.

126. An electrophotographic photosensitive member according to claim 122, wherein said oxadiazole is 2,5-bis(p-diethylaminophenyl)-1,3,4-oxadiazole.

127. An electrophotographic photosensitive member according to claim 122, wherein said nitrofluorenones are at least one compound selected from the group consisting of 2,4,7-trinitro-9-fluorenone, 2,4,5,7-tetranitrofluorenone, and 2,4,7-trinitro-9-dicyanomethylenefluorenone.

128. An electrophotographic photosensitive member according to claim 122, wherein said diarylalkane is 1,1-bis(p-diethylaminophenyl)propane.

129. An electrophotographic photosensitive member according to any of claims 113 and 114, wherein said charge generation layer contains a binder.

130. An electrophotographic photosensitive member according to claim 129, wherein said binder is polyvinyl butyral or polyesters.

131. An electrophotographic photosensitive member according to claim 114, wherein said adhesive layer contains a compound selected from casein, polyvinyl alcohol or hydroxypropyl cellulose.

132. An electrophotographic photosensitive member according to claim 115, wherein said charge transport material is at least one compound selected from the group consisting of hydrazones, pyrazolines and nitrofluorenones.

133. An electrophotographic photosensitive member according to claim 115, wherein said charge transport material is oxazoles or a poly-N-vinylcarbazole.

134. An electrophotographic photosensitive member according to claim 132 or 133, wherein said oxazole is 2-(p-diethylaminophenyl)-4-(p-dimethylaminophenyl)-5-(o-chlorophenyl)oxazole.

135. An electrophotographic photosensitive member having a photosensitive layer comprising a dis-azo pigment represented by the following formula (J):

Formula (J)

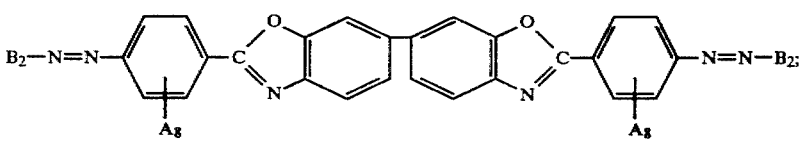

wherein $B_2$ represents a coupler residue and $A_8$ is a hydrogen atom, a halogen atom, a lower alkyl, an alkoxy, an acylamino or a nitro group.

136. An electrophotographic photosensitive member according to claim 135, wherein said electrophotographic photosensitive member comprises at least a conductive layer, a charge generation layer containing at least one dis-azo pigment represented by the following Formula (J), and a charge transport layer:

Formula (J)

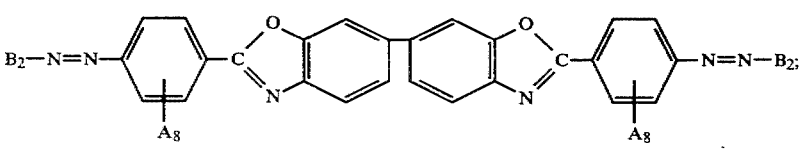

wherein $B_2$ represents a coupler residue and $A_8$ is a hydrogen atom, a halogen atom, a lower alkyl, an alkoxy, an acylamino or a nitro group.

137. An electrophotographic photosensitive member according to claim 136, wherein said electrophotographic photosensitive member comprises at least a conductive layer, an adhesive layer provided on said conductive layer, a charge generation layer containing at least one dis-azo pigment represented by the following Formula (J), and a charge transport layer:

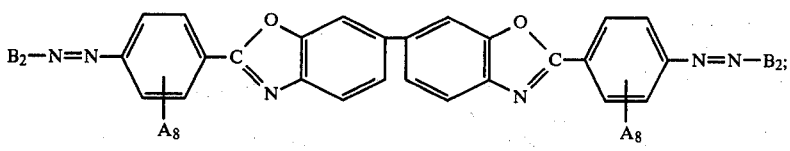

Formula (J)

wherein $B_2$ represents a coupler residue and $A_8$ is a hydrogen atom, a halogen atom, a lower alkyl, an alkoxy, an acylamino or a nitro group.

138. An electrophotographic photosensitive member according to claim 135, wherein said electrophotographic photosensitive member comprises at least a conductive layer and a layer, containing at least one dis-azo pigment represented by the following Formula (J) and at least one charge transport material:

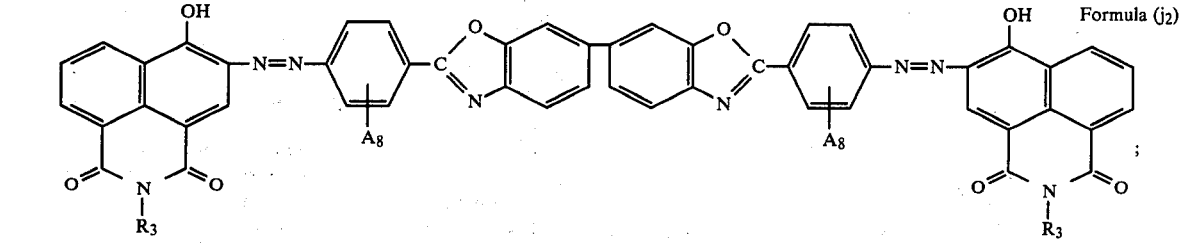

Formula (J)

wherein $B_2$ represents a coupler residue and $A_8$ is a hydrogen atom, halogen atom, a lower alkyl, an alkoxy, an acylamino or a nitro group.

139. An electrophotographic photosensitive member according to any of claims 135, 136, 137 and 138, wherein said dis-azo pigment is represented by the following Formula ($j_1$):

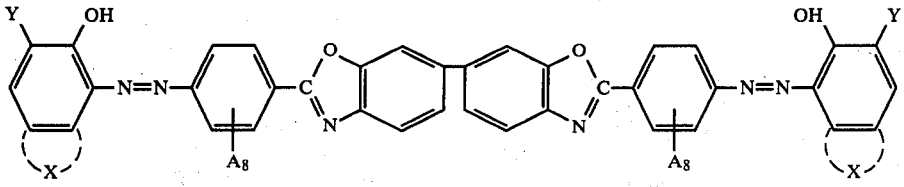

Formula ($j_1$)

wherein $A_8$ is a hydrogen atom a halogen atom a lower alkyl, an alkoxy, an acylamino or an nitro group, X is an atomic group forming a naphthalene-, anthracene-, carbazole- or dibenzofuran-ring together with the benzene ring, and Y is a group of the formula

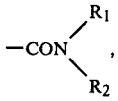

wherein $R_1$ is a hydrogen atom, an unsubstituted or substituted alkyl or an unsubstituted or substituted phenyl group and $R_2$ is an unsubstituted or substituted alkyl, an unsubstituted or substituted aryl, or a di-substituted amino group.

140. An electrophotographic photosensitive member according to any of claims 135, 136, 137 and 138, wherein said dis-azo pigment is represented by the following Formula ($j_2$):

Formula ($j_2$)

wherein $A_8$ represents a hydrogen atom, a halogen atom, a lower alkyl, an alkoxy, a nitro or an acylamino group and $R_3$ an unsubstituted or substituted alkyl, or an unsubstituted or substituted phenyl group.

141. An electrophotographic photosensitive member according to any of claims 135, 136, 137 and 138, wherein said dis-azo pigment is represented by the following Formula ($j_3$):

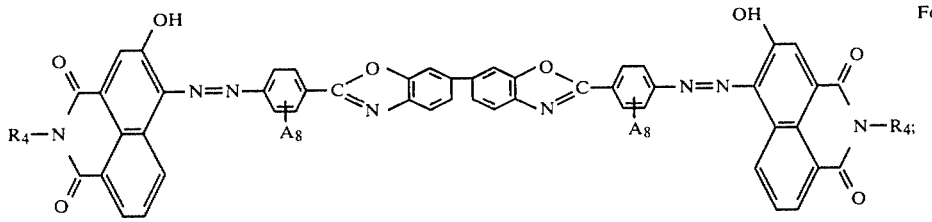

Formula (j3)

wherein $A_8$ represents a hydrogen atom, a halogen atom, a lower alkyl, an alkoxy, an acylamino or a nitro group and $R_4$ an unsubstituted or substituted alkyl, or an unsubstituted or substituted phenyl group.

142. An electrophotographic photosensitive member according to claim 135, wherein there is contained at least one dis-azo pigment wherein said $A_8$ is a hydrogen atom, a chlorine atom, a methyl or an acetylamino group.

143. An electrophotographic photosensitive member according to claim 135, wherein said $B_2$ is a coupler residue represented by Formula (j4) or (j5) shown below:

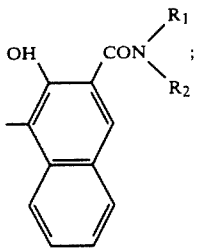

Formula (j4)

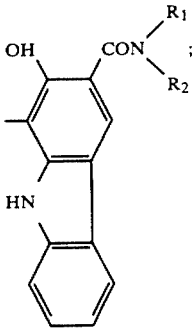

Formula (j5)

wherein $R_1$ is a hydrogen atom, an unsubstituted or substituted alkyl, or an unsubstituted or substituted phenyl group and $R_2$ is an unsubstituted or substituted alkyl, an unsubstituted or substituted aryl, or a di-substituted amino group.

144. An electrophotographic photosensitive member according to claim 136 or 137, wherein said charge transport layer is provided on the charge generation layer.

145. An electrophotographic photosensitive member according to any of claims 136 and 137, wherein said charge transport layer contains at least one compound selected from the group consisting of oxadiazoles, hydrazones, pyrazolines and nitrofluorenones.

146. An electrophotographic photosensitive member according to claim 145, wherein said hydrazones are at least one compound selected from the group consisting of p-diethylaminobenzaldehyde-N,N-diphenylhydrazone, N-methyl-N-phenylhydrazino-3-methylidene-9-ethylcarbazole and N,N-diphenylhydrazino-3-methylidene-9-ethylcarbazole.

147. An electrophotographic photosensitive member according to claim 145, wherein said pyrazolines are at least one compound selected from the group consisting of 1-phenyl-3-(p-diethylaminostyryl)-5-(p-diethylaminophenyl)pyrazoline, 1-[pyridyl-(2)]-3-(p-diethylaminostyryl)-5-(p-diethylaminophenyl)pyrazoline and 1-[quinolyl-(2)]-3-(p-diethylaminostyryl)-5-(p-diethylaminophenyl)pyrazoline.

148. An electrophotographic photosensitive member according to claim 145, wherein said oxadiazole is 2,5-bis(p-diethylaminophenyl)-1,3,4-oxadiazole.

149. An electrophotographic photosensitive member according to claim 145, wherein said nitrofluorenones are at least one compound selected from the group consisting of 2,4,7-trinitro-9-fluorenone, 2,4,5,7-tetranitrofluorenone and 2,4,7-trinitro-9-dicyanomethylenefluorenone.

150. An electrophotographic photosensitive member according to any of claims 136 and 137, wherein said charge generation layer contains a binder.

151. An electrophotographic photosensitive member according to claim 150, wherein said binder is at least one resin selected from the group consisting of polyvinyl butyral, polyvinyl acetate, polyesters, polycarbonates, phenoxy resins, acrylic resins, polyacrylamide, polyamides, polyvinyl pyridine, cellulose resins, urethane resins, epoxy resins, casein and polyvinyl alcohol.

152. An electrophotographic photosensitive member according to claim 137, wherein said adhesive layer contains casein, polyvinyl alcohol, water-soluble ethyleneacrylic acid copolymer or nitrocellulose.

153. An electrophotographic photosensitive member according to claim 138, wherein said charge transport material is at least one compound selected form the group consisting of hydrazones, pyrazolines and nitrofluorenones.

154. An electrophotographic photosensitive member according to claim 138, wherein said charge transport material consists of hydrazones and poly-N-vinylcarbazole.

155. An electrophotographic photosensitive member according to claim 153 or 154, wherein said hydrazones are at least one compound selected from the group consisting of p-diethylaminobenzaldehyde-N,N-diphenylhydrazone, N-methyl-N-phenylhydrazino-3-methylidene-9-ethylcarbazole and N,N-diphenylhydrazino-3-methylidene-9-ethylcarbazole.

156. An electrophotographic photosensitive member having a photosensitive layer, said photosensitive layer comprising at least one disazo pigment of Formula (II) shown below:

Formula (II)

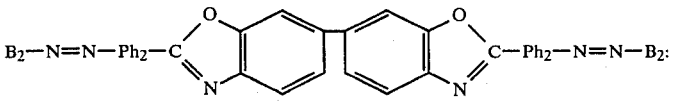

wherein $Ph_2$ is an unsubstituted or substituted phenylene group and $B_2$ is a coupler residue.

157. An electrophotographic photosensitive member comprising at least (i) a conductive layer or support, (ii) a charge generation layer containing at least one disazo pigment selected from the group consisting of Formula ($a_1$), ($a_2$), ($a_3$), ($g_1$), ($g_2$), or ($g_3$) shown below:

Formula ($a_1$)

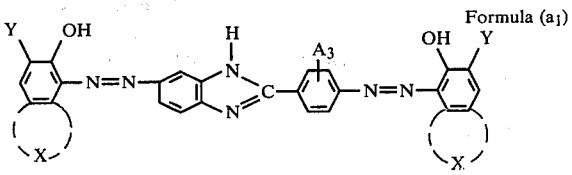

wherein $A_3$ represents a hydrogen atom, a halogen atom, a lower alkyl, an alkoxy, a nitro or an acylamino group, X is an atom group forming a naphthalene-, anthracene-, carbazole- or dibenzofuran-ring together with the benzene ring, and Y is a group of the formula

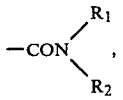

wherein $R_1$ is a hydrogen atom, an unsubstituted or substituted alkyl or an unsubstituted or substituted phenyl group and $R_2$ is an unsubstituted or substituted alkyl, an unsubstituted or substituted aryl or, a disubstituted amino group;

Formula ($a_2$)

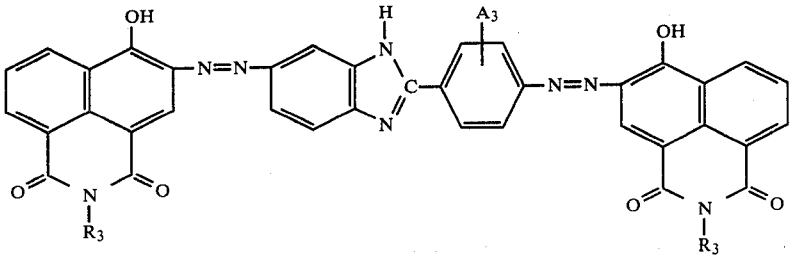

wherein $A_3$ represents a hydrogen atom, a halogen atom, a lower alkyl, an alkoxy, a nitrogen or an acylamino group and $R_3$ is an unsubstituted or substituted alkyl, or an unsubstituted or substituted phenyl group;

Formula ($a_3$)

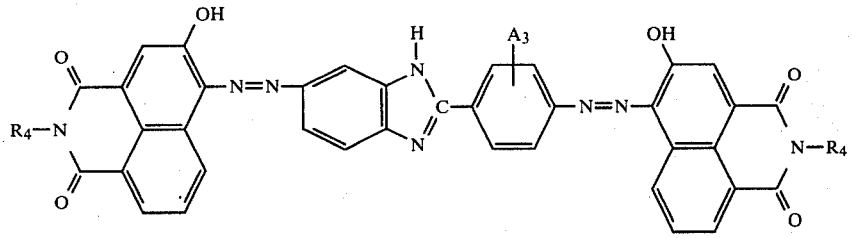

wherein $A_3$ represents a hydrogen atom, a halogen atom, a lower alkyl, an alkoxy, a nitro or an acylamino group, and $R_4$ is an unsubstituted or substituted alkyl, or an unsubstituted or substituted phenyl group;

Formula ($g_1$)

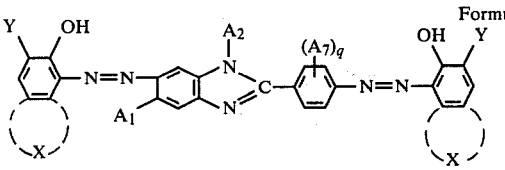

wherein $A_1$ represents a lower alkyl group, $A_2$ is a hydrogen atom, $A_7$ is a hydrogen atom, a halogen atom, a lower alkyl, a lower alkoxy, an acylamino or a hydroxyl group, g is an integer of 1 4, X is an atomic group forming a naphthalene- anthracene-, carbazole- or dibenzofuran-ring together with the benzene ring, and Y is a group of the formula

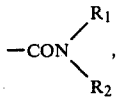

wherein $R_1$ is a hydrogen atom, an unsubstituted or substituted alkyl, or an unsubstituted or substituted phenyl group and $R_2$ is an unsubstituted or substituted alkyl, or an unsubstituted or substituted aryl group;

Formula ($g_2$)

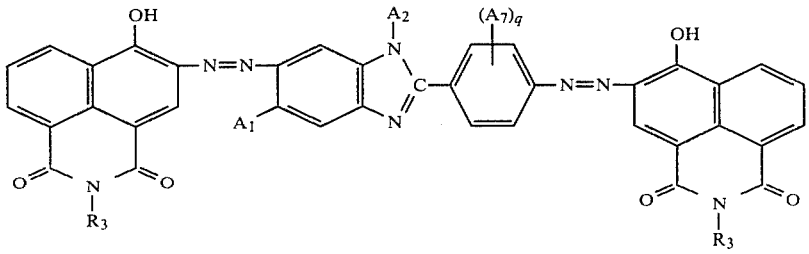

wherein $A_1$ represents a lower alkyl group, $A_2$ is a hydrogen atom, $A_7$ is a hydrogen atom, a halogen atom, a lower alkyl, a lower alkoxy, an acylamino or a hydroxyl group, and g is an integer of 1 to 4; and Formula ($g_3$)

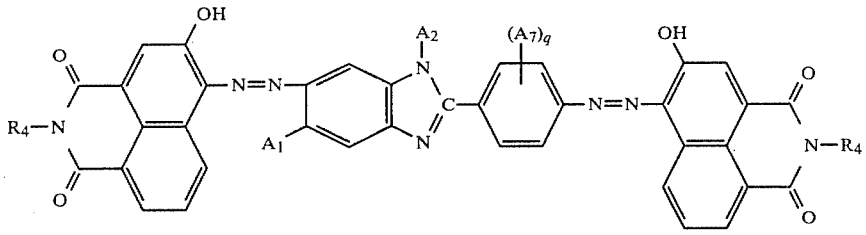

wherein $A_1$ represents a lower alkyl group, $A_2$ is a hydrogen atoms, $A_7$ is a hydrogen atom, a halogen atom, a lower alkyl, a lower alkoxy, an acylamino or a hydroxyl group, q is an integer of 1 to 4, and $R_4$ is an unsubstituted or substituted alkyl, or an unsubstituted or substituted phenyl group, and (iii) a charge transport layer.

158. An electrophotographic photosensitive member according to claim 157, wherein said electrophotographic photosensitive member comprises a conductive layer or support, an adhesive layer provided on said conductive layer, a charge generation layer containing at least one disazo pigment of said Formula ($a_1$), ($a_2$), ($a_3$), ($g_1$), ($g_2$) or ($g_3$) and a charge transport layer.

159. An electrophotographic photosensitive member according to claim 157 wherein said electrophotographic photosensitive member comprises at least a conductive layer or support and a layer, containing at least one disazo pigment of said Formula ($a_1$), ($a_2$), ($a_3$), ($g_1$), ($g_2$) or ($g_3$) and at least one charge transport material.

160. An electrophotographic photosensitive member according to claim 157, wherein said charge transport layer is provided on the charge generation layer.

161. An electrophotographic photosensitive member according to claim 157, wherein said charge transport layer contains at least one compound selected from the group consisting of oxadiazoles, hydrazones, pyrazolines and nitrofluorenones.

162. An electrophotographic photosensitive member according to claim 161, wherein said hydrazones are at least one compound selected from the group consisting of p-diethylaminobenzaldehyde-N, N-diphenylhydrazone, N-methyl-N-phenylhydrazino-3-methylidene-9-ethylcarbazole and N, N-diphenylhydrazino-3-methylidene-9-ethylcarbazole.

163. An electrophotographic photosensitive member according to claim 161, wherein said pyrazolines are at least one compound selected from the group consisting of 1-phenyl-3-(p-diethylaminostyryl)-5-(p-diethylaminophenyl)pyrazoline, 1-[pyridyl-(2)]-3-(p-diethylaminostyryl)5-(p-diethylaminophenyl)pyrazoline and 1-[quinolyl-(2)]-3-(p-diethylaminostyryl)-5-(p-diethylaminophenyl)pyrazoline.

164. An electrophotographic photosensitive member according to claim 161, wherein said nitrofluorenones are at least one compound selected from the group consisting of 2,4,7-trinitro-9-fluorenone, 2,4,5,7-tetranitrofluorenone and 2,4,7-trinitro-9-dicyanomethylenefluorenone.

165. An electrophotographic photosensitive member according to claim 161, wherein said oxadiazole is 2,5-bis(p-diethylaminophenyl)-1,3,4-oxadiazole.

166. An electrophotographic photosensitive member according to claim 157, wherein said charge generation layer contains a binder.

167. An electrophotographic photosensitive member according to claim 166, wherein said binder is at least one resin selected from the group consisting of polyvinyl butyral, polyvinyl acetate, polyesters, polycarbonates, phenoxy resins, acrylic resins, polyacrylamide, polyamides, polyvinyl pyridine, cellulose resins, urethane resins, epoxy resins, casein and polyvinyl alcohol.

168. An electrophotographic photosensitive member according to claim 158, wherein said adhesive layer contains at least one resin selected from the group consisting of casein, polyvinyl alcohol, water-soluble ethylene-acrylic acid copolymer and nitrocellulose.

169. An electrophotographic photosensitive member according to claim 158, wherein said charge transport material is at least one compound selected from the group consisting of oxadiazoles, hydrazones, pyrazolines and nitrofluorenones.

170. An electrophotographic photosensitive member according to claim 159, wherein said charge transport material consists of hydrazones and poly-N-vinylcarbazole.

171. An electrophotographic photosensitive member according to claim 169, wherein said hydrazones are at least one compound selected from the group consisting of p-diethylaminobenzaldehyde-N, N-diphenylhydrazone, N-methyl-N-phenylhydrazino-3-methylidene-9-ethylcarbazole and N, N-diphenylhydrazino-3-methylidene-9-ethylcarbazole.

* * * * *

UNITED STATES PATENT AND TRADEMARK OFFICE

CERTIFICATE OF CORRECTION

PATENT NO. : 4,471,040

DATED : September 11, 1984

INVENTOR(S) : Katagiri et al.

It is certified that error appears in the above-identified patent and that said Letters Patent is hereby corrected as shown below:

IN THE ABSTRACT ON THE TITLE PAGE:

Line 1, change "have" to --having--.

Column 1, line 39, change "scarecly" to --scarcely--.

line 55, change "much" to --many--.

Column 3, line 58, insert --(III)-- to the right side of formula.

Column 16, line 55, delete "an".

Column 17, line 4, insert --at-- after "arrive".

Column 18, line 8, insert --of-- after "purpose".

line 15, change "a wide applications of" to --many applications in--.

lines 56 and 57, change "Sritting" to --Stirring--.

Column 23, line 38, change "$V_o$=580 V" to --$V_o$-580V--.

line 59, change "varpor" to --vapor--.

UNITED STATES PATENT AND TRADEMARK OFFICE

CERTIFICATE OF CORRECTION

PATENT NO. : 4,471,040

DATED : September 11, 1984

INVENTOR(S) : Katagiri et al.

It is certified that error appears in the above-identified patent and that said Letters Patent is hereby corrected as shown below:

Column 24, line 20, under "Table 3" insert subheading --(Pigments used)--.

Column 31, line 33, change

" 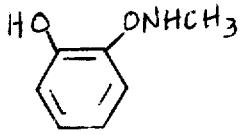 " to -- 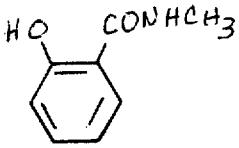 --.

Column 32, line 68, change "to" (1st occurrence) to --as--.

Column 33, line 22, change "to describe" to --as described--.

Column 37, line 67, change "to" (1st occurrence) to --as--.

Column 41, line 20, change "5g f" to 5g of--.

line 40, change "to" to --as--.

Column 42, line 29, change "to" (1st occurrence) to --as--.

UNITED STATES PATENT AND TRADEMARK OFFICE

CERTIFICATE OF CORRECTION

PATENT NO. : 4,471,040

DATED : September 11, 1984

INVENTOR(S) : Katagiri et al.

It is certified that error appears in the above-identified patent and that said Letters Patent is hereby corrected as shown below:

Column 43, line 27, change

" 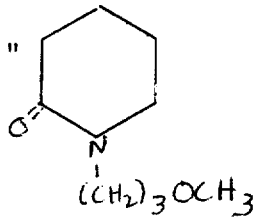 " to -- 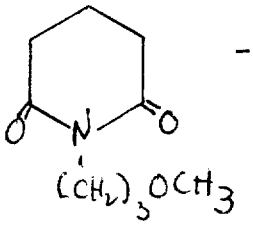 --.

Column 46, line 67, change "to" (1st occurrence) to --as--.

Column 63, line 24, under heading "E 1/2", change "9.4" to --9.6--.

Column 64, line 23, insert --being-- before "conditioned".

Claim 8, line 3, change "chlorin" to --chlorine--.

Claim 22, line 13, change "grouop" to --group--.

Claim 71, line 2, change "65" to --59--.

Claim 75, line 3, change "hydrazones" to --hydrazone--.

UNITED STATES PATENT AND TRADEMARK OFFICE

CERTIFICATE OF CORRECTION

PATENT NO. : 4,471,040

DATED : September 11, 1984 Page 4 of 4

INVENTOR(S) : Katagiri et al.

It is certified that error appears in the above-identified patent and that said Letters Patent is hereby corrected as shown below:

Claim 84, line 3, change "(f6)" to --(f5)--.

Claim 99, line 2, change "126" to --156--.

Claim 143, line 2, change "135" to --139--.

Col. 98, Claim 157, line 41, change "14" to --1 to 4--.

Col. 99, Claim 157, line 29, change "atoms" to --atom--.

Signed and Sealed this

*Fifteenth* Day of *October 1985*

[SEAL]

*Attest:*

*Attesting Officer*

DONALD J. QUIGG

*Commissioner of Patents and Trademarks—Designate*